US011653721B2

(12) United States Patent
Jessup et al.

(10) Patent No.: US 11,653,721 B2
(45) Date of Patent: May 23, 2023

(54) SEAT BELT APPARATUS AND BUCKLE

(71) Applicant: Indiana Mills & Manufacturing, Inc., Westfield, IN (US)

(72) Inventors: Chris P. Jessup, Sheridan, IN (US); Allan Lortz, Zionsville, IN (US); Guy R. Dingman, Idaville, IN (US); Brian Nelson Coffman, Gurley, AL (US); Yang Tao, Meicun town Xinwu (CN)

(73) Assignee: Indiana Mills Manufacturing, Inc., Westfield, IN (US)

( * ) Notice: Subject to any disclaimer, the term of this patent is extended or adjusted under 35 U.S.C. 154(b) by 0 days.

(21) Appl. No.: 17/249,883

(22) Filed: Mar. 17, 2021

(65) Prior Publication Data

US 2021/0204658 A1 Jul. 8, 2021

Related U.S. Application Data

(63) Continuation of application No. PCT/US2019/051725, filed on Sep. 18, 2019.

(60) Provisional application No. 62/732,707, filed on Sep. 18, 2018.

(51) Int. Cl.
*A44B 11/25* (2006.01)

(52) U.S. Cl.
CPC ..... *A44B 11/2523* (2013.01); *A44B 11/2549* (2013.01)

(58) Field of Classification Search
CPC ..... A44B 11/2546; A44B 11/2503; Y10T 24/45639; B60R 22/18; B60R 22/48
See application file for complete search history.

(56) References Cited

U.S. PATENT DOCUMENTS

| | | | |
|---|---|---|---|
| 5,023,981 | A | 6/1991 | Anthony et al. |
| 5,038,446 | A | 8/1991 | Anthony et al. |
| 5,142,748 | A | 9/1992 | Anthony et al. |
| D342,465 | S | 12/1993 | Anthony et al. |
| 5,283,933 | A | 2/1994 | Wiseman et al. |
| D364,124 | S | 11/1995 | Lortz et al. |

(Continued)

FOREIGN PATENT DOCUMENTS

| | | | |
|---|---|---|---|
| CN | 208585129 | U | 3/2019 |
| CN | 104908705 | B | 1/2020 |

(Continued)

OTHER PUBLICATIONS

PCT, Intl. App. No. PCT/US2019/051725 International Search Report, 3 pages, dated Jan. 3, 2020.

(Continued)

*Primary Examiner* — Robert Sandy
*Assistant Examiner* — Michael S Lee
(74) *Attorney, Agent, or Firm* — Woodard, Emhardt, Henry, Reeves & Wagner, LLP

(57) ABSTRACT

A buckle has a buckle mechanism with a lock pawl and a latch pin. The latch pin is designed to travel only in a longitudinal or horizontal direction relative to the buckle mechanism. When a latch plate assembly is secured, the latch pin holds the lock pawl in a latched position and prevents accidental release of the latch plate assembly. A release button is coupled to the latch plate retention bar so that all of the effective actuation and other motions are in the longitudinal direction of the buckle mechanism. The buckle mechanism has an ejector mechanism with an ejection spring for ejecting the latch plate assembly.

36 Claims, 35 Drawing Sheets

(56) References Cited

U.S. PATENT DOCUMENTS

| | | | |
|---|---|---|---|
| 5,813,097 | A | 9/1998 | Woellert et al. |
| D407,667 | S | 4/1999 | Homeier |
| 6,606,770 | B1 | 8/2003 | Badrenas Buscart |
| 6,868,591 | B2 | 3/2005 | Dingman et al. |
| 7,124,481 | B2 | 10/2006 | Sato et al. |
| 7,240,407 | B2 | 7/2007 | Kawai et al. |
| 8,190,332 | B2 | 5/2012 | Saban |
| 8,434,203 | B2 | 5/2013 | Morgan et al. |
| RE45,114 | E | 9/2014 | Maguire, Jr. |
| 9,266,535 | B2 | 2/2016 | Schoenberg |
| 9,333,941 | B2 | 5/2016 | Ikeda |
| 9,424,728 | B2 | 8/2016 | Rambadt et al. |
| 9,457,716 | B2 | 10/2016 | Westmoreland |
| 9,573,541 | B2 | 2/2017 | Graumann et al. |
| 9,663,032 | B1 | 5/2017 | Appukutty et al. |
| 9,789,786 | B2 | 10/2017 | Westmoreland |
| 9,814,282 | B2 | 11/2017 | Merrick |
| 10,052,979 | B2 | 8/2018 | Schonfeld et al. |
| D888,611 | S | 6/2020 | Anthony et al. |
| 2003/0090133 | A1 | 5/2003 | Nathan et al. |
| 2006/0057900 | A1 | 3/2006 | Lawrence et al. |
| 2006/0163923 | A1 | 7/2006 | Baumann et al. |
| 2009/0309346 | A1 | 12/2009 | Van Druff et al. |
| 2010/0253498 | A1 | 10/2010 | Rork et al. |
| 2010/0263176 | A1 | 10/2010 | Lee et al. |
| 2013/0201013 | A1 | 8/2013 | Schoenberg |
| 2014/0184404 | A1 | 7/2014 | Schoenberg et al. |
| 2014/0292503 | A1 | 10/2014 | Schoenberg |
| 2014/0354022 | A1 | 12/2014 | Szakelyhidi et al. |
| 2017/0042293 | A1 | 2/2017 | Jin et al. |
| 2018/0043860 | A1 | 2/2018 | Bailliard et al. |
| 2018/0078001 | A1 | 3/2018 | Babin et al. |
| 2020/0058210 | A1 | 2/2020 | Williams et al. |
| 2020/0269807 | A1 | 8/2020 | Tardif |

FOREIGN PATENT DOCUMENTS

| | | | |
|---|---|---|---|
| CN | 110654343 | A | 1/2020 |
| CN | 110723037 | A | 1/2020 |
| CN | 110742590 | A | 2/2020 |
| CN | 210212326 | U | 3/2020 |
| CN | 107031559 | B | 5/2021 |
| EP | 1755914 | B1 | 4/2015 |
| EP | 3904156 | A1 | 11/2021 |
| FR | 2866846 | A1 | 5/2006 |
| JP | 2646379 | B2 | 8/1997 |
| WO | 2008107494 | A1 | 9/2008 |
| WO | 2018158605 | A1 | 9/2018 |
| WO | 2020088182 | A1 | 5/2020 |
| WO | 2020134031 | A1 | 7/2020 |

OTHER PUBLICATIONS

PCT, Intl. App. No. PCT/US2019/051725 Written Opinion of the International Searching Authority, 8 pages, dated Jan. 3, 2020.

SEAT BELT APPARATUS AND BUCKLE

CROSS REFERENCE TO RELATED APPLICATIONS

This application is a continuation of International Patent Application Number PCT/US2019/051725, filed Sep. 18, 2019, which is hereby incorporated by reference. International Patent Application Number PCT/US2019/051725, filed Sep. 18, 2019, claims the benefit of U.S. Patent Application No. 62/732,707, filed Sep. 18, 2018, which are hereby incorporated by reference.

BACKGROUND

Harness systems are commonly used in child car seats and other vehicular restraint systems. Various harness configurations, such as with 3-point or 5-point harnesses, can be used to restrain occupants inside the vehicle. Buckles are typically used to join together the various webs forming the harness so as to secure the occupant in the seat. The buckle needs remain locked and withstand significant forces that occur during an accident, and at the same time, the buckle needs to be able to be repeatedly unlocked to facilitate removal of the occupant from the harness. At times, it can also be difficult to determine whether the restraint systems are properly buckled.

Thus, there is a need for improvement in this field.

SUMMARY

A buckle system, such as for use in vehicular restraint systems like child car seats, has been developed to address a number of issues. The buckle system includes a unique buckle design that not only improves safety and ease of use but that also simplifies manufacturing and can reduce cost by reducing the number of components required. The buckle has a buckle mechanism with a unique lock pawl and latch pin. The latch pin is designed to travel only in a longitudinal or horizontal direction relative to the buckle mechanism. When a latch plate assembly is secured, the latch pin holds the lock pawl in a latched position and prevents accidental release of the latch plate assembly. A release button is coupled to the latch plate retention bar so that all of the effective actuation and other motions are in the longitudinal direction of the buckle mechanism. The buckle mechanism has an ejector mechanism with an ejection spring for ejecting the latch plate assembly. Earlier designs purely relied on the ejection spring to eject the latch plate assembly. However, the force applied by the ejection spring can deteriorate over time, such as by debris like food crumbs being trapped between the coils of the ejection spring. The lock pawl is configured to mechanically actuate the ejector mechanism so as to eject the latch plate assembly when the release button is actuated. The buckle can further include an indicator and/or a sensor for determining whether the latch plate assembly is properly buckled to the buckle.

Aspect 1 generally concerns a system that includes a buckle with a longitudinally slidable pin configured to lock a lock pawl.

Aspect 2 generally concerns the system of aspect 1 in which the buckle includes a buckle mechanism configured to releasably secure one or more latch plates.

Aspect 3 generally concerns the system of aspect 2 in which the buckle mechanism includes a latch mechanism, a release mechanism, and an ejector mechanism.

Aspect 4 generally concerns the system of aspect 3 in which the latch mechanism includes the pin and the lock pawl configured to engage the latch plates.

Aspect 5 generally concerns the system of aspect 4 in which the buckle mechanism includes a frame with one or more pivot notches pivotally engaged to the lock pawl.

Aspect 6 generally concerns the system of aspect 5 in which the frame has one or more pin guide slots extending in a longitudinal direction in which the pin is slidably received.

Aspect 7 generally concerns the system of aspect 4 in which the release mechanism includes one or more release springs seated to one or more spring seat fingers on the lock pawl.

Aspect 8 generally concerns the system of aspect 7 in which the release mechanism includes a release button.

Aspect 9 generally concerns the system of aspect 8 in which the release springs are disposed between the release button and the spring seat fingers.

Aspect 10 generally concerns the system of aspect 9 in which the release button includes a spring retainer in which the release springs are seated.

Aspect 11 generally concerns the system of aspect 10 in which the spring retainer has one or more latch pin engagement channels in which the pin is received.

Aspect 12 generally concerns the system of aspect 11 in which the release button includes a cap body with clip arms secured to the latch pin engagement channels to retain the pin.

Aspect 13 generally concerns the system of aspect 12 in which the clip arms each have a latch pin contact surface configured to move the latch pin.

Aspect 14 generally concerns the system of aspect 8 in which the lock pawl has one or more cam arms engageable by the pin to secure the lock pawl in a latched position.

Aspect 15 generally concerns the system of aspect 14 in which the release button is secured to the pin to actuate the pin to a position where the lock pawl is released.

Aspect 16 generally concerns the system of aspect 4 in which the lock pawl has one or more ejector fingers that are engageable with the ejector mechanism.

Aspect 17 generally concerns the system of aspect 4 in which the lock pawl has a nose tab to contact a tab guide on the ejector mechanism to inhibit latching after latch plate ejection.

Aspect 18 generally concerns the system of aspect 4 in which the ejector mechanism includes an ejector swivel configured to swivel to stop latching when a single latch plate is inserted.

Aspect 19 generally concerns the system of aspect 18 in which the ejector swivel is configured to redirect the single plate to stop latching of the pawl with the single plate.

Aspect 20 generally concerns the system of aspect 3 in which the ejector mechanism includes a slider slidably received in a guide slot in a frame.

Aspect 21 generally concerns the system of aspect 20 in which the slider has one or more retention tabs oriented to be received in corresponding notches in the guide slot.

Aspect 22 generally concerns the system of aspect 20 in which the ejector mechanism includes an ejector spring disposed between the slider and a spring seat flange of the frame.

Aspect 23 generally concerns the system of aspect 1 in which the buckle has a release button with an indicator that indicates when the buckle is properly secured.

Aspect 24 generally concerns the system of aspect 1 in which the buckle includes a sensor for sensing a state of the buckle.

Aspect 25 generally concerns the system of aspect 1 in which the buckle secures at least two latch plates.

Aspect 26 generally concerns the system of aspect 25 in which the latch plates include a latch plate alignment system configured to align the latch plates.

Aspect 27 generally concerns the system of aspect 26 in which the latch plate alignment system includes one or more magnets on the latch plates.

Aspect 28 generally concerns the system of aspect 26 in which the latch plate alignment system includes one or more alignment protrusions and one or more alignment cavities on the latch plates.

Aspect 29 generally concerns the system of any previous aspect in which the buckle includes a buckle mechanism configured to releasably secure one or more latch plates.

Aspect 30 generally concerns the system of any previous aspect in which the buckle mechanism includes a latch mechanism, a release mechanism, and an ejector mechanism.

Aspect 31 generally concerns the system of any previous aspect in which the latch mechanism includes the pin and the lock pawl configured to engage the latch plates.

Aspect 32 generally concerns the system of any previous aspect in which the buckle mechanism includes a frame with one or more pivot notches pivotally engaged to the lock pawl.

Aspect 33 generally concerns the system of any previous aspect in which the frame has one or more pin guide slots extending in a longitudinal direction in which the pin is slidably received.

Aspect 34 generally concerns the system of any previous aspect in which the release mechanism includes one or more release springs seated to one or more spring seat fingers on the lock pawl.

Aspect 35 generally concerns the system of any previous aspect in which the release mechanism includes a release button.

Aspect 36 generally concerns the system of any previous aspect in which the release springs are disposed between the release button and the spring seat fingers.

Aspect 37 generally concerns the system of any previous aspect in which the release button includes a spring retainer in which the release springs are seated.

Aspect 38 generally concerns the system of any previous aspect in which the spring retainer has one or more latch pin engagement channels in which the pin is received.

Aspect 39 generally concerns the system of any previous aspect in which the release button includes a cap body with clip arms secured to the latch pin engagement channels to retain the pin.

Aspect 40 generally concerns the system of any previous aspect in which the clip arms each have a latch pin contact surface configured to move the latch pin.

Aspect 41 generally concerns the system of any previous aspect in which the lock pawl has one or more cam arms engageable by the pin to secure the lock pawl in a latched position.

Aspect 42 generally concerns the system of any previous aspect in which the release button is secured to the pin to actuate the pin to a position where the lock pawl is released.

Aspect 43 generally concerns the system of any previous aspect in which the lock pawl has one or more ejector fingers that are engageable with the ejector mechanism.

Aspect 44 generally concerns the system of any previous aspect in which the lock pawl has a nose tab to contact a tab guide on the ejector mechanism to inhibit latching after latch plate ejection.

Aspect 45 generally concerns the system of any previous aspect in which the ejector mechanism includes an ejector swivel configured to swivel to stop latching when a single latch plate is inserted.

Aspect 46 generally concerns the system of any previous aspect in which the ejector swivel is configured to redirect the single plate to stop latching of the pawl with the single plate.

Aspect 47 generally concerns the system of any previous aspect in which the ejector mechanism includes a slider slidably received in a guide slot in a frame.

Aspect 48 generally concerns the system of any previous aspect in which the slider has one or more retention tabs oriented to be received in corresponding notches in the guide slot.

Aspect 49 generally concerns the system of any previous aspect in which the ejector mechanism includes an ejector spring disposed between the slider and a spring seat flange of the frame.

Aspect 50 generally concerns the system of any previous aspect in which the buckle has a release button with an indicator that indicates when the buckle is properly secured.

Aspect 51 generally concerns the system of any previous aspect in which the buckle includes a sensor for sensing a state of the buckle.

Aspect 52 generally concerns the system of any previous aspect in which the buckle secures at least two latch plates.

Aspect 53 generally concerns the system of any previous aspect in which the latch plates include a latch plate alignment system configured to align the latch plates.

Aspect 54 generally concerns the system of any previous aspect in which the latch plate alignment system includes one or more magnets on the latch plates.

Aspect 55 generally concerns the system of any previous aspect in which the latch plate alignment system includes one or more alignment protrusions and one or more alignment cavities on the latch plates.

Aspect 56 generally concerns a method of operating the system of any previous aspect.

Further forms, objects, features, aspects, benefits, advantages, and embodiments of the present invention will become apparent from a detailed description and drawings provided herewith.

DETAILED DESCRIPTION OF SELECTED EMBODIMENTS

Figure 1:
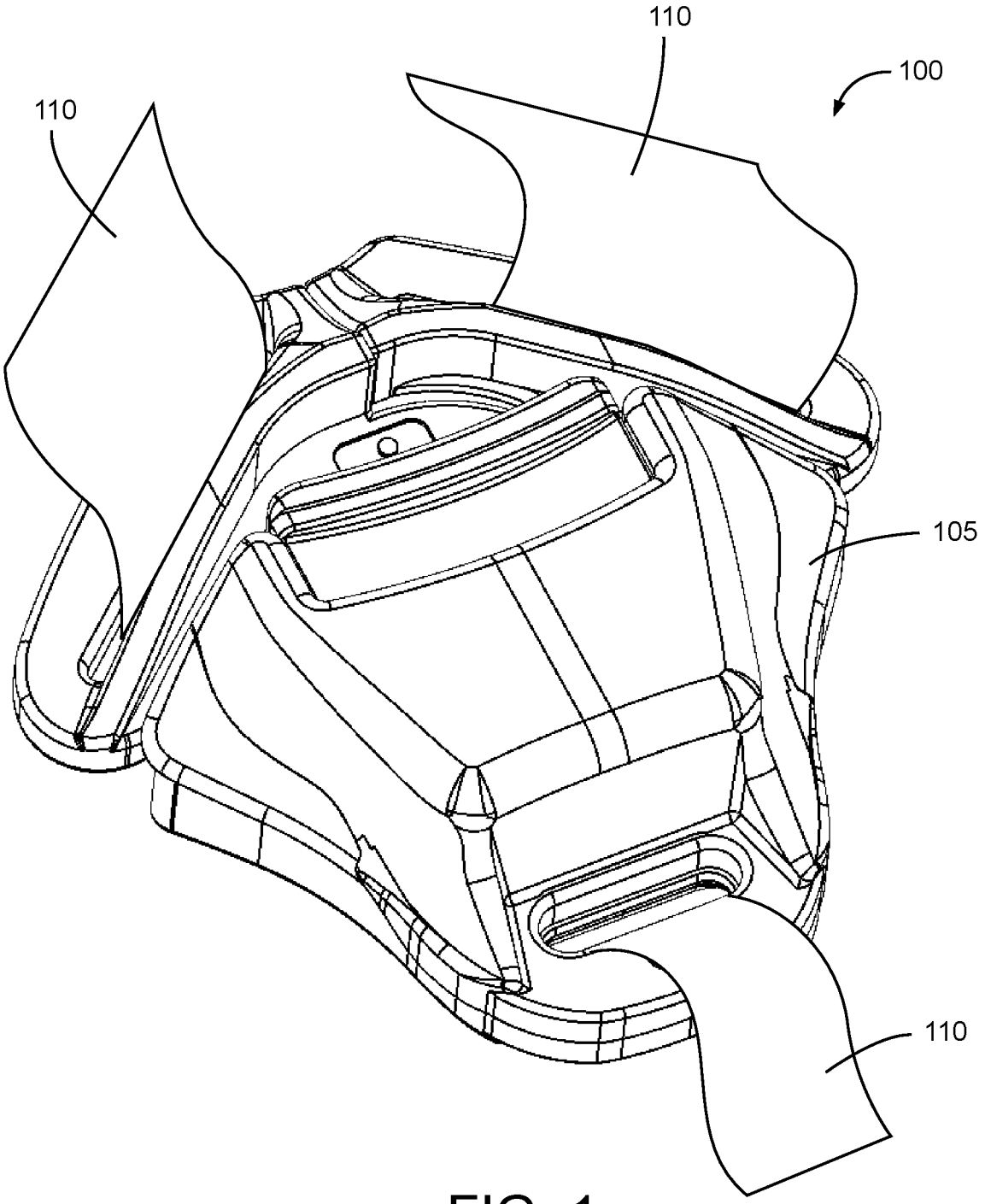
FIG. 1 is a top perspective view of a harness system according to one example.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

The reference numerals in the following description have been organized to aid the reader in quickly identifying the drawings where various components are first shown. In particular, the drawing in which an element first appears is typically indicated by the left-most digit(s) in the corresponding reference number. For example, an element identified by a "100" series reference numeral will likely first appear in FIG. 1, an element identified by a "200" series reference numeral will likely first appear in FIG. 2, and so on.

A harness system 100 is illustrated in FIG. 1. The harness system 100 includes a buckle system 105 to which webbing 110 is secured. In one example, the harness system 100 is used in a vehicle restraint system, such as a child car seat, but the harness system 100 can be used in other environments.

Figure 2:
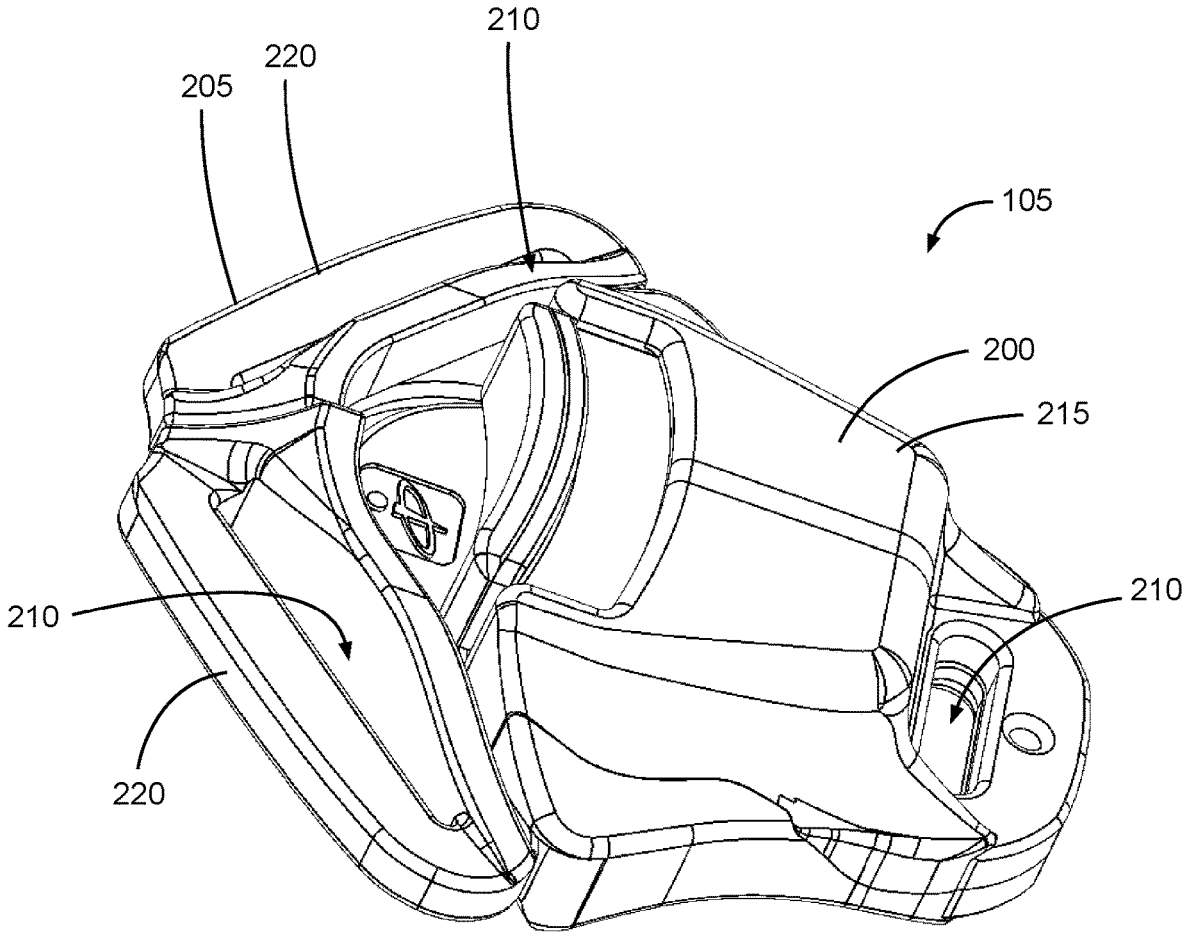
FIG. 2 is a side perspective view of a buckle system shown in FIG. 1.

Turning to FIG. 2, the buckle system 105 includes a buckle 200 to which a latch plate assembly 205 is buckled. The buckle 200 and latch plate assembly 205 include one or more web slots 210 to which the webbing 110 is secured. As shown, the buckle 200 has a housing 215 for protecting its internal components. The latch plate assembly 205 includes one or more latch plates 220 that are secured to the buckle 200. In the illustrated example, the latch plate assembly 205 includes two (2) latch plates 220 that are coupled together before being inserted into the buckle 200, but the latch plate assembly 205 in other examples can includes more or less latch plates 220 than is shown.

Figure 3:
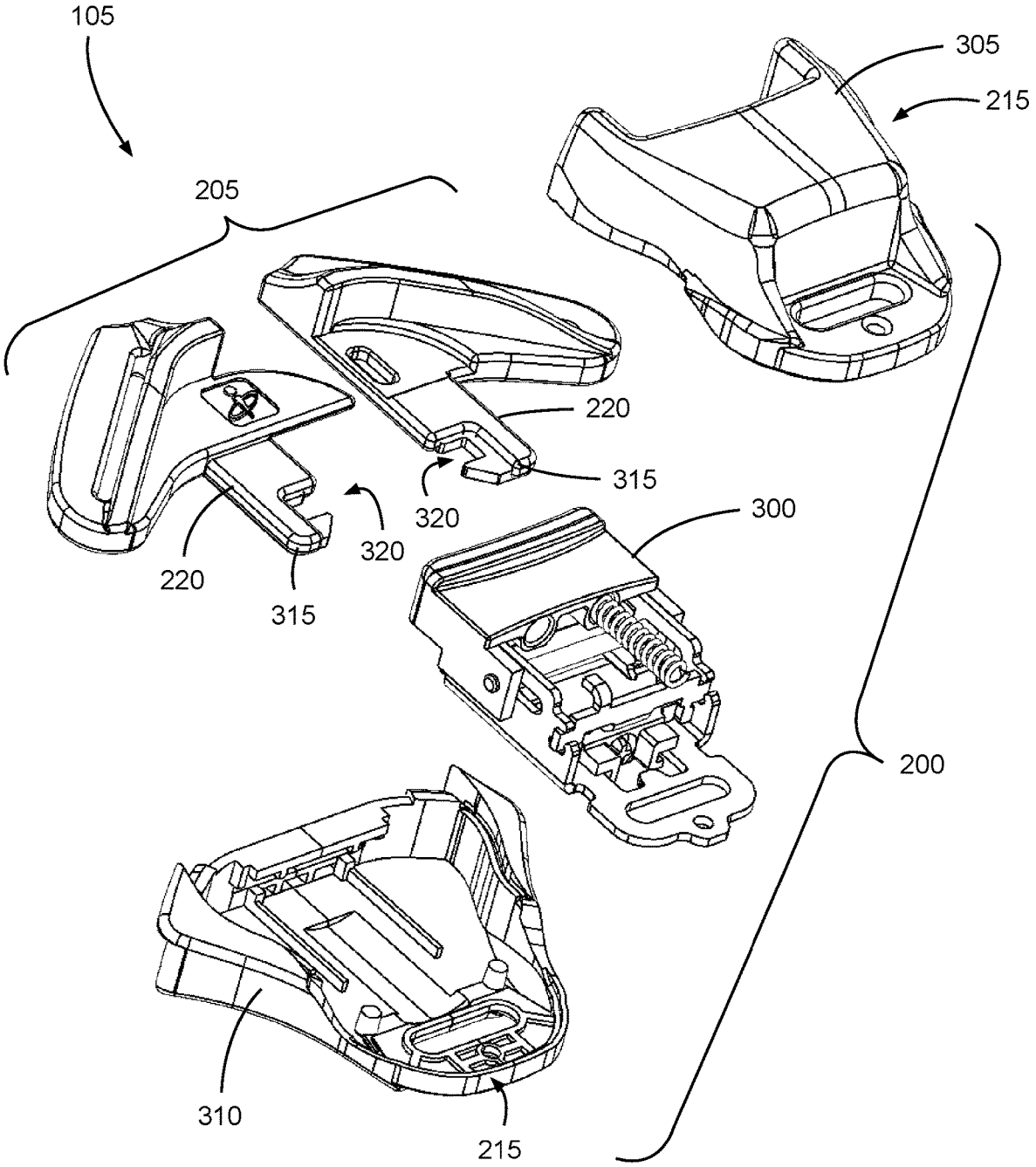
FIG. 3 is an exploded view of a buckle shown in FIG. 2.

An exploded view of the buckle system 105 is depicted in FIG. 3. As shown, the buckle 200 includes a buckle mechanism 300 that is attached by the housing 215. The housing 215 of the buckle 200 includes a mechanism cover 305 and a base cover 310 that are coupled together in a clamshell type configuration around the buckle mechanism 300. Each of the latch plates 220 of the latch plate assembly 205 have a tongue 315 with a latch notch 320. When the latch plates 220 are coupled together, the latch plate assembly 205 can then be inserted into the buckle mechanism 300 of the buckle 200.

Figure 4:
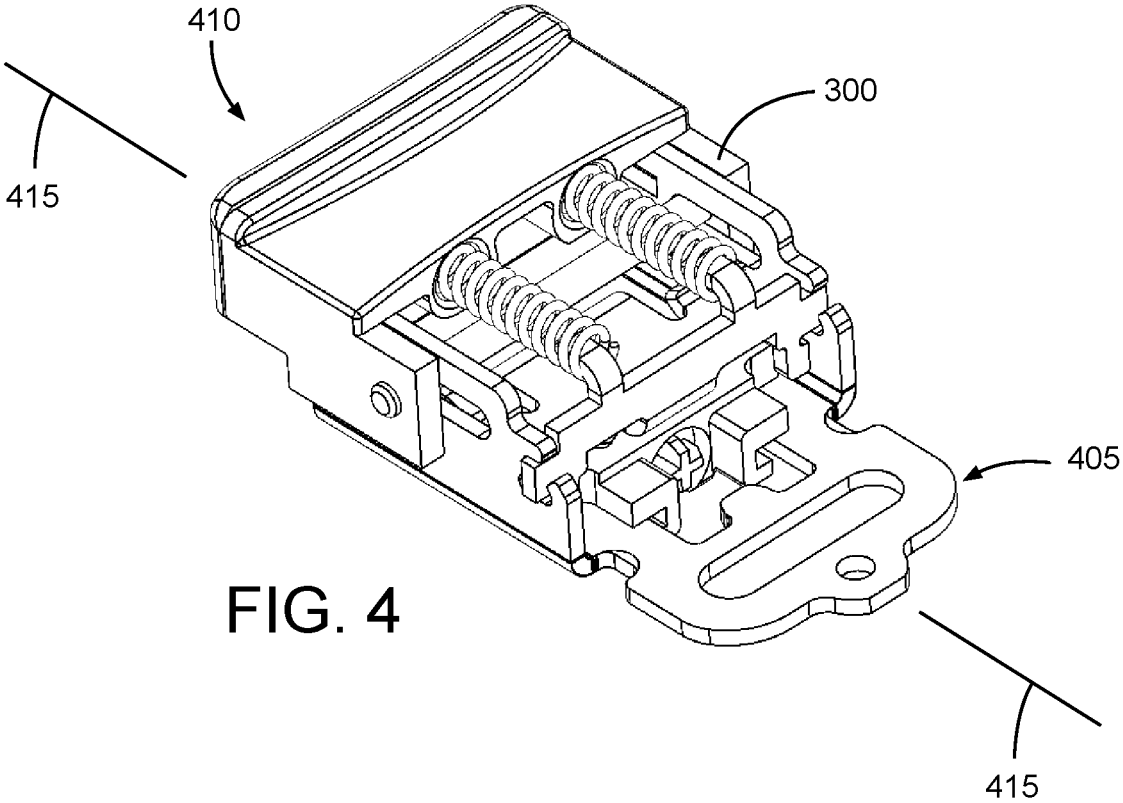
FIG. 4 is a top perspective view of a buckle mechanism shown in FIG. 3.
Figure 5:
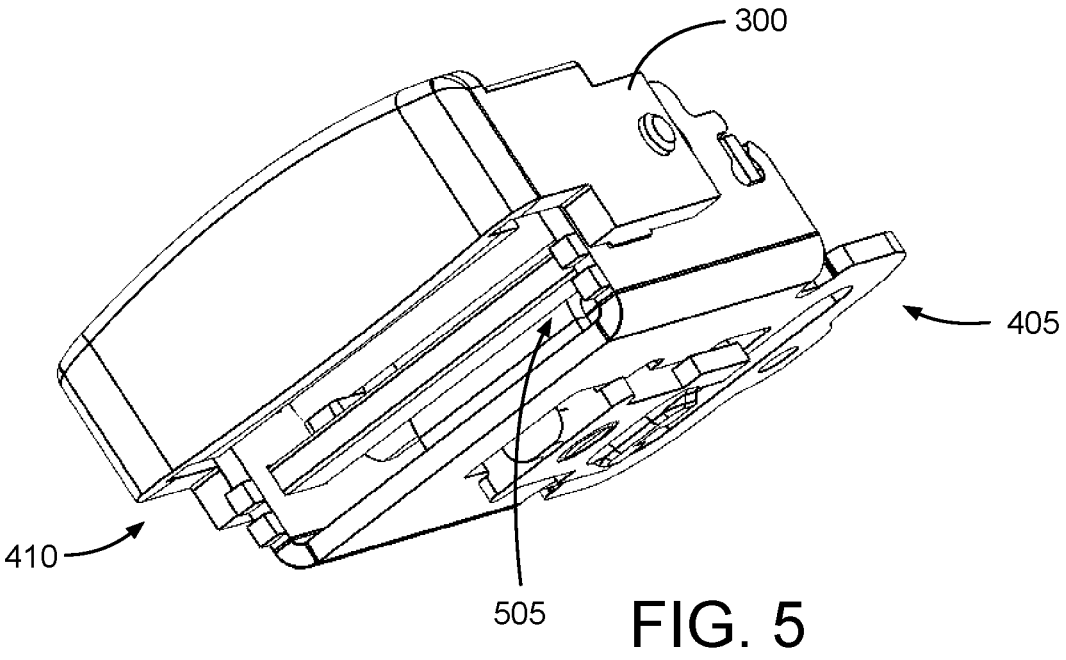
FIG. 5 is a front perspective view of the buckle mechanism.
Figure 6:
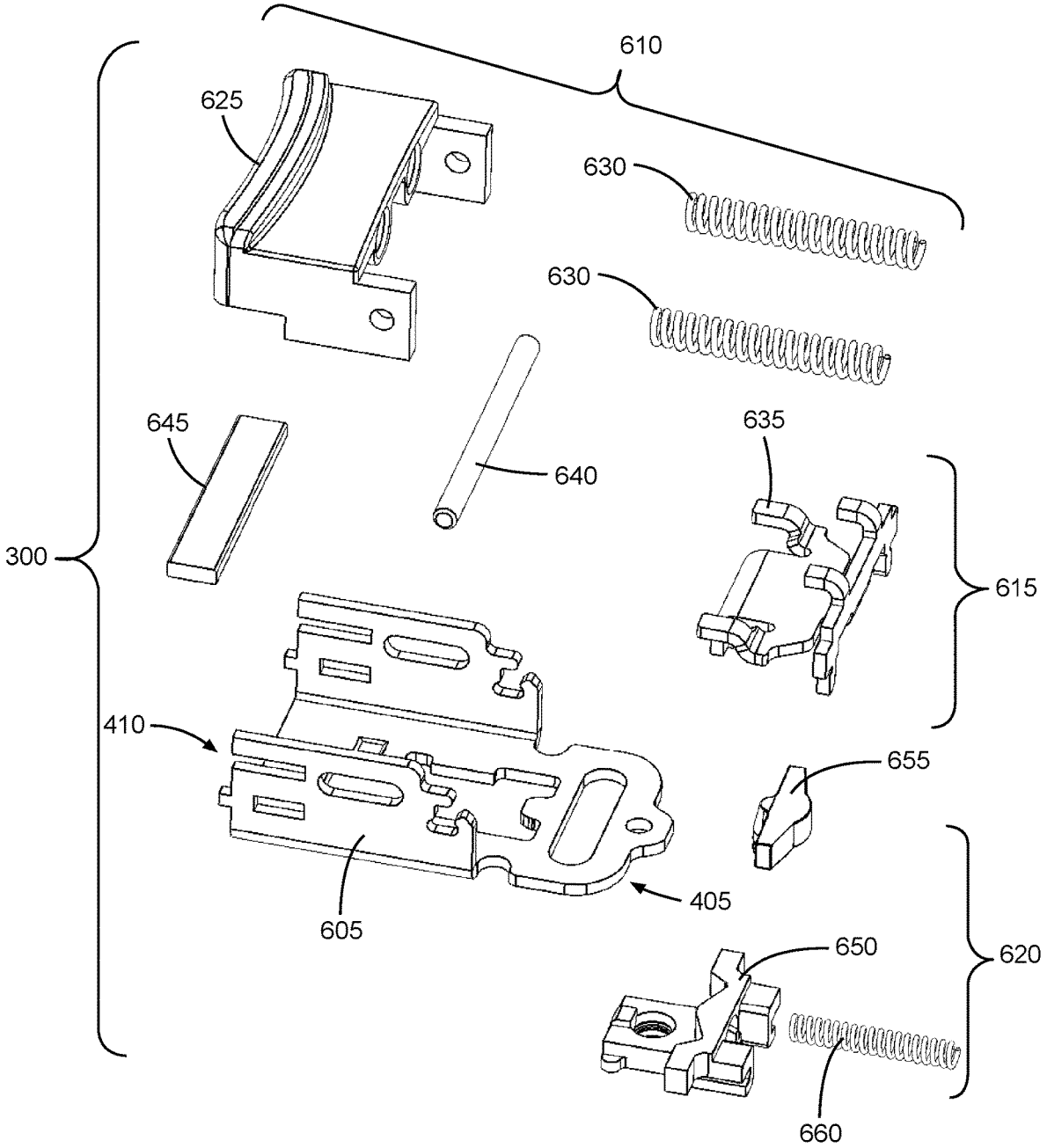
FIG. 6 is an exploded view of the buckle mechanism.
Figure 7:
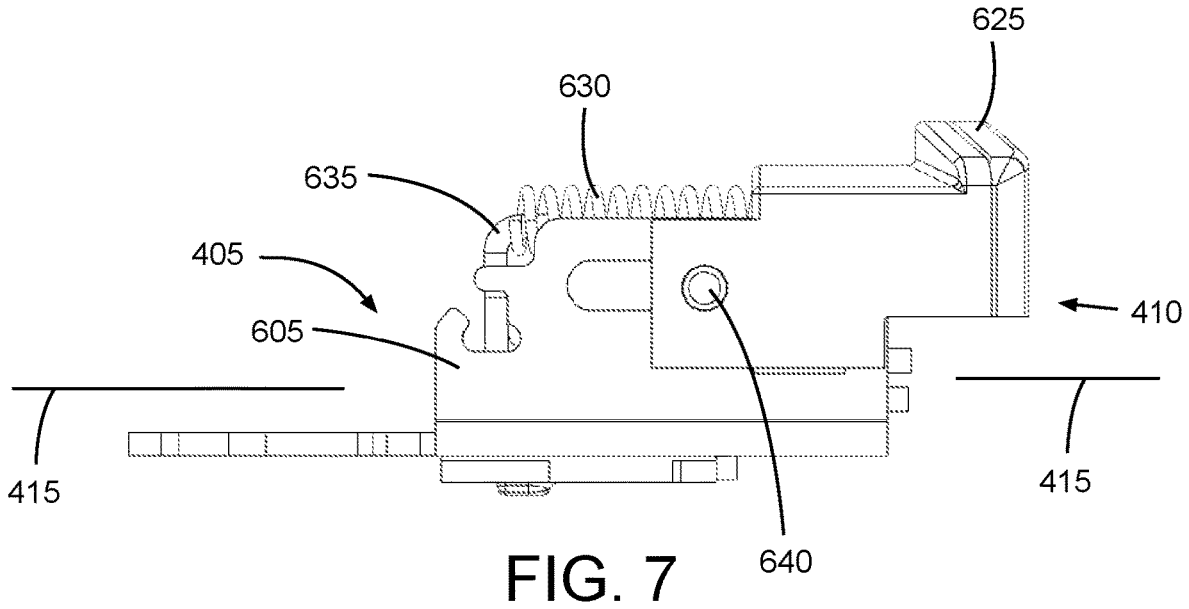
FIG. 7 is a side view of the buckle mechanism.
Figure 8:
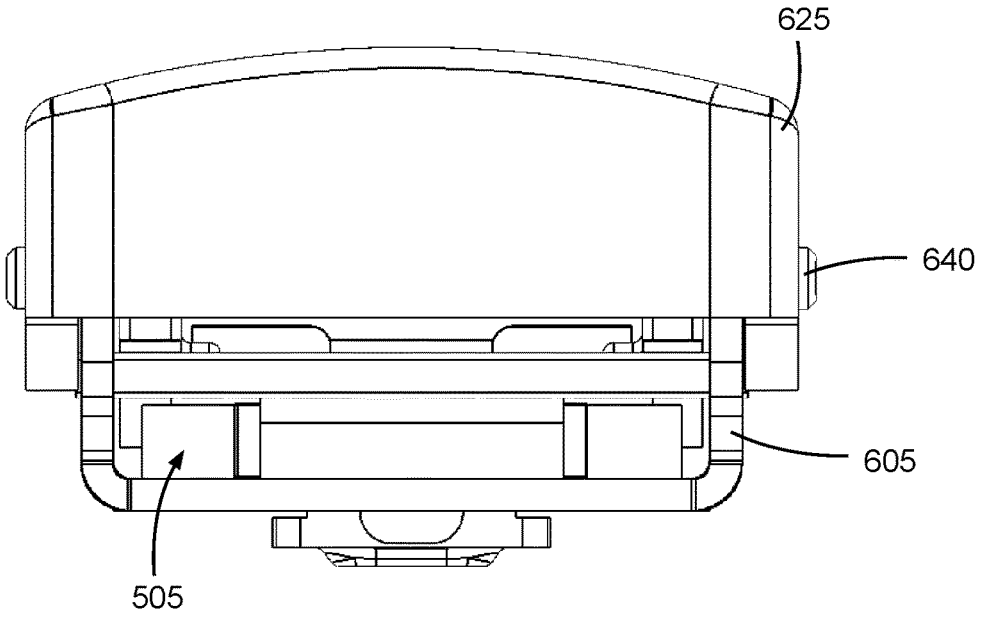
FIG. 8 is a front view of the buckle mechanism.
Figure 9:
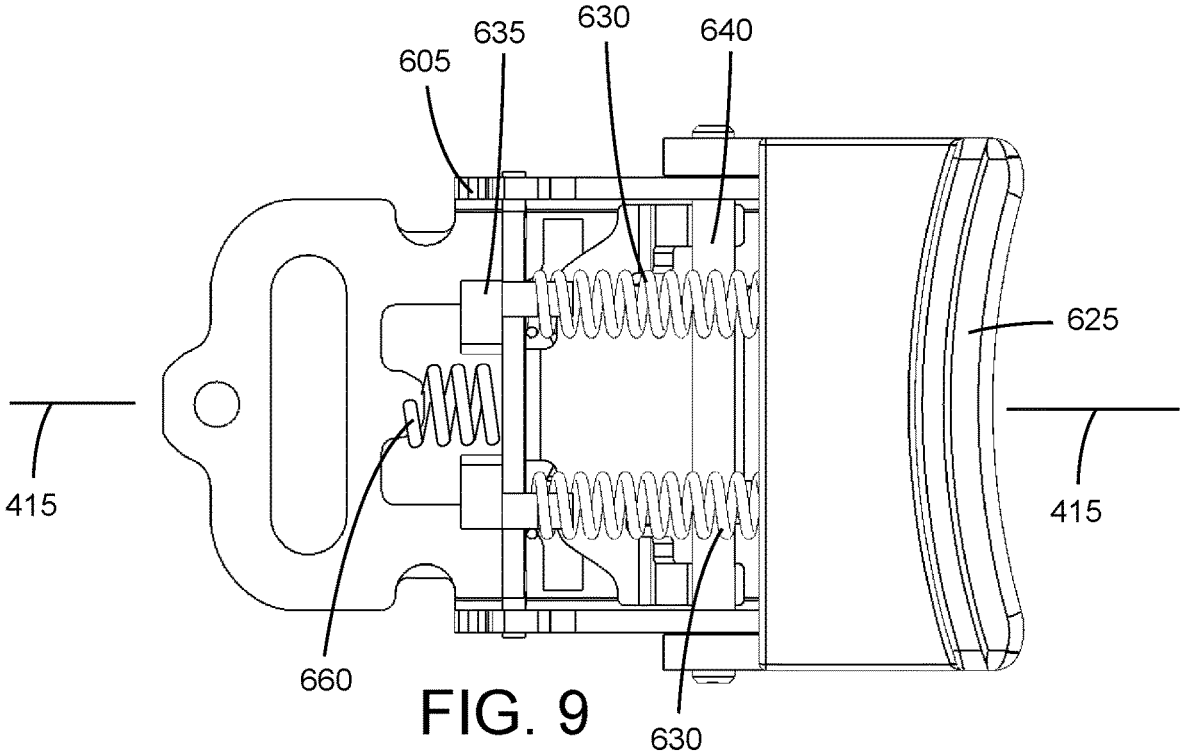
FIG. 9 is a top view of the buckle mechanism.
Figure 10:
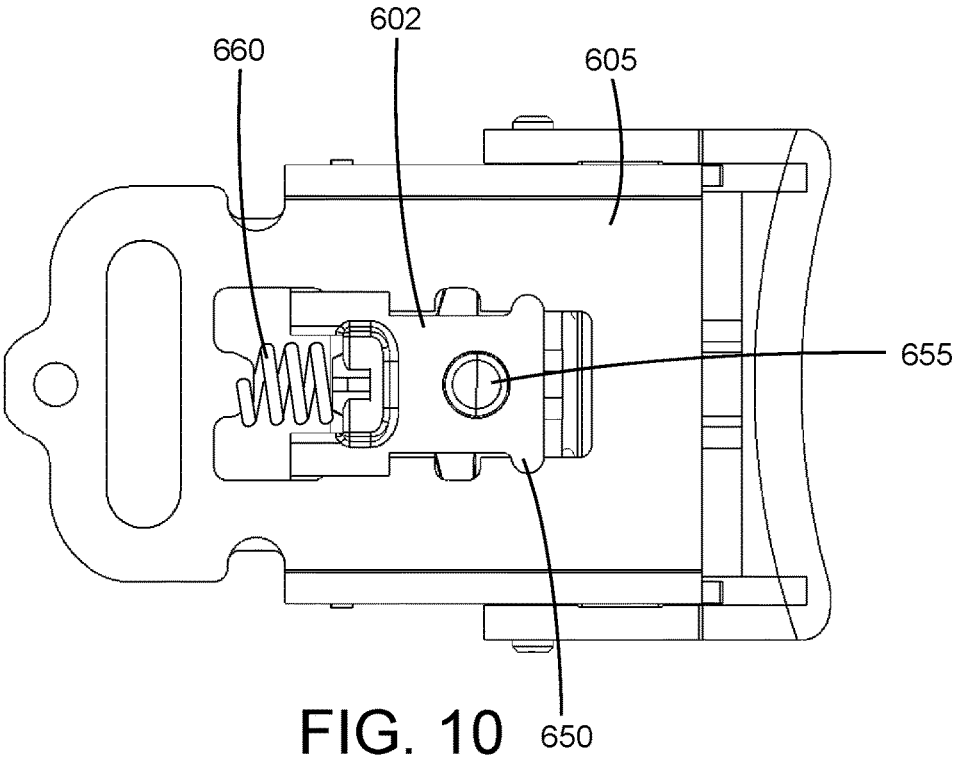
FIG. 10 is a bottom view of the buckle mechanism.

FIGS. 4 and 5 respectively illustrate top and front perspective views of the buckle mechanism 300. The buckle mechanism 300 includes a web engagement end 405 where the webbing 110 is secured. Opposite the web engagement end 405, the buckle mechanism 300 has a latch plate coupling end 410 where the latch plate assembly 205 is inserted and secured. A longitudinal axis 415 of the buckle mechanism 300 (and the buckle 200) extends between the web engagement end 405 and the latch plate coupling end 410. As will be explained below, most of the movement action of the buckle 200 occurs generally along this longitudinal axis 415 so as to provide smooth actuation and latching movement. For example, the latch plate assembly 205 is inserted into and ejected from the buckle 200 along this longitudinal axis 415 of the buckle 200. Looking at FIG. 5, the buckle mechanism 300 at the latch plate coupling end 410 has a latch plate cavity 505 configured to receive the tongues 315 of the latch plates 220.

Referring now to FIGS. 6, 7, 8, 9, and 10, the buckle mechanism 300 includes a frame 605 that supports a release mechanism 610, latch mechanism 615, and ejector mechanism 620 of the buckle mechanism 300. Among other things, the release mechanism 610 along with the ejector mechanism 620 is generally used to release and eject the latch plate assembly 205 from the buckle 200, and the latch mechanism 615 is generally used to secure the latch plates 220 of the latch plate assembly 205 in the buckle mechanism 300. The release mechanism 610 includes a release button 625 and one or more button springs 630 that bias the release button 625 in an extended position. The latch mechanism 615 has a lock pawl 635 designed to lock to the tongues 315 of the latch plates 220 and a latch pin 640 configured to hold the lock pawl 635 in the locked position. The latch pin 640 is slidably coupled to the frame 605, and the release button 625 is secured to the latch pin 640 so that the release button 625 is able to move in a sliding fashion relative to the frame 605. The lock pawl 635 is pivotally coupled to the frame 605. The button springs 630 are biased or sandwiched between the release button 625 and the lock pawl 635. When the release button 625 is pressed, the button springs 630 transmit the force from the release button 625 to the lock pawl 635 so that the lock pawl 635 pivots relative to the frame 605 so as to release the latch plates 220. The latch mechanism 615 further includes a latch plate retention bar 645 that is coupled to the frame 605. Along with the frame 605, the latch plate retention bar 645 forms the latch plate cavity 505 that keeps the latch plates 220 coupled together so as to prevent latch plate assembly 205 from accidentally disengaging from the buckle 200.

The ejector mechanism 620 includes an ejection slider 650 that is slidably coupled to the frame 605, an ejector swivel 655 that is pivotally coupled to the ejection slider 650, and at least one ejection spring 660 to bias the ejection slider 650. The ejector swivel 655 is able to swivel relative to the ejection slider 650 to ensure that both latch plates 220 are properly secured together when locked in the buckle 200. In other words, the ejector swivel 655 is designed to swivel in order to prevent the lock pawl 635 from latching with only a single latch plate 220. The ejection spring 660 is sandwiched between the frame 605 and the ejection slider 650 so as to bias the ejection slider 650 in an ejection direction where the latch plate assembly 205 is ejected from the latch plate cavity 505.

Earlier designs relied solely on springs to eject latch plates. It was discovered, however, that debris can collect in between the coils of the spring, thereby inhibiting proper ejection of the latch plates. Due to repeated use, the spring force can also deteriorate over time so as to further inhibit proper ejection of the latch plates. Without proper ejection of the latch plates, the latch plate may remain latched to the buckle which can be especially problematic such as during emergencies where quick occupant removal from the car seat is required.

The buckle mechanism 300 in the illustrated example has been designed to address this as well as other issues. As noted before, when the release button 625 is actuated, the lock pawl 635 rotates so as to release the latch plate assembly 205. This rotation also causes the lock pawl 635 to contact the ejector swivel 655 and push the ejection slider 650 in the ejection direction so as to eject the latch plates 220 from the latch plate cavity 505 in the buckle 200. In most cases, this ejection force from the lock pawl 635 supplements the ejection biasing force applied by the ejection spring 660, but in some cases, where the ejection spring 660 has been damaged or otherwise rendered inoperative, the lock pawl 635 can apply the sole ejection force to the ejection slider 650 so as to eject the latch plate assembly 205 from the buckle 200.

Various features of the frame 605 will now be described with reference to FIGS. 11, 12, and 13. As shown, the frame 605 includes a base 1105 and one or more support flanges 1110 extending in a transverse direction from the base 1105. In the illustrated example, a pair of support flanges 1110 extend perpendicularly from the base 1105 along opposing sides of the frame 605 to form a latch plate channel 1112 in which various components of the buckle mechanism 300 are received. Each support flange 1110 has a latch pivot notch 1115 where the lock pawl 635 is pivotally coupled to the frame 605. In the depicted example, the latch pivot notch 1115 is shaped to have a flat bottom and notched sides to allow the lock pawl 635 to lay flat when latched and properly rotate during unlatching. The support flanges 1110 further each define a pin guide slot 1120 in which the latch pin 640 is slidably received. To promote smooth actuation of the release button 625 and firm latching of the lock pawl 635, the pin guide slots 1120 extend in a direction that is generally parallel to the longitudinal axis 415 of the buckle mechanism 300. As can be seen, the pin guide slots 1120 are generally straight so that the latch pin 640 can smoothly glide within the pin guide slots 1120. The pin guide slots 1120 in the depicted example do not have any bends or jogs where the latch pin 640 could catch. The support flanges 1110 each further has retention bar slot 1125 in which the latch plate retention bar 645 is secured.

Each support flange 1110 further defines a button guide notch 1130 at the latch plate coupling end 410 of the frame 605. As shown, the button guide notches 1130 extend parallel to the longitudinal axis 415 of the buckle 200. The button guide notches 1130 are generally straight and extend in a generally parallel manner relative to the pin guide slots 1120. With such an arrangement, the release button 625 generally moves in a straight direction along the longitudinal axis 415 when pressed or otherwise actuated. This release button 625 further does not catch on anything when biased back to its original position. At the web engagement end 405, the frame 605 has a fastener opening 1135 configured to receive a fastener for securing the frame 605 between the mechanism cover 305 and base cover 310. The frame 605 at the web engagement end 405 has a web eye 1140 through where the webbing 110 is looped.

Figure 11:
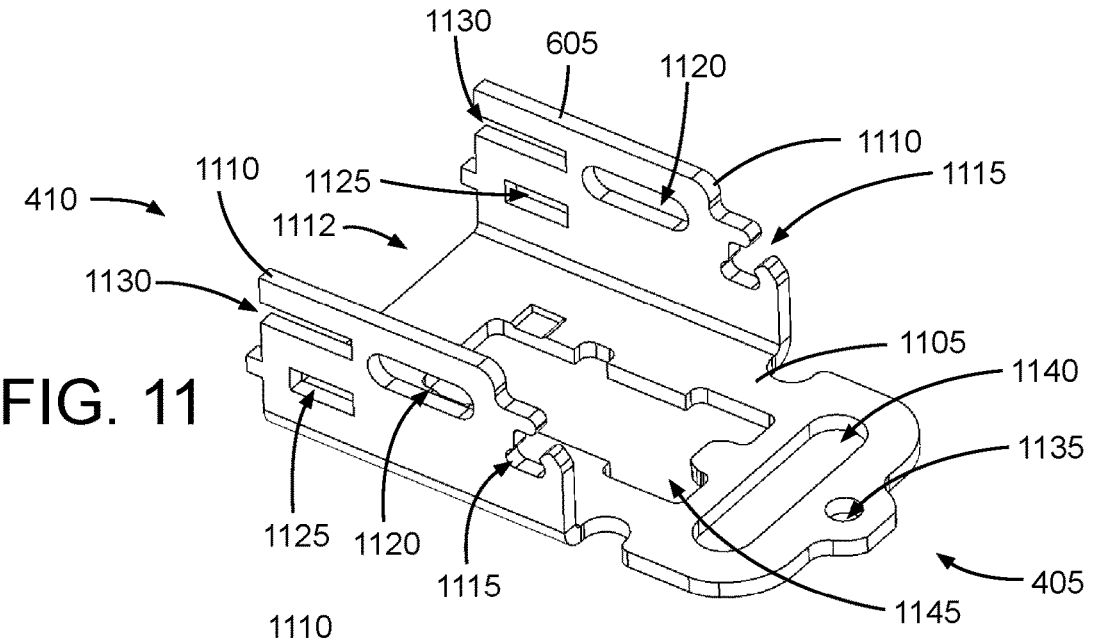
FIG. 11 is a perspective view of a frame in the buckle mechanism.
Figure 12:
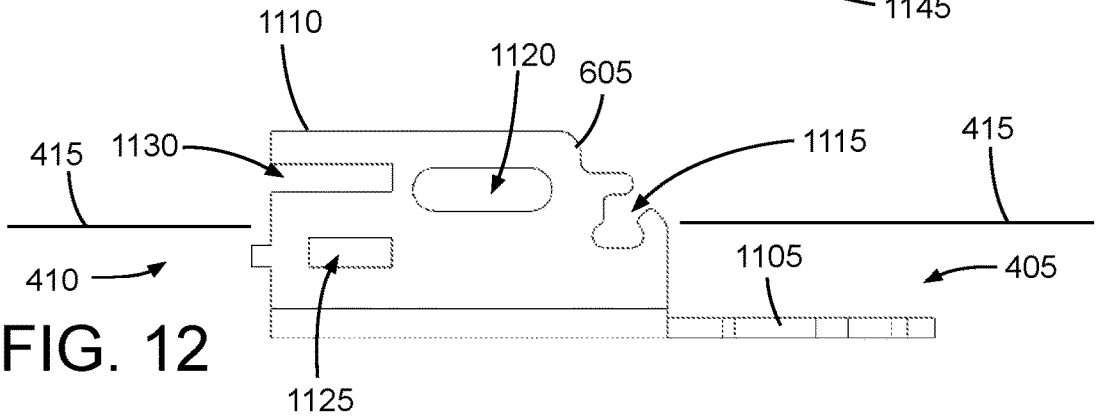
FIG. 12 is a side view of the frame.
Figure 13:
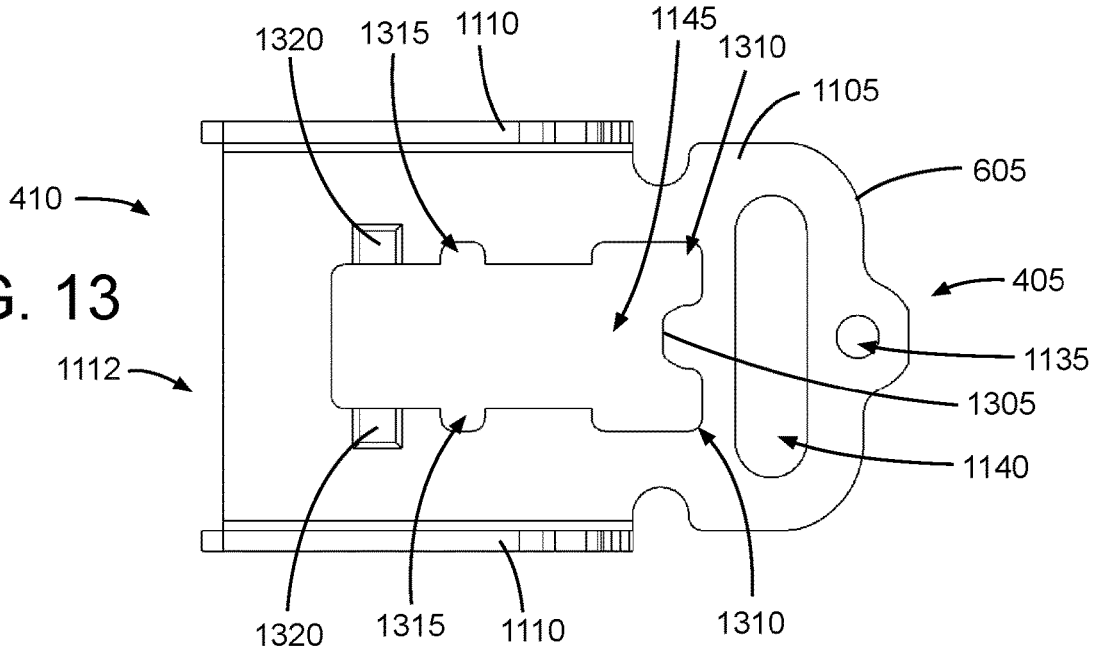
FIG. 13 is a top view of the frame.

Looking at FIGS. 11 and 13, the base 1105 of the frame 605 defines an ejector guide slot 1145 in which the ejector mechanism 620 is slidably coupled to the frame 605. The ejector guide slot 1145 has a spring seat flange 1305 where one end of the ejection spring 660 is secured to the frame 605. On opposing sides of the ejector guide slot 1145, the base 1105 has one or more spring seat facing relief notches 1310 and latch facing relief notches 1315. During assembly, the spring seat facing relief notches 1310 and latch facing relief notches 1315 allow the ejection slider 650 to be slidably coupled to and retained on the frame 605. At the sides of the ejector guide slot 1145 proximal to the latch plate coupling end 410, the base 1105 has one or more latch alignment grooves 1320 configured to receive an end of the lock pawl 635 when latched.

Figure 14:
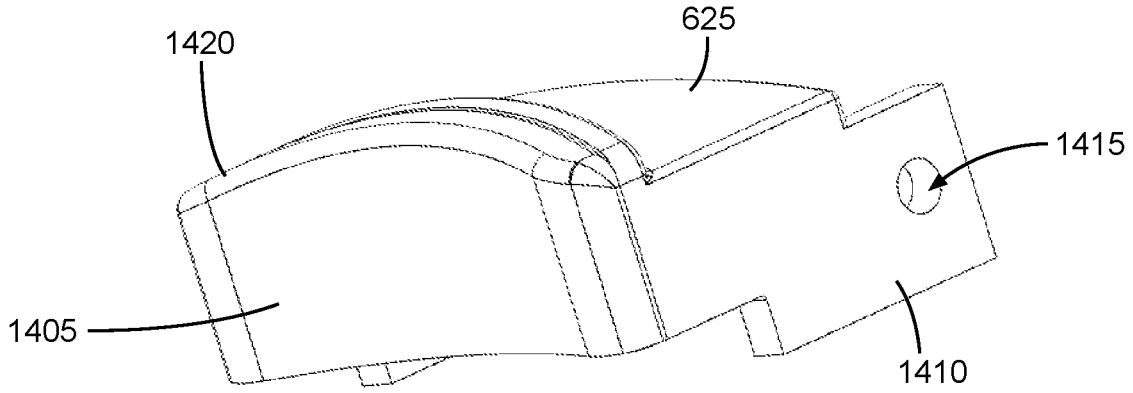
FIG. 14 is a front perspective view of a release button in the buckle mechanism.
Figure 15:
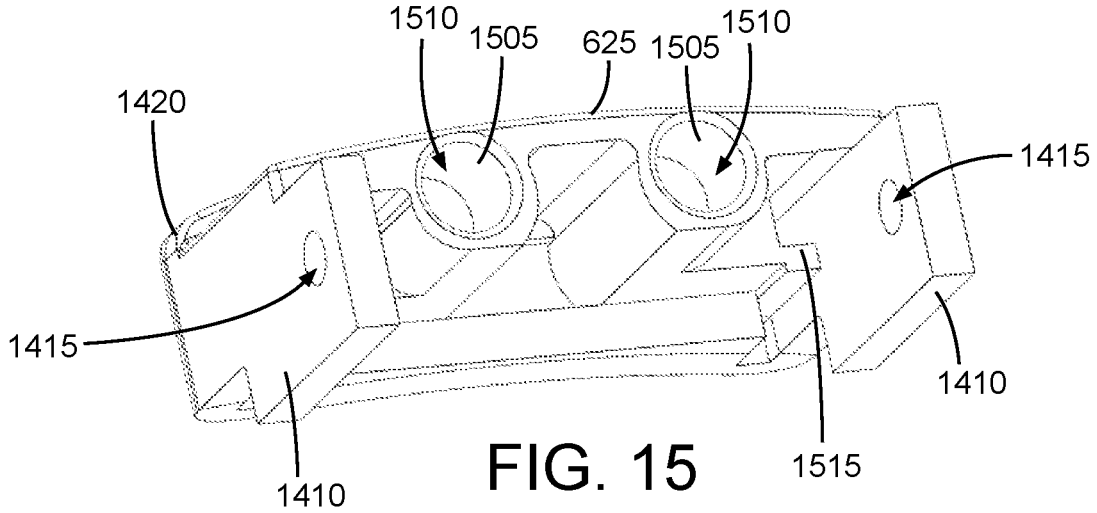
FIG. 15 is a rear perspective view of the release button.
Figure 16:
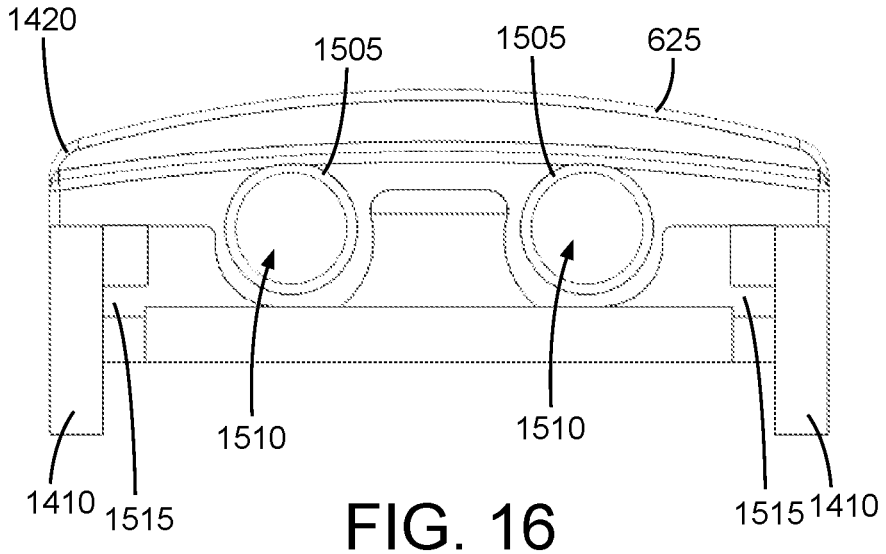
FIG. 16 is a rear view of the release button.

As can be seen in FIGS. 14, 15, and 16, the release button 625 has an actuation surface 1405 where the user usually presses or otherwise actuates the release button 625 and one or more frame engagement flanges 1410 configured to glide along the support flanges 1110 of the frame 605. Each of the frame engagement flanges 1410 has one or more pin openings 1415 where the ends of the latch pin 640 are secured to the release button 625. In the illustrated example, the pin openings 1415 extend completely through the frame engagement flanges 1410, and the latch pin 640 is held in place by the housing 215, adhesive, and/or in other manners. In other examples, the pin openings 1415 are blind holes in which the ends of the latch pin 640 are clipped at the inside surfaces of the frame engagement flanges 1410. The release button 625 further has a stop lip 1420 that limits the travel of the release button 625 by engaging the mechanism cover 305 when the release button 625 is fully pressed.

Turning to FIGS. 15 and 16, the release button 625 has one or more spring seats 1505 with seat 1510 in which the ends of the button springs 630 are coupled to the release button 625. Inside, the release button 625 has one or more guide flanges 1515 that extend between the pin openings 1415 and spring seats 1505. The guide flanges 1515 are configured to be slidably received in the button guide notch 1130 of the frame 605 so as to retain and guide the movement of the release button 625 during actuation. The guide flanges 1515 in conjunction with the latch pin 640 stabilize the release button 625 by minimizing rotation of the release button 625 which in turn provides a smooth actuation motion in a linear longitudinal direction.

Figure 17:
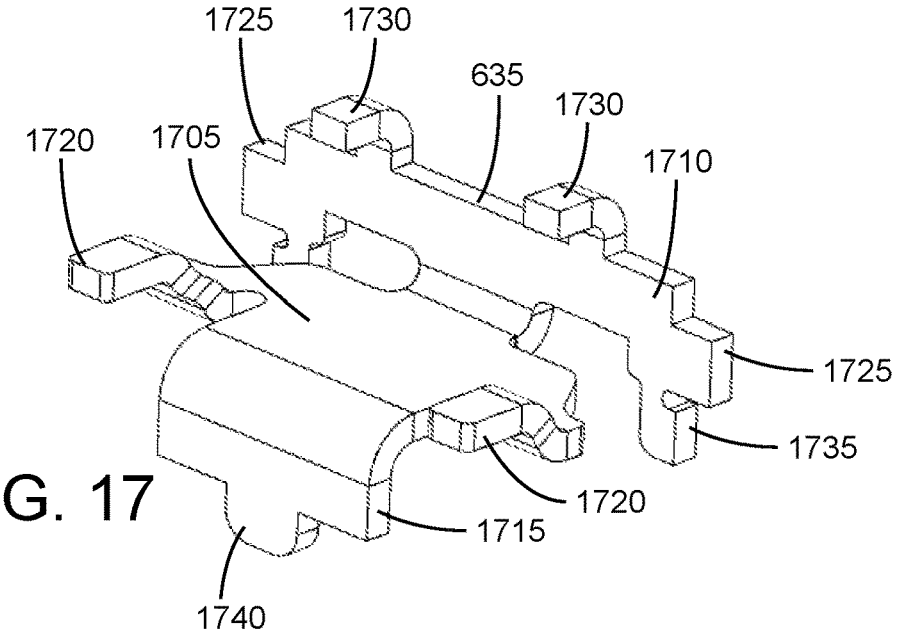
FIG. 17 is a perspective view of a lock pawl in the buckle mechanism.
Figure 18:
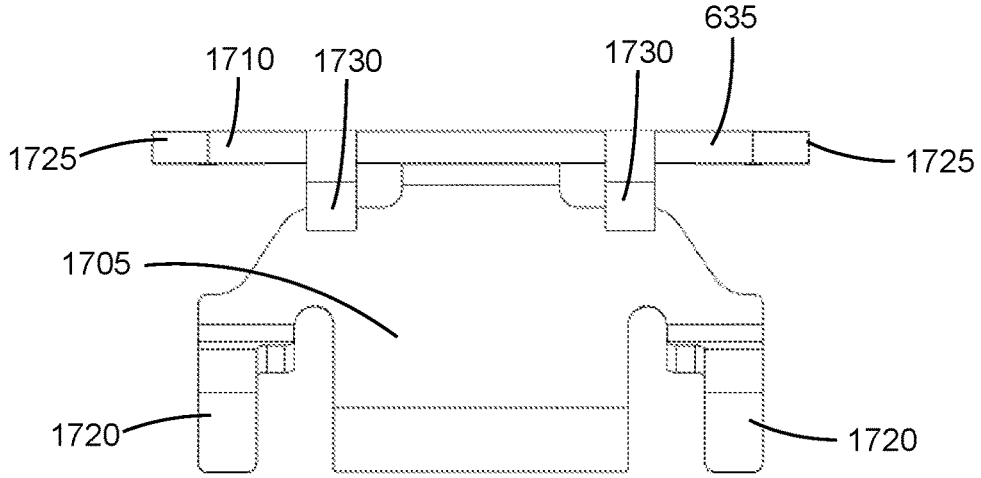
FIG. 18 is a top view of the lock pawl.
Figure 19:
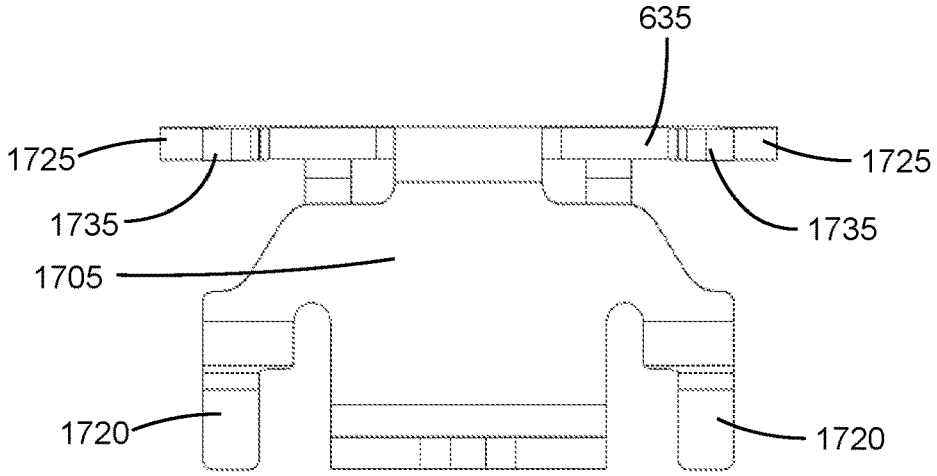
FIG. 19 is a bottom view of the lock pawl.
Figure 20:
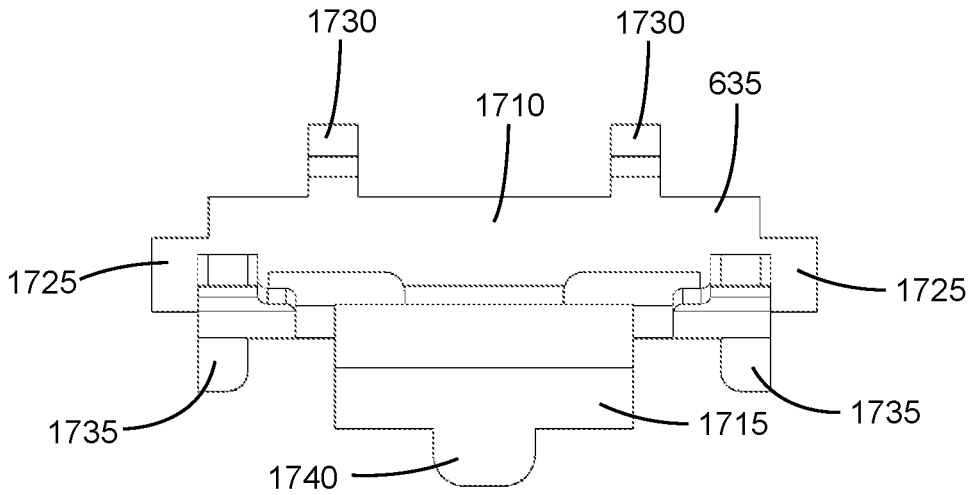
FIG. 20 is a front view of the lock pawl.
Figure 21:
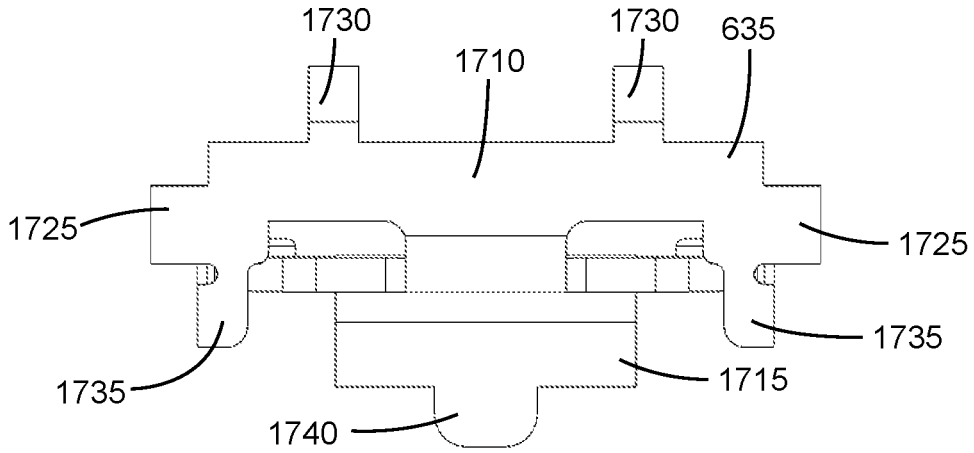
FIG. 21 is a rear view of the lock pawl.
Figure 22:
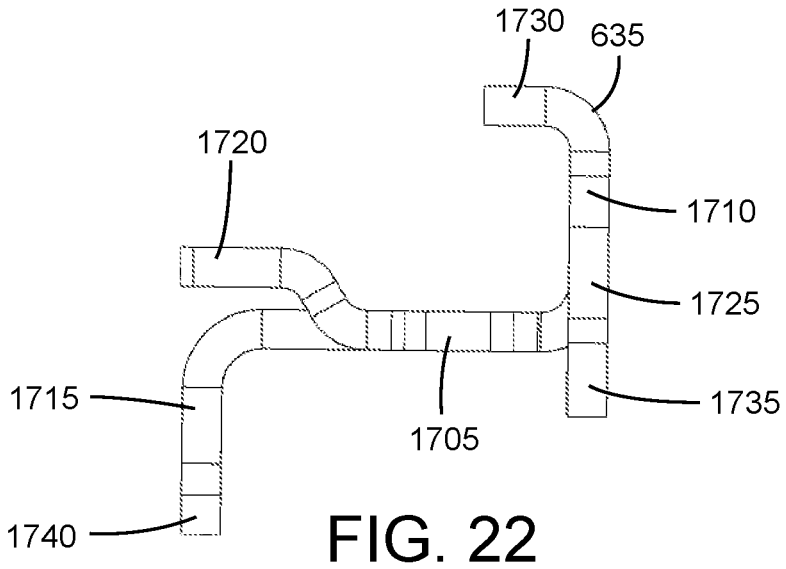
FIG. 22 is a side view of the lock pawl.
Figure 23:
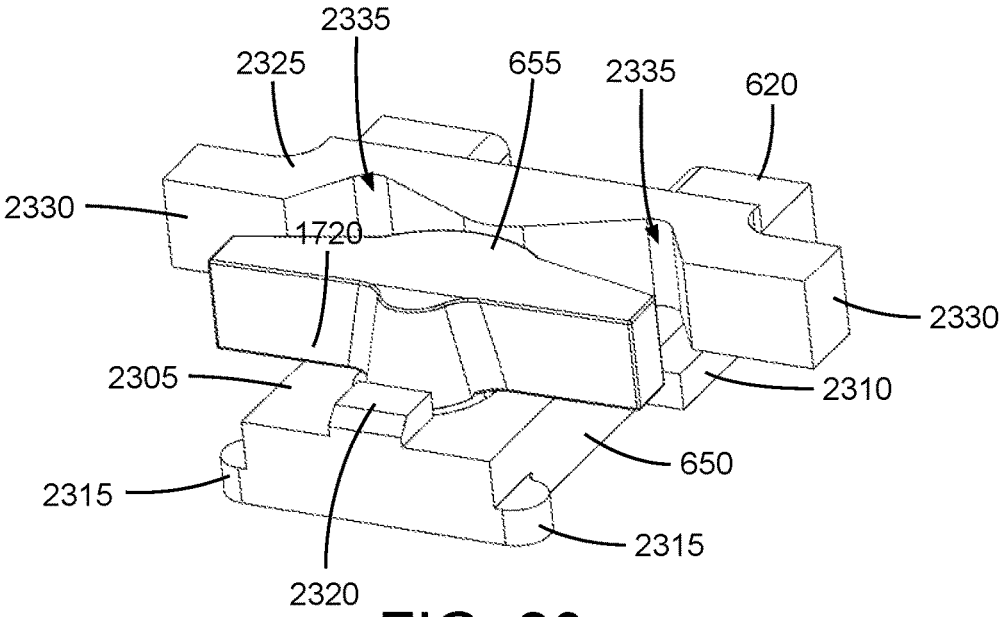
FIG. 23 is a front perspective view of a portion of an ejector mechanism in the buckle mechanism.

A perspective view of the lock pawl 635 is shown in FIG. 17, and top and bottom views of the lock pawl 635 are respectively illustrated in FIGS. 18 and 19. FIGS. 20, 21, and 22 show front, rear, and side views of the lock pawl 635, respectively. As shown, the lock pawl 635 has a latch body 1705 from where a hinge portion 1710 and lock portion 1715 extend at opposing ends. The hinge portion 1710 and lock portion 1715 extend in opposite transverse directions from the latch body 1705. One or more cam arms 1720 extend from the latch body 1705. In the depicted example, the cam arms 1720 extend at an acute angle from opposing lateral sides of the lock pawl 635 and have a flat section that is spaced above the latch body 1705. As shown in FIG. 22, the cam arms 1720 extend toward the lock portion 1715 and extend from the latch body 1705 in an opposite direction to the lock portion 1715. The cam arms 1720 provide a cam surface along where the latch pin 640 is able to move. The latch pin 640 engages near the ends of the cam arms 1720 to lock the lock pawl 635 in the latched position with the latch plates 220.

Referring again to FIG. 17, the hinge portion 1710 has one or more pivot tabs 1725 that are pivotally received in the latch pivot notch 1115 of the frame 605 to facilitate pivotal movement of the lock pawl 635 during latching and unlatching of the lock portion 1715 of the lock pawl 635 with the latch plate assembly 205. The hinge portion 1710 further has one or more spring seat fingers 1730 that extend towards the release button 625 when the buckle mechanism 300 is assembled. The spring seat fingers 1730 are configured to couple the ends of the button springs 630 to the lock pawl 635. As illustrated, the spring seat fingers 1730 are offset from the pivot tabs 1725 so as to create a moment arm that allows the release button 625 via the button springs 630 to pivot the lock pawl 635 when the release button 625 is pressed towards the lock pawl 635.

Extending on a side opposite from the spring seat fingers 1730 relative to the pivot tabs 1725, the hinge portion 1710 has one or more ejector fingers 1735 positioned to engage the ejection slider 650 of the ejector mechanism 620. When the latch plate assembly 205 is inserted into the buckle mechanism 300, the ends of the tongues 315 of the latch plates 220 press against the ejector mechanism 620. This pressing action pushes the ejection slider 650 against the ejector fingers 1735 which in turn causes the lock pawl 635 to rotate about the pivot tabs 1725 to latch with the latch plate assembly 205. When the release button 625 is pressed to eject the latch plate assembly 205 from the buckle mechanism 300, the lock pawl 635 rotates in the opposite direction which in turn causes the ejector fingers 1735 to press against and move the ejection slider 650 in the ejection direction resulting in the latch plate assembly 205 being unlatched and ejected from the buckle mechanism 300. The compressed ejection spring 660 can provide additional force for ejecting the latch plate assembly 205. As noted before, this construction allows the latch plate assembly 205 to be unlatched and ejected even when the ejection spring 660 is clogged with debris, damaged, and/or otherwise operating below operational norms.

At the end of the lock portion 1715, the lock pawl 635 has a nose tab 1740 that helps to keep the lock pawl 635 in an unlatched position until the latch plate assembly 205 is properly seated inside the buckle 200. The nose tab 1740 is sized to fit between the tips of the tongues 315, and the lock portion 1715 is sized to engage the latch notches 320 in the tongues 315 when the latch plate assembly 205 is latched. In the illustrated example, the lock portion 1715 is rounded to reduce wear on the ejection slider 650.

Turning to FIGS. 23, 24, 25, and 26, the ejection slider 650 of the ejector mechanism 620 has a slider body 2305. One or more retention flanges 2310 and retention tabs 2315 extend in a lateral direction from the slider body 2305. The retention flanges 2310 and retention tabs 2315 are configured to retain the ejection slider 650 on the frame 605. The ejection slider 650 further has a nose tab guide 2320 that extends from the surface of the slider body 2305. The nose tab guide 2320 is centered in front of the ejector swivel 655. The nose tab guide 2320 is positioned to contact the nose tab 1740 so as to hold the lock pawl 635 in the unlatched position until the latch plate assembly 205 is properly positioned in the buckle mechanism 300. Once the latch plate assembly 205 is positioned for latching, the nose tab 1740 is able to slide past the nose tab guide 2320 as the lock pawl 635 pivots to latch with the tongues 315 of the latch plate assembly 205. In the depicted example, the nose tab guide 2320 has a beveled edge that facilitate smooth sliding of the nose tab 1740 of the lock pawl 635.

A latch bias wing 2325 of the ejection slider 650 extends transverse to the slider body 2305. The latch bias wing 2325 has one or more wing tabs 2330 that extend from opposing ends of the latch bias wing 2325. The wing tabs 2330 in conjunction with the retention tabs 2315 help to retain the ejection slider 650 in sliding engagement with the frame 605. The wing tabs 2330 of the latch bias wing 2325 are positioned to be contacted with the ejector fingers 1735 when the lock pawl 635 is pivoted to facilitate movement of the ejection slider 650 for ejecting the latch plate assembly 205. The latch bias wing 2325 further defines one or more relief notches 2335 configured to facilitate swiveling motion of the ejector swivel 655 relative to the ejection slider 650.

Figure 24:
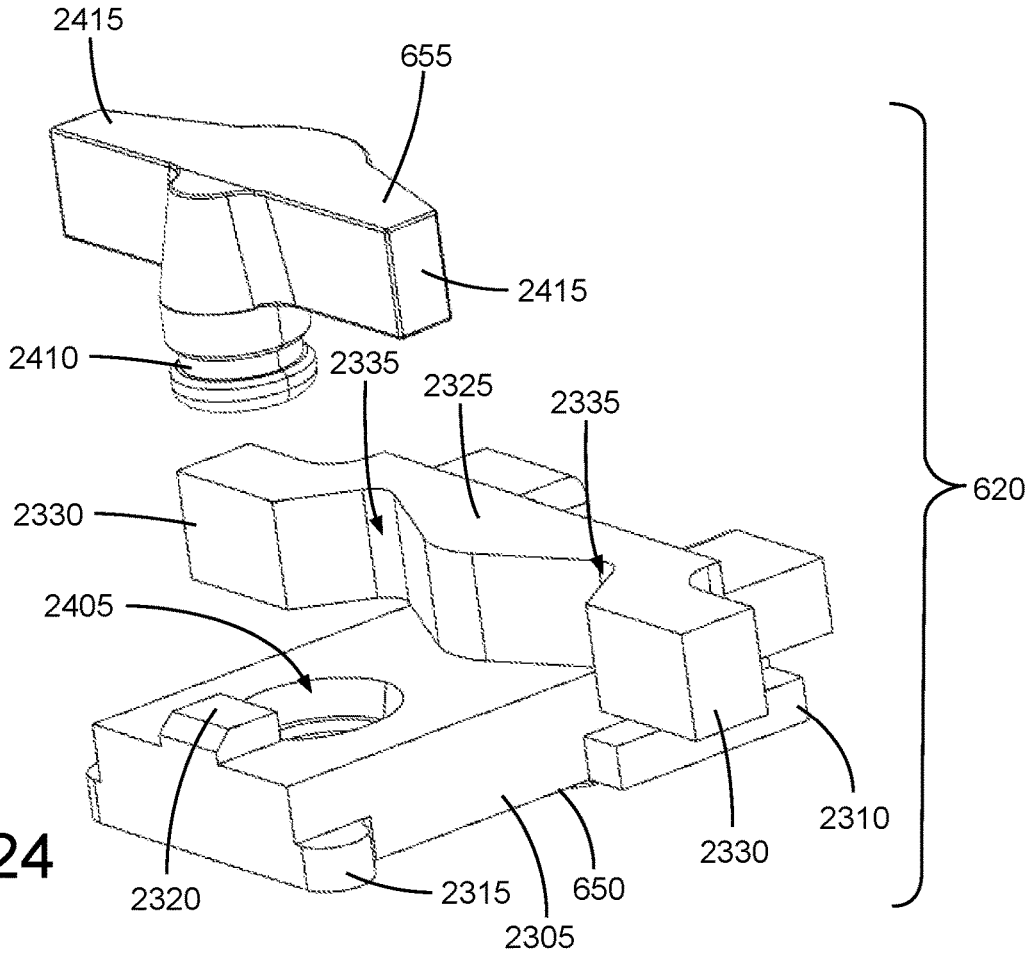
FIG. 24 is an exploded view of the ejector mechanism.

Referring to FIG. 24, the slider body 2305 of the ejection slider 650 defines a connector opening 2405 to which the ejector swivel 655 is connected in a swiveling manner. As shown, the ejector swivel 655 has a pivot connector head 2410 that is received in the connector opening 2405 of the ejection slider 650. In the illustrated example, the connector opening 2405 and pivot connector head 2410 from a snap fit type connection that facilitates rotational or swiveling movement of the ejector swivel 655 relative to the ejection slider 650. The ejection slider 650 and ejector swivel 655 in other examples can be connected together in other ways to facilitate swiveling motion. As shown, the ejector swivel 655 has one or more tongue engagement arms 2415 where the tongues 315 of the latch plate assembly 205 contact the ejector swivel 655 of the ejector mechanism 620. The tongue engagement arms 2415 extend from opposing sides the ejector swivel 655.

As noted before, the buckle mechanism 300 is designed to prevent just a single latch plate 220 from being secured without the other. In other words, the latch plates 220 of the latch plate assembly 205 must be properly aligned and coupled together before the lock pawl 635 in the buckle mechanism 300 is able to latch the latch plate assembly 205 with the buckle 200. When a single latch plate 220 is inserted into the latch plate cavity 505 of the buckle 200, the end of the tongue 315 of the latch plate 220 contacts just one of the tongue engagement arms 2415 such that ejector swivel 655 begins to swivel. While the ejector swivel 655 swivels, the ejection slider 650 is stationary with the nose tab guide 2320 remaining in contact with the nose tab 1740 of the lock pawl 635 such that the lock pawl 635 stays in an unlatched position. When the single latch plate 220 is inserted further into the buckle 200, the relief notches 2335 in the latch bias wing 2325 allow the ejector swivel 655 to further swivel while ejection slider 650 remains stationary. The tongue engagement arms 2415 are then angled such that further insertion causes the end of the latch plate 220 to slide in an outward lateral direction which in turn prevents the latch notch 320 in the tongue 315 from engaging the lock portion 1715 of the lock pawl 635.

In contrast, when the latch plates 220 are both properly coupled together and inserted at the same time into the latch plate cavity 505 of the buckle mechanism 300, the ends of the latch plates 220 contact the tongue engagement arms 2415 of the ejector mechanism 620 at the same time, and the ejector swivel 655 does not rotate or swivel. Against the biasing force of the of the ejection spring 660, the latch plate assembly 205 is able to slide the ejection slider 650 in an insertion direction. This sliding movement of the ejection slider 650 compresses the ejection spring 660, and the resulting potential energy stored in the ejection spring 660 can be later used to move the ejection slider 650 in the ejection direction during unbuckling. As the latch plate assembly 205 is further pushed into the buckle 200, the ejection slider 650 continues to slide in the insertion direction, and the nose tab 1740 of the lock pawl 635 slides off the nose tab guide 2320 so that the lock pawl 635 is able to latch to the latch notches 320 in the latch plate assembly 205. Eventually, as the ejection slider 650 continues to slide, the wing tabs 2330 of the ejection slider 650 press against the ejector fingers 1735 of the lock pawl 635 (FIG. 17). When the ejector fingers 1735 are pressed, the lock pawl 635 is able to pivot about the pivot tabs 1725 to have the lock portion 1715 latch in the latch notches 320.

Figure 25:
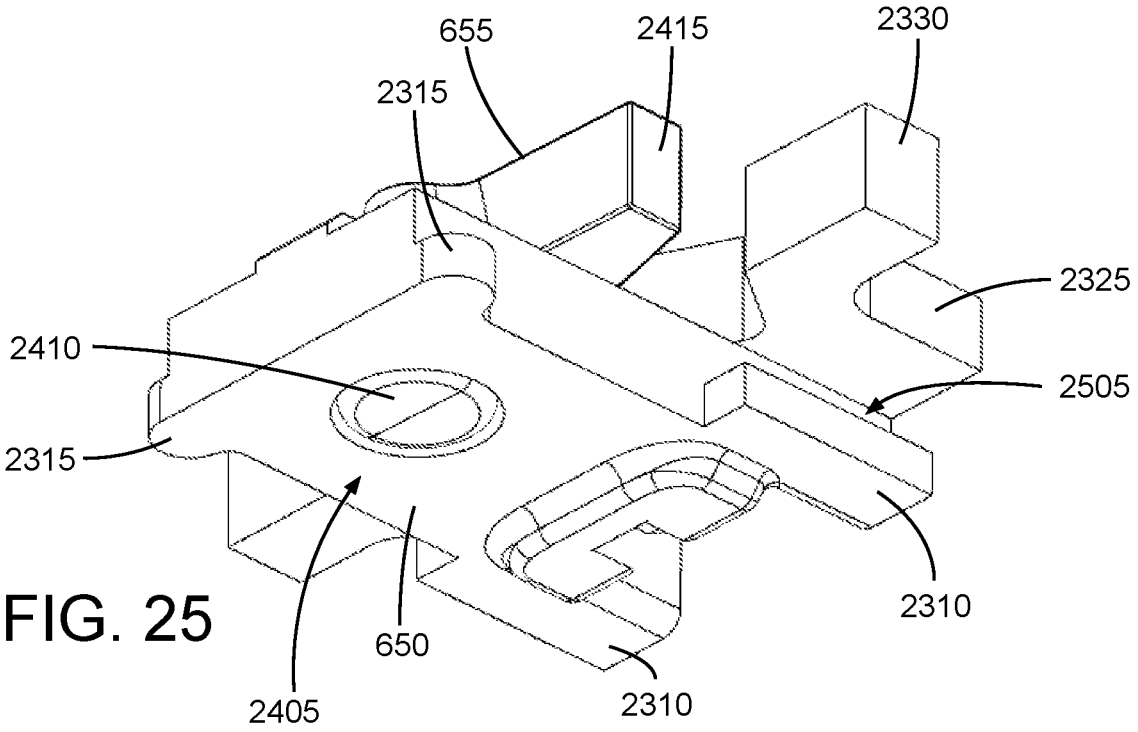
FIG. 25 is a bottom perspective view of the ejector mechanism.
Figure 26:
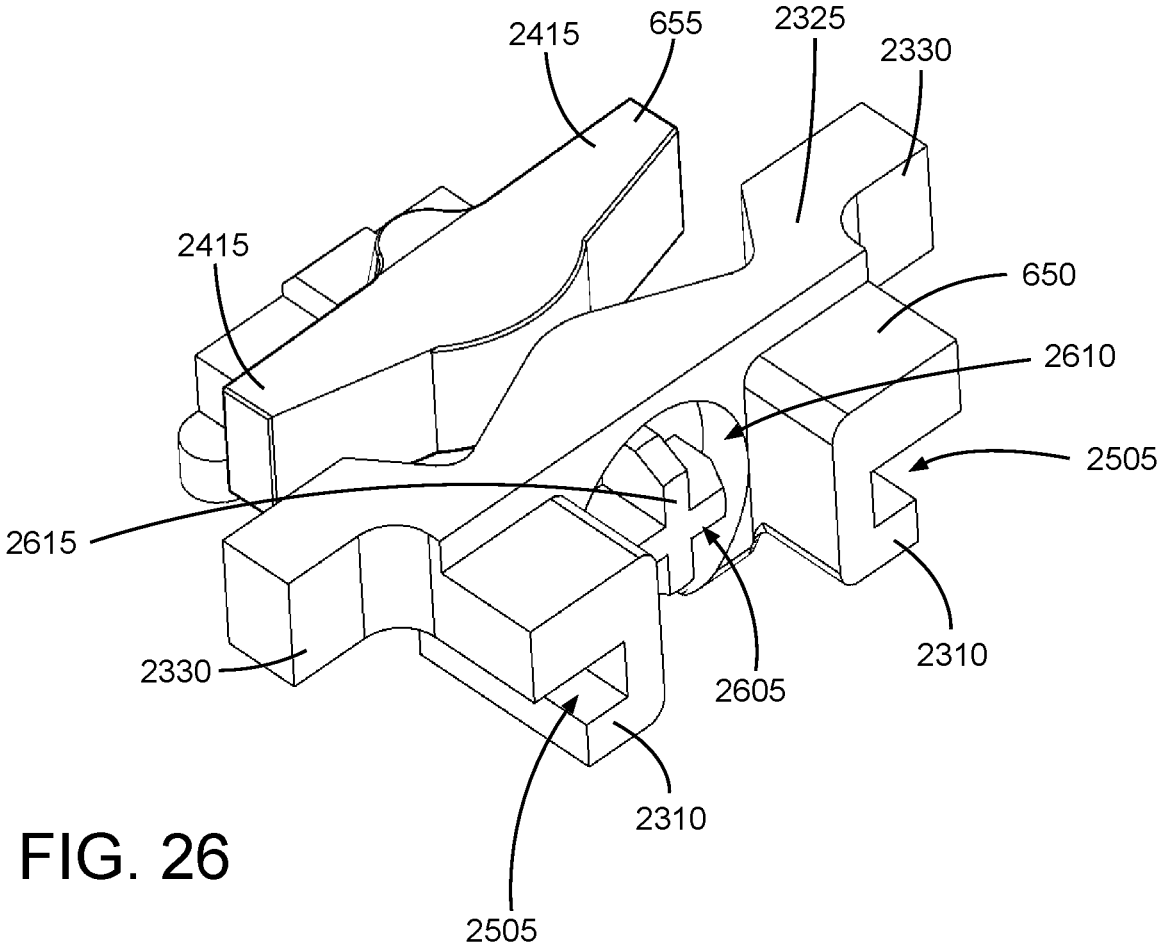
FIG. 26 is a rear perspective view of the ejector mechanism.

FIGS. 25 and 26 show one or more frame grooves 2505 that are formed between the retention flanges 2310 and latch bias wing 2325. These frame grooves 2505 in essence further extend between the tongue engagement arms 2415 of the ejector swivel 655 and the retention tabs 2315 of the ejection slider 650.

With the frame grooves 2505, the ejection slider 650 is able to be retained on and slide relative to the frame 605. Looking at FIG. 26, the ejection slider 650 further includes a spring seat 2605 to which the ejection spring 660 is coupled. As shown, the spring seat 2605 has a spring cavity 2610 in which the ejection spring 660 is received and a spring seat member 2615 to which the ejection spring 660 is secured.

The buckle system 105, and more particularly the buckle mechanism 300, is designed to minimize the number of components so as to simplify assembly as well as enhance reliability. A technique for assembling various components of the buckle 200 will now be initially described with reference to FIGS. 27, 28, 29, and 30. To improve visibility, various components, such as various springs, have been not shown in selected drawings, but it should be recognized that during assembly these components would be present. The ejector swivel 655 is normally snap fitted to the ejection slider 650 before being attached to the frame 605, but the ejector swivel 655 can be connected to the ejection slider 650 after the ejection slider 650 is secured to the frame 605.

Figure 27:
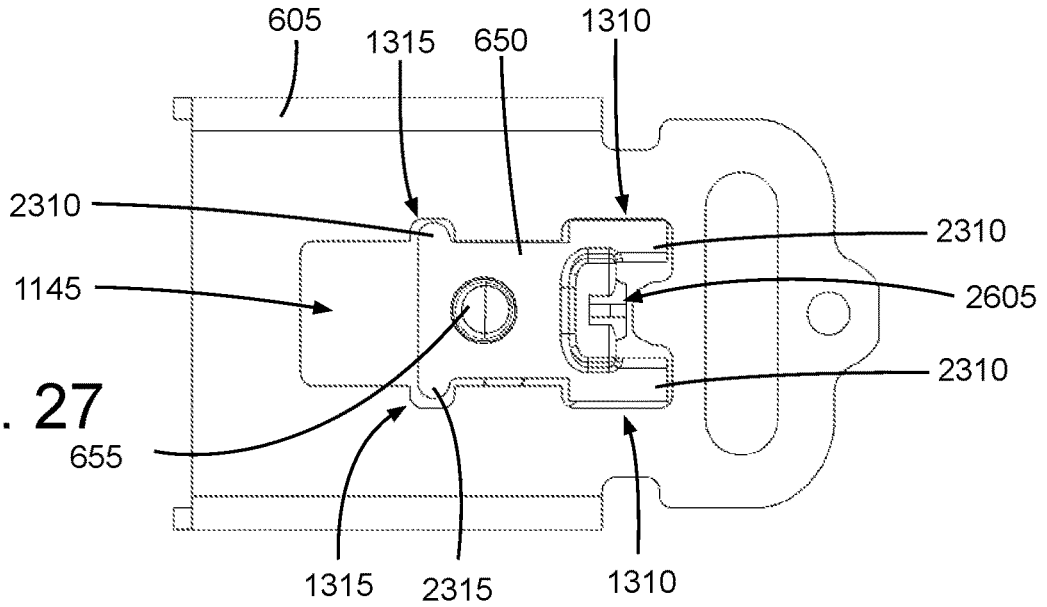
FIG. 27 is a bottom view of the frame and ejector mechanism during assembly.
Figure 28:
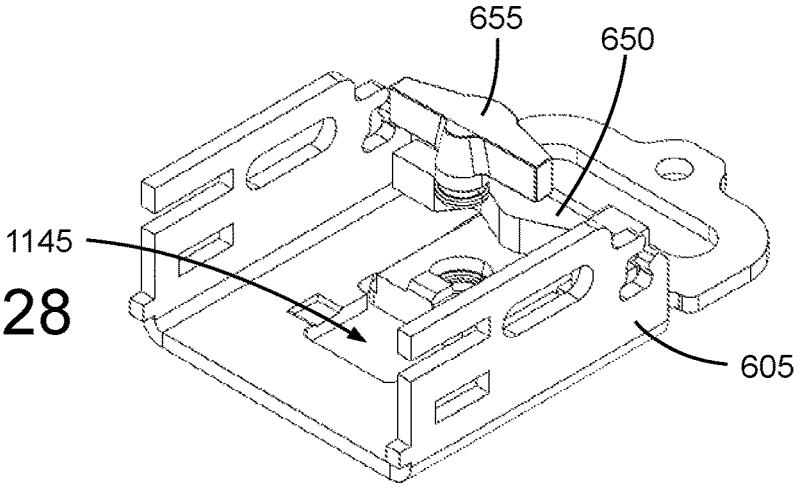
FIG. 28 is an exploded view of the frame and ejector mechanism during assembly.
Figure 29:
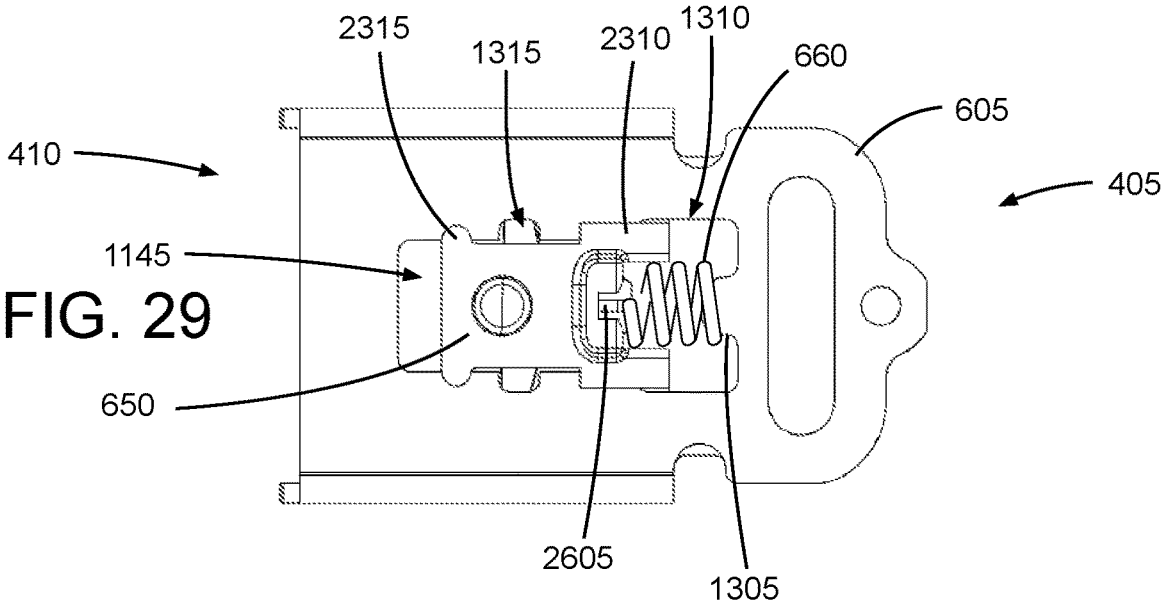
FIG. 29 is a bottom view of the frame, ejector mechanism, and ejection spring during assembly.
Figure 30:
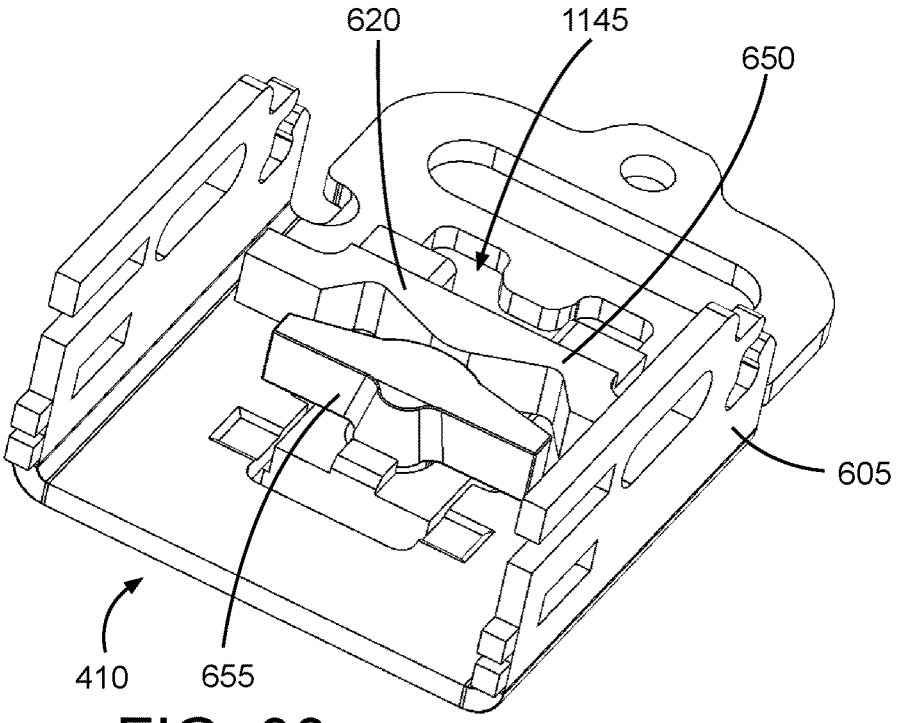
FIG. 30 is a perspective view of the frame and ejector mechanism during assembly.

Looking at FIGS. 27 and 28, to secure the ejection slider 650 to the frame 605, the retention flanges 2310 and retention tabs 2315 of the ejection slider 650 are respectively aligned with the spring seat facing relief notches 1310 and latch facing relief notches 1315 in the ejector guide slot 1145 of the frame 605. As shown in FIGS. 29 and 30, the ejection slider 650 is then slid within the ejector guide slot 1145 towards the latch plate coupling end 410 of the frame 605. The ends of the ejection spring 660 are then coupled to the spring seat flange 1305 of the frame 605 and the spring seat 2605 of the ejection slider 650. The retention flanges 2310 and retention tabs 2315 along with the ejection spring 660 retain the ejection slider 650 on the frame 605.

Figure 31:
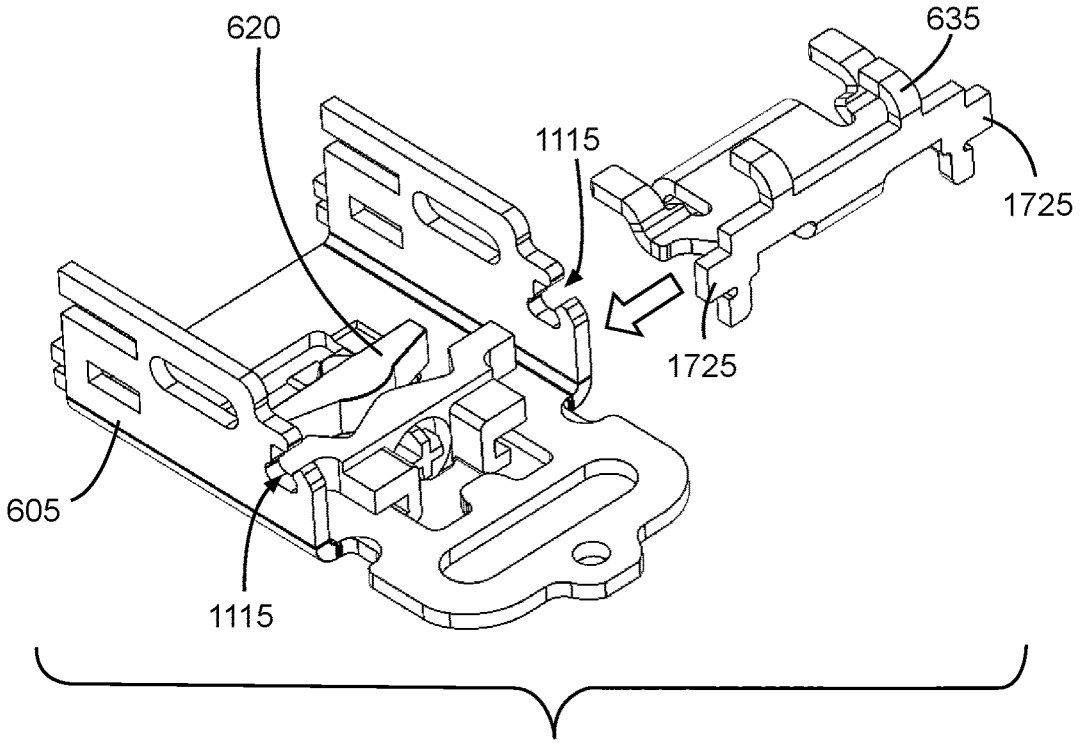
FIG. 31 is an exploded view of the lock pawl being coupled to the frame during assembly.
Figure 32:
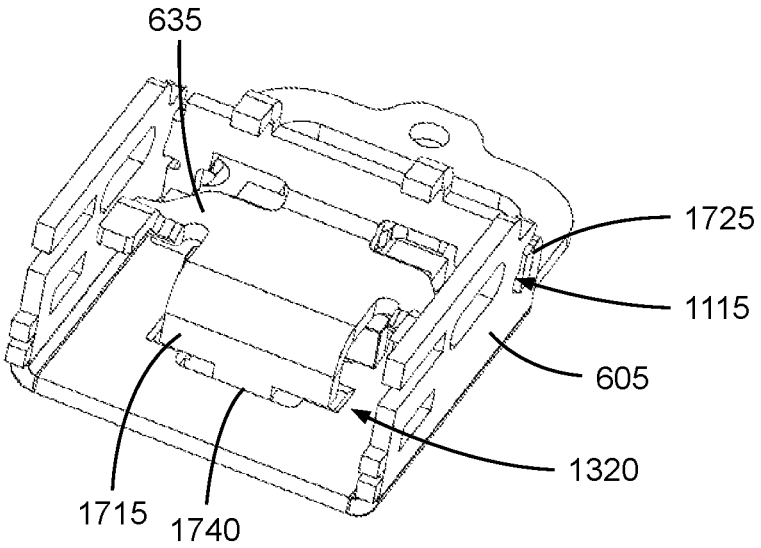
FIG. 32 is a front perspective view of the lock pawl in a latched position.
Figure 33:
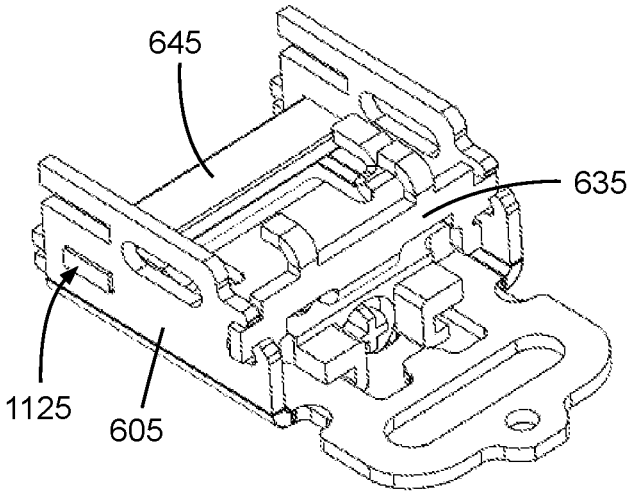
FIG. 33 is a rear perspective view of a latch plate retention bar attached to the frame during assembly.
Figure 34:
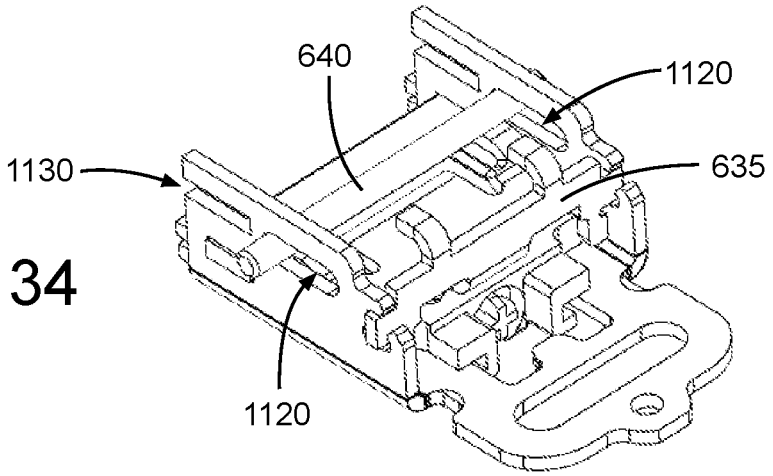
FIG. 34 is a rear perspective view of a latch pin coupled to the frame during assembly.

Turning to FIGS. 31 and 32, the lock pawl 635 is coupled to the frame 605 by inserting the pivot tabs 1725 of the lock pawl 635 into the latch pivot notches 1115 in the frame 605. The latch plate retention bar 645 is secured to the retention bar slots 1125 of the frame 605. It should be recognized that the latch plate retention bar 645 can be secured at other times during the assembly process, such as before or after the ejector mechanism 620 and/or lock pawl 635 are secured to the frame 605. As depicted in FIG. 34 the latch pin 640 is inserted into the pin guide slots 1120 of the frame 605. The release button 625 is then secured to the frame 605. The release button 625 is clipped onto the ends of the latch pin 640 by inserting the ends into the pin openings 1415 (FIG. 14) of the frame engagement flanges 1410 to arrive at the configuration for example illustrated in FIGS. 7 and 9.

With the release button 625 secured to the frame 605, the ends of the button springs 630 are secured to the spring seat fingers 1730 of the lock pawl 635 (FIG. 17) and the spring seats 1505 of the release button 625 (FIG. 15). Once the buckle mechanism 300 is assembled, the buckle mechanism 300 is then sandwiched inside the mechanism cover 305 and base cover 310 to form the housing 215, and the mechanism cover 305 and base cover 310 are secured together, such as with fasteners, adhesives, etc. With the reduced number of components, the buckle 200 can be assembled quickly and inexpensively. Again, it should be recognized that the components of the buckle 200 can be assembled in a different order than is described and illustrated.

Figure 35:
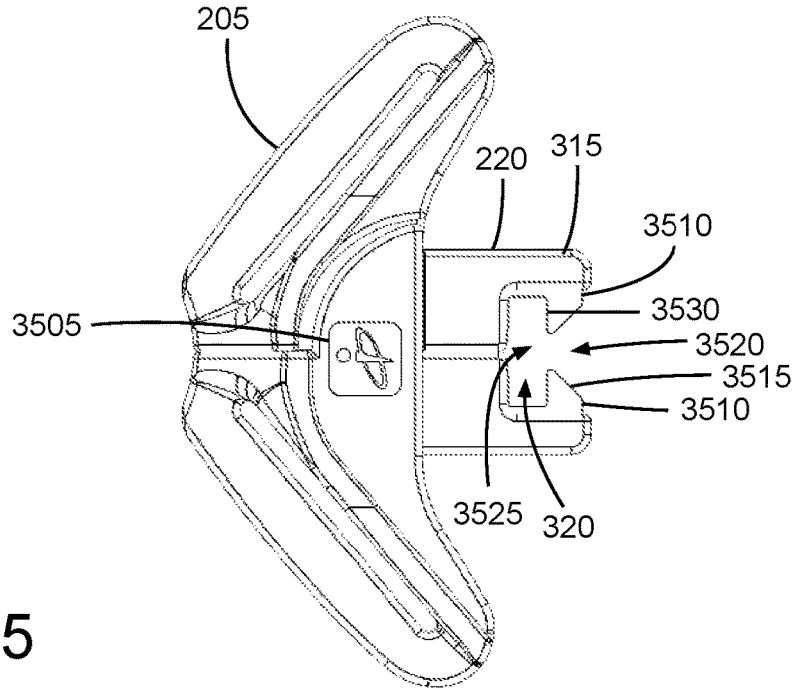
FIG. 35 is a top perspective view of a latch plate assembly shown in FIG. 2.

FIG. 35 illustrates the latch plates 220 coupled together to form the latch plate assembly 205. The latch plates 220 can be properly aligned with one another mechanically, such as through a keying type structural arrangements, and/or in other ways. For example, the latch plate assembly 205 in one form includes a magnetic coupling 3505 in the form of magnets with opposite polarity arrangement on each of the latch plates 220. On the tongues 315, the latch plates 220 each has an ejector contact edge 3510 that is configured to contact the tongue engagement arms 2415 of the ejector swivel 655. From the ejector contact edge 3510, the tongue 315 of the latch plates 220 has a beveled edge 3515 to assist with alignment during insertion. When the latch plate assembly 205 is coupled together, the beveled edges 3515 form a tongue gap 3520 in which the nose tab guide 2320 of the ejection slider 650 is received during buckling. The latch notches 320 in the tongues 315 together form a latch cavity 3525 in which the lock portion 1715 of the lock pawl 635 is secured when latched in the buckle 200. The latch notch 320 in each tongue 315 forms a latch edge 3530 where the latch plate assembly 205 hooks onto or otherwise contacts the lock portion 1715 of the lock pawl 635 when the latch plate assembly 205 is secured to the buckle 200.

Figure 36:
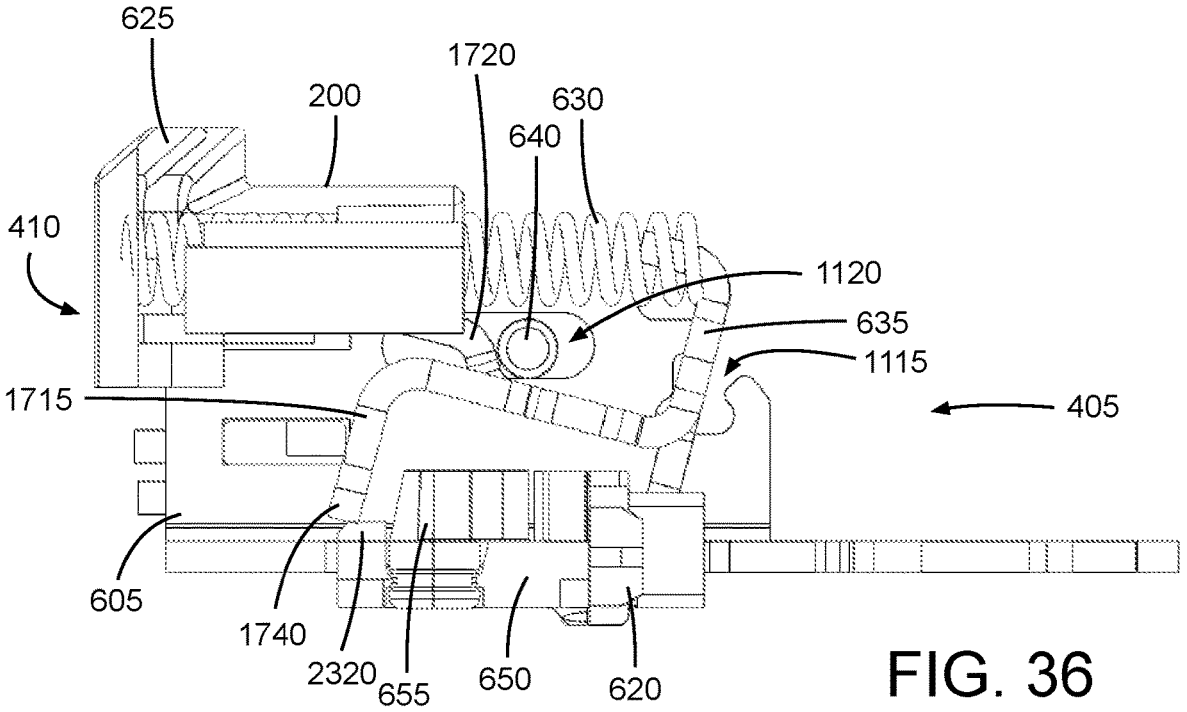
FIG. 36 is a side cross-sectional view of the buckle in an unbuckled state.

FIG. 36 show the buckle 200 in a normal unbuckled state before (or after) the latch plate assembly 205 is secured to the buckle 200. In this state, the lock pawl 635 is at a rotated position where the nose tab 1740 contacts the nose tab guide 2320 of the ejector mechanism 620. The ejection spring 660 along with the ejector fingers 1735 of the lock pawl 635 biases and holds the ejection slider 650 in a fully extended ejection position where the nose tab 1740 rests on the nose tab guide 2320. As shown, the release button 625 is in a partially retracted state which is caused by the latch pin 640 being disposed towards the web engagement end 405 in the pin guide slot 1120 of the frame 605. The latch pin 640 is at least partially held in this position by the cam arms 1720 of the lock pawl 635.

Figure 37:
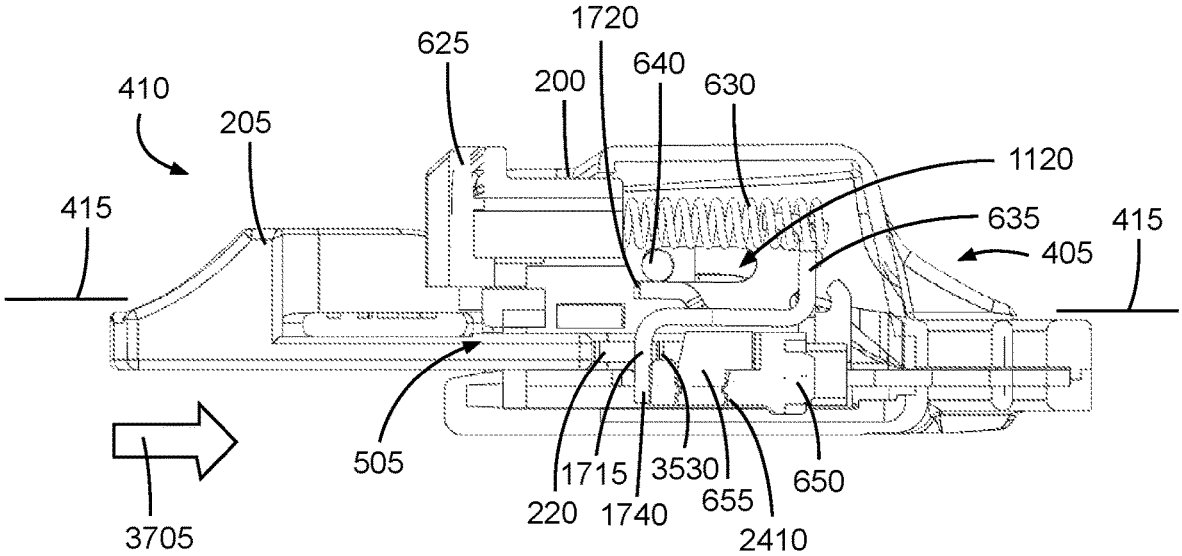
FIG. 37 is a side cross-sectional view of the latch plate assembly buckled to the buckle.
Figure 38:
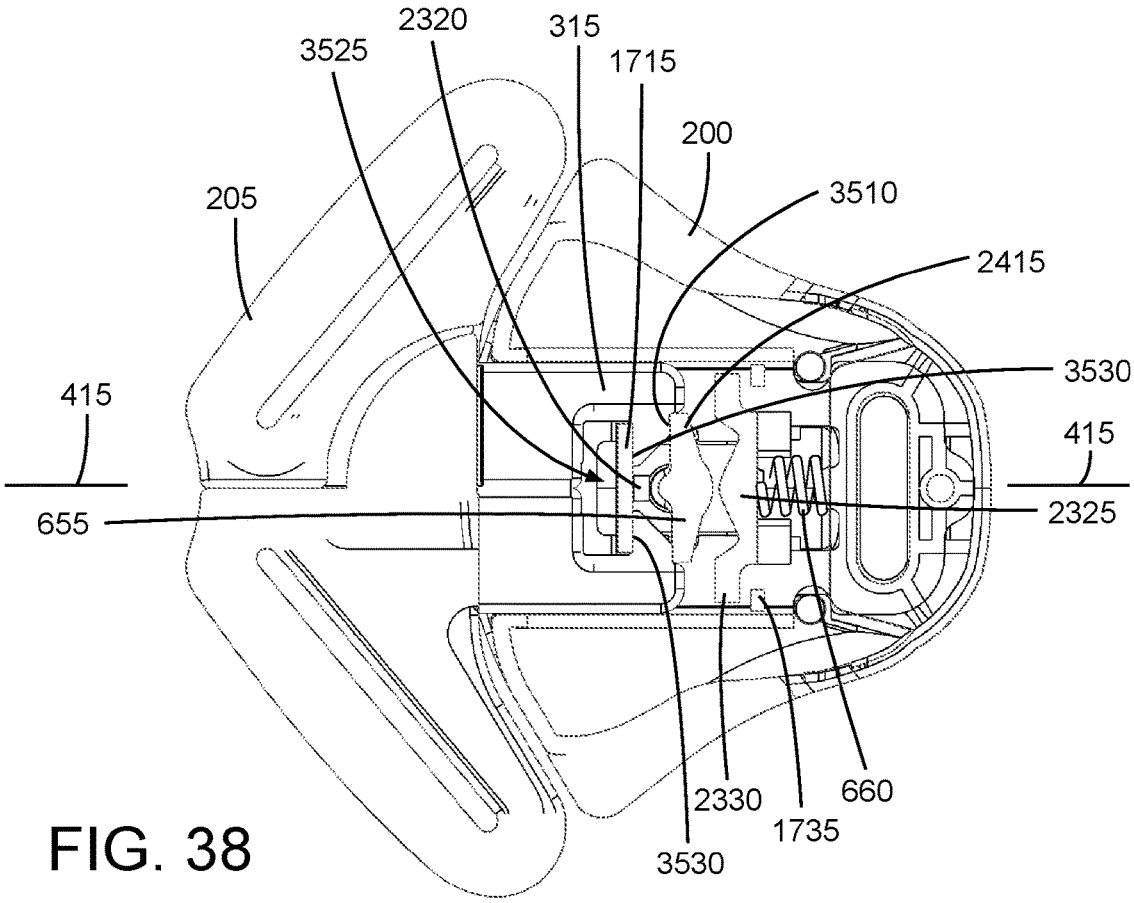
FIG. 38 is a top cross-sectional view of the latch plate assembly buckled to the buckle.

A technique for inserting and securing the latch plate assembly 205 in the buckle 200 will now be described with reference to FIGS. 37 and 38. Once more, the buckle mechanism 300 is designed to prevent just a single latch plate 220 from being secured without the other. In other words, the latch plates 220 of the latch plate assembly 205 must be properly aligned and coupled together before the lock pawl 635 in the buckle mechanism 300 is able to latch the latch plate assembly 205 with the buckle 200. When a single latch plate 220 is inserted into the latch plate cavity 505 of the buckle 200, the ejector contact edge 3510 of the tongue 315 of the latch plate 220 contacts just one of the tongue engagement arms 2415 such that ejector swivel 655 begins to swivel. While the ejector swivel 655 swivels, the ejection slider 650 is stationary with the nose tab guide 2320 remaining in contact with the nose tab 1740 of the lock pawl 635 such that the lock pawl 635 stays in an unlatched position. When the single latch plate 220 is inserted further into the buckle 200, the relief notches 2335 in the latch bias wing 2325 allow the ejector swivel 655 to further swivel while ejection slider 650 remains stationary. The tongue engagement arms 2415 are then angled such that further insertion causes the end of the latch plate 220 to slide in an outward lateral direction which in turn prevents the latch notch 320 in the tongue 315 from engaging the lock portion 1715 of the lock pawl 635.

To secure the latch plate assembly 205 with the buckle 200, the latch plate assembly 205 is inserted into the latch plate cavity 505 of the buckle 200 in an insertion direction 3705 along the longitudinal axis 415. When the latch plates 220 are both properly coupled together and inserted at the same time into the latch plate cavity 505 of the buckle mechanism 300, the ejector contact edges 3510 of the latch plates 220 contact the tongue engagement arms 2415 of the ejector mechanism 620 at the same time, and the ejector swivel 655 does not rotate or swivel. In other words, the forces applied by both ejector contact edges 3510 on the tongue engagement arms 2415 located on opposite sides of the pivot connector head 2410 balance one another, thereby preventing rotation of the ejector swivel 655.

Against the biasing force of the of the ejection spring 660, the latch plate assembly 205 is able to slide the ejection slider 650 in the insertion direction 3705. This sliding movement of the ejection slider 650 compresses the ejection spring 660, and the resulting potential energy stored in the ejection spring 660 can be later used to move the ejection slider 650 during ejection of the latch plate assembly 205. As the latch plate assembly 205 is further pushed into the buckle 200, the ejection slider 650 continues to slide in the along the longitudinal axis 415 in the insertion direction 3705, and the nose tab 1740 of the lock pawl 635 slides off the nose tab guide 2320 so that the lock pawl 635 is able to latch to the latch notches 320 in the latch plate assembly 205. Eventually, as the ejection slider 650 continues to slide, the wing tabs 2330 of the ejection slider 650 press against the ejector fingers 1735 of the lock pawl 635. When the ejector fingers 1735 are pressed, the lock pawl 635 is able to pivot about the pivot tabs 1725 to have the lock portion 1715 latch in the latch notches 320. After latching, the ejection spring 660 may cause the ejection slider 650 to slide back such that a space or gap is formed between the ejector fingers 1735 of the lock pawl 635 and the wing tabs 2330 of the ejection slider 650. This spacing gives some play in the release button 625 so as to prevent accidental release of the latch plate assembly 205 when the release button 625 is accidentally or incidentally pressed.

When the latch plate assembly 205 is buckled or latched in the buckle 200, the lock portion 1715 of the lock pawl 635 is received inside the latch cavity 3525 of the latch plate assembly 205. The latch edges 3530 of the latch plate assembly 205 are pressed or hooked against the lock portion 1715 of the lock pawl 635. To prevent slippage, the side end edges of the lock portion 1715 are received in the latch alignment grooves 1320 of the frame 605 (FIG. 13). The nose tab 1740 of the lock pawl 635 extends through the ejector guide slot 1145 in the frame 605. To further prevent accidental release, the latch pin 640 presses against the cam arms 1720 of the lock pawl 635 so as to hold the lock pawl 635 in a latched position. With the pin guide slot 1120 only extending in a straight line along the longitudinal axis 415, only the smooth linear motion of the release button 625 being pushed in a single direction along the longitudinal axis 415 can release the latch pin 640 such that the lock pawl 635 can decouple from the latch plate assembly 205. Movements in other directions will not cause the lock pawl 635 to be accidentally unlatched. With the latch plate assembly 205 latched in the buckle 200, the occupant can be at least partially secured in the harness system 100, though additional tightening of the webbing 110 may be required.

Figure 39:
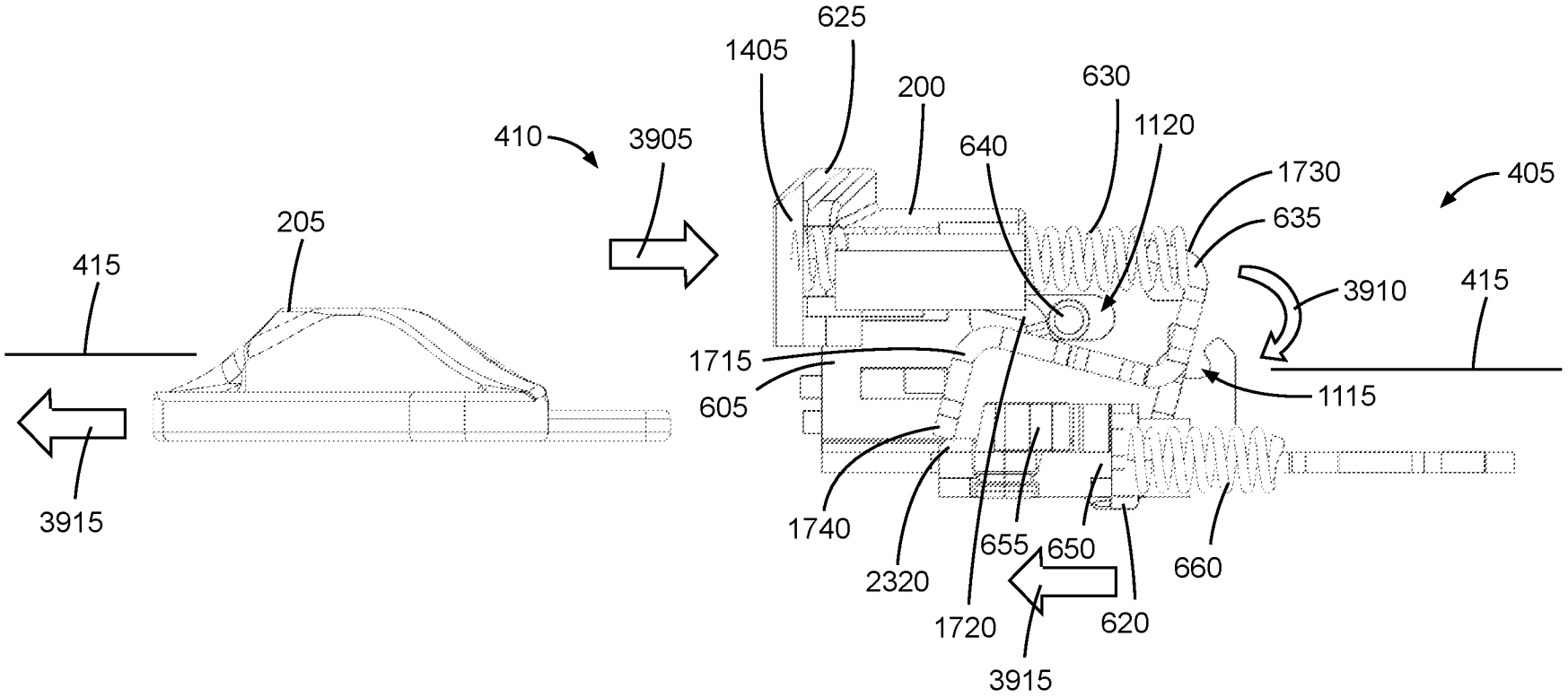
FIG. 39 is a partial cross-sectional view of the buckle and latch plate assembly during ejection.

To release the latch plate assembly 205 from the buckle 200, the user actuates the release button 625. Once more, the release button 625 is designed to smoothly slide in a straight direction along the longitudinal axis 415 when pressed. Looking at FIG. 39, an individual presses on the actuation surface 1405 of the release button 625 in the direction indication by arrow 3905 that is parallel to the longitudinal axis 415 (i.e., in the insertion direction 3705) to release the latch plate assembly 205. When the release button 625 is pressed, the latch pin 640, which is coupled to the release button 625, longitudinally slides in the pin guide slot 1120 of the frame 605 towards the web engagement end 405. This movement in turn releases cam arms 1720 of the lock pawl 635 from the latch pin 640 such that the lock pawl 635 is no longer locked in the latched position. At the same, the button springs 630 are compressed between the release button 625 and the ejector fingers 1735 of the lock pawl 635. Due to this compression, the pressing force is transferred from the release button 625 to the lock pawl 635 via the button springs 630. With the lock pawl 635 now released by the latch pin 640 and the force from the release button 625 being applied to the spring seat fingers 1730, the lock pawl 635 pivots about the pivot tabs 1725 in the latch pivot notch 1115 (see e.g., FIGS. 31 and 32) in a rotational direction indicated by arrow 3910 in FIG. 39.

As the lock pawl 635 rotates, the lock portion 1715 of the lock pawl 635 is removed or disengages from the latch cavity 3525 of the latch plate assembly 205 (FIG. 35). Around the same time, the pivoting motion of the lock pawl 635 also causes the ejector fingers 1735 (FIG. 17) to push against the wing tabs 2330 of the ejector mechanism 620 (FIG. 23) so as to cause the ejection slider 650 to slide in an ejection direction 3915. The ejection spring 660 that was compressed when the latch plate assembly 205 was buckled is now released so as to also push the ejection slider 650 in the ejection direction 3915. The ejector swivel 655 of the ejector mechanism 620 then pushes the latch plate assembly 205 in the ejection direction 3915 so as to eject the latch plate assembly 205. Again, the ejector fingers 1735 of the lock pawl 635 allow the latch plate assembly 205 to be unlatched and ejected even when the ejection spring 660 is clogged with debris, damaged, and/or otherwise functionally inoperable. The buckle 200 returns to the initial unbuckled state where the nose tab 1740 rests against the nose tab guide 2320 of the ejection slider 650, and the release button 625 is now at a partially retracted position, as was described before with respect to FIG. 36. With the latch plate assembly 205 unlatched from the lock pawl 635 and moved in the ejection direction 3915, the latch plate assembly 205 can be removed from the buckle 200, and the occupant can be freed from the harness system 100.

A buckle 4000 according to another example will now be described with reference to FIGS. 40, 41, and 42. The buckle 4000 is constructed and functions generally in the same fashion as the one previously described with just a few notable exceptions that will be discussed below. For the sake of brevity and clarity, these common features and functions will not be described again, but please refer to the previous discussion. Unless otherwise described, the buckle 4000 in FIGS. 40, 41, and 42 has the same components as the buckle 200 described before and operates in the same way.

Figure 40:
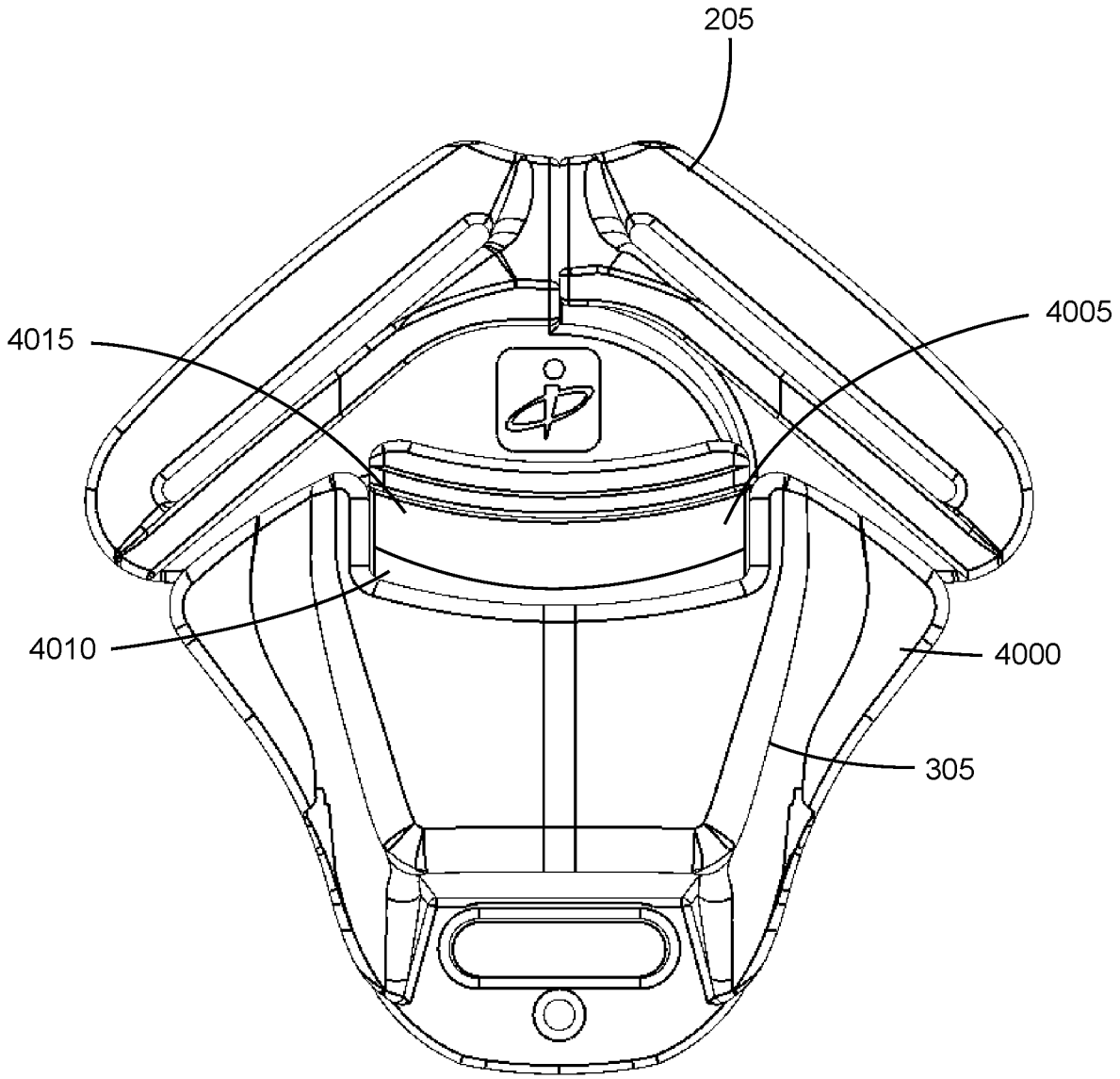
FIG. 40 is a top view of a buckle according to another example.

The buckle 4000 of FIG. 40 has a release button 4005 that has a few additional features different from the release button 625 described before. As can be seen, the release button 4005 has an indicator 4010 that is only visible when the latch plate assembly 205 is properly locked with the buckle 4000. The indicator 4010 has a physical appearance that differs from and/or is in contrast to a persistent visible area 4015 on the release button 4005 that is visible at all times, whether or not the latch plate assembly 205 is buckled to the buckle 4000. In one example, the persistent visible area 4015 is colored red, and the indicator 4010 is colored green to indicate that the latch plate assembly 205 was buckled properly in the buckle 4000, but in other examples, the indicator 4010 can include other types of indicators, such as patterns, colors, shapes, words, icons, and/or designs. When the buckle 4000 is in an unbuckled state, the release button 4005 is in the partially or intermediate retracted position, such as is in the same fashion shown in FIG. 36. At this partially retracted position, the indicator 4010 of the release button 4005 is covered by the mechanism cover 305 such that only the persistent visible area 4015 is visible to the operator. When the latch plate assembly 205 is buckled to the buckle 4000, such as in a similar fashion shown in FIG. 37, the release button 4005 is positioned at a fully extended position such that the indicator 4010 is now visible to the operator (i.e., not covered by the mechanism cover 305), thereby indicating that the latch plate assembly 205 is buckled properly. To decouple and eject the latch plate assembly 205, the operator presses on the release button 4005 so that the release button 4005 is at a fully retracted position. Once the latch plate assembly 205 is ejected from the buckle 4000, the release button 4005 returns to the intermediate position, such as for example in a similar fashion shown in FIG. 39, where the indicator 4010 is covered by the mechanism cover 305 and is no longer visible to the operator or others.

Figure 41:
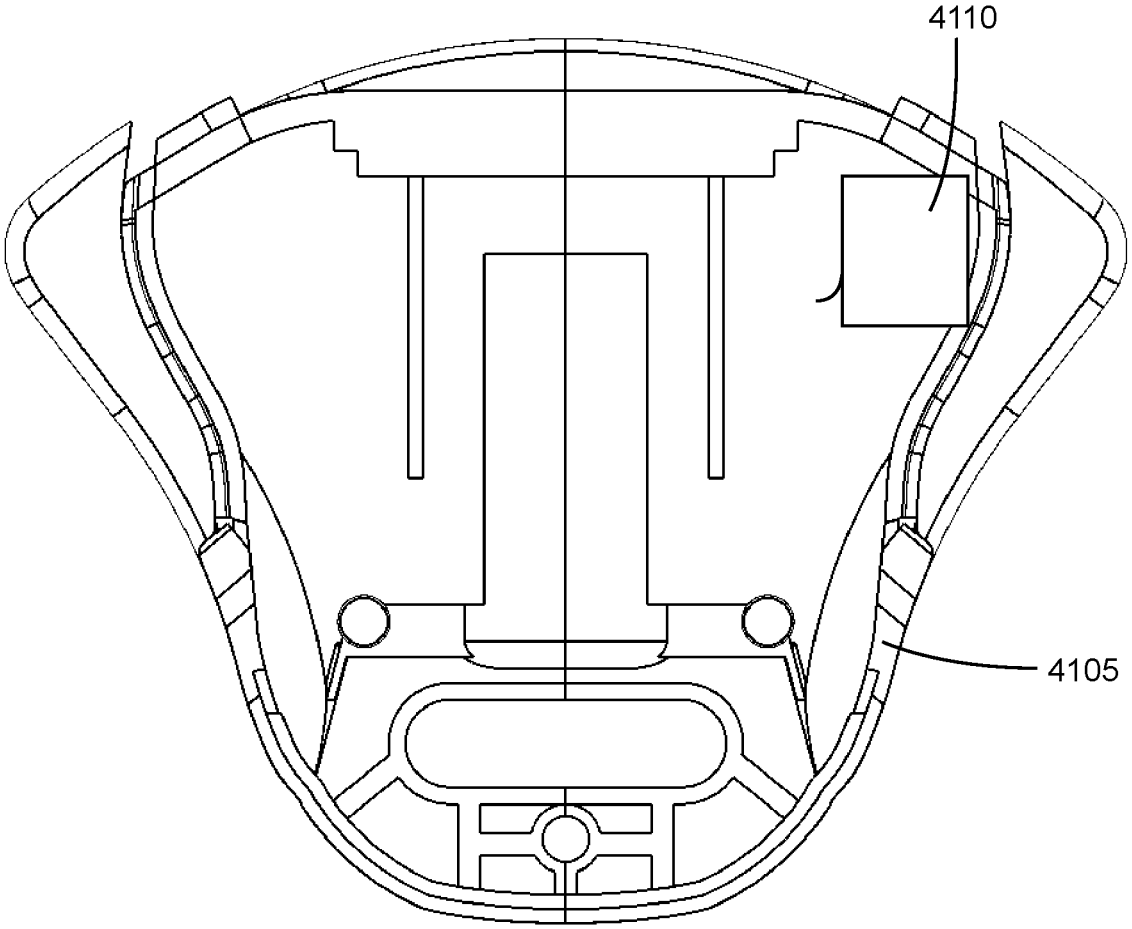
FIG. 41 is a top view of a base cover with a sensor found in the FIG. 40 buckle.

The buckle 4000 in FIG. 40 has the same mechanism cover 305 of the type described before, but the buckle 4000 has a base cover 4105 that is configured to receive a sensor 4110, as is depicted in FIG. 41. In one example, the sensor 4110 is configured to sense the latching state of the buckle 4000, but the sensor 4110 can be used to detect other properties of the buckle 4000 and/or latch plate assembly 205, such as temperature and component wear. The sensor 4110 can include a variety of sensors, like mechanical switches, proximity switches, optical sensors, magnetic sensors, capacitive sensors, and/or thermocouples, to name just a few examples. In one particular example, the sensor 4110 includes an electrical contact switch.

Figure 42:
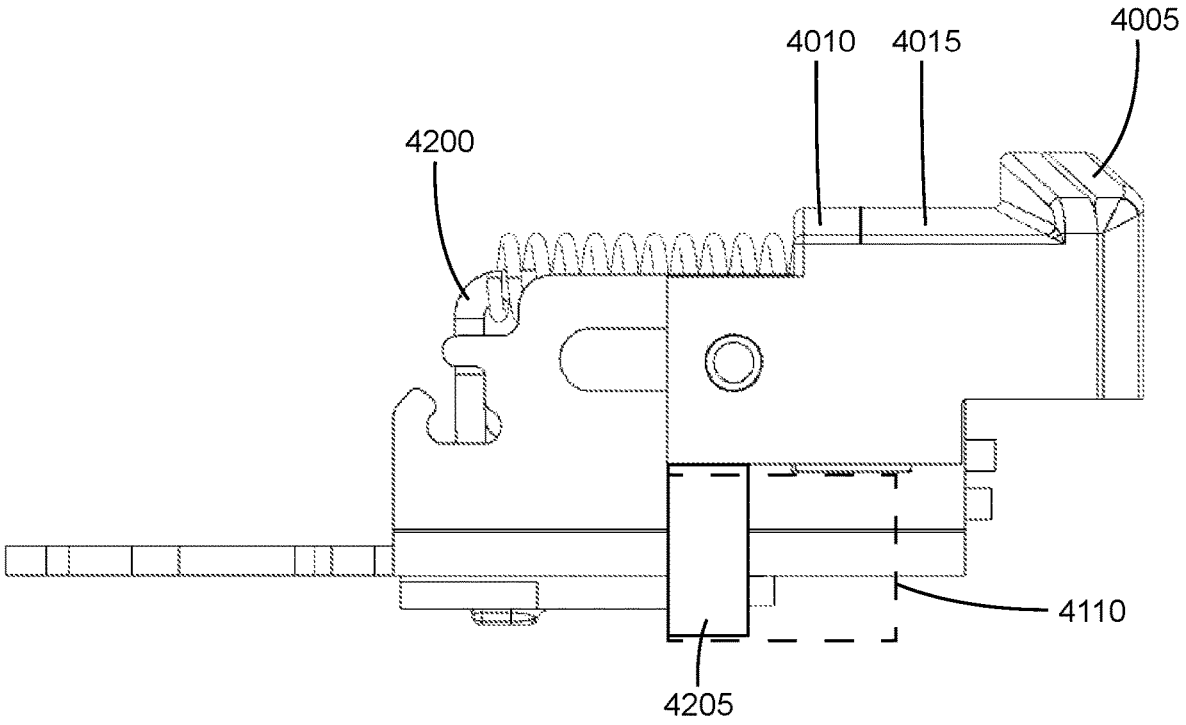
FIG. 42 is a side view of a buckle mechanism with the sensor of the FIG. 40 buckle.

Turning to FIG. 42, with the exception of the release button 4005, the buckle 4000 includes a buckle mechanism 4200 that is constructed and functions in the same fashion as the buckle mechanism 300 illustrated in FIG. 3. As can be seen, the release button 4005 includes a sensor arm 4205 that extends proximal to the sensor 4110. In one example, the sensor 4110 is able to sense the relative position of the release button 4005 via the sensor arm 4205. For instance, when the sensor 4110 is an electrical switch, the sensor arm 4205 opens or closes the switch so as to indicate if the release button 4005 has been actuated and/or if the latch plate assembly 205 has been properly buckled in the buckle 4000. The sensor 4110 in one particular example senses if the latch plate assembly 205 is properly secured to the buckle 4000. The sensor 4110 via a wired connection and/or wirelessly communicates this status to a vehicle controller which in turn can communicate this status to other occupants of the vehicle, such as via a warning light and/or audible alarm. In further examples, the sensor 4110 can monitor the properties of other parts of the release button 4005 and/or other components of the buckle 4000 (e.g., the ejector mechanism 620, lock pawl 635, latch pin 640, etc.).

Figure 43:
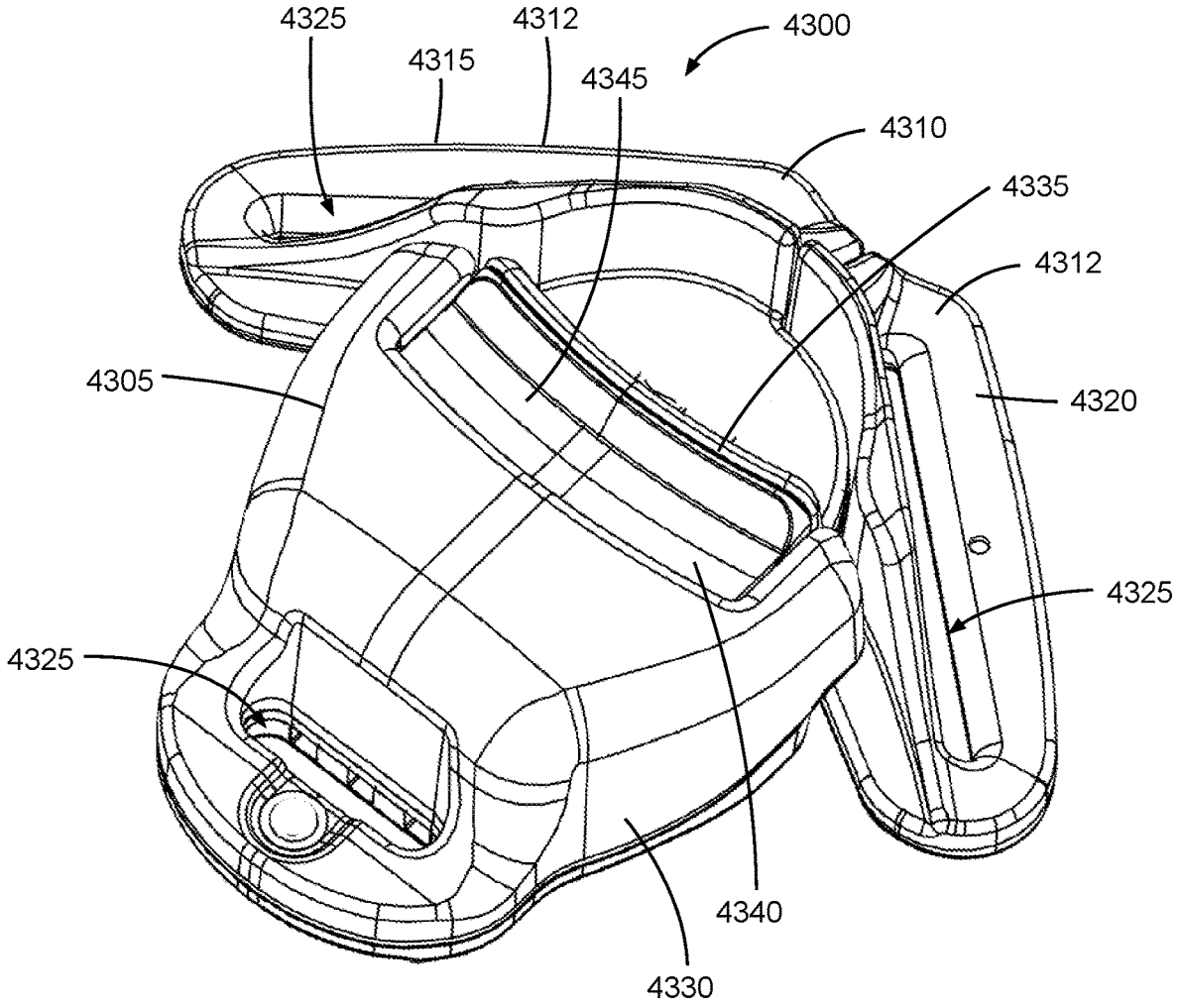
FIG. 43 is a perspective view of a buckle system according to a further example.

Another example of a buckle system 4300 that can be used with the webbing 110 of the FIG. 1 harness system 100 is depicted in FIG. 43. As will be recognized, the buckle system 4300 shares a number of features in common with the buckle system 105 shown in FIG. 2 as well as FIG. 40 and operates in a similar fashion as those described before. For the sake of brevity and clarity, these common features and functions will not be again described in great detail below, but please refer to the previous discussion. The buckle system 4300 in one form is used in a vehicle restraint system, such as a child car seat, but the buckle system 4300 can be used in other environments.

The buckle system 4300 includes a buckle 4305 to which a latch plate assembly 4310 is buckled. The latch plate assembly 4310 includes one or more latch plates 4312 that are secured to the buckle 4305. In the illustrated example, the latch plate assembly 4310 includes a first latch plate 4315 and a second latch plate 4320 that are coupled together before being buckled to the buckle 4305. The latch plate assembly 4310 includes two (2) latch plates 4312 that are coupled together before being inserted into the buckle 4305, but the latch plate assembly 4310 in other examples can includes more or less latch plates 4312 than is shown. As depicted, the buckle 4305 along with the first latch plate 4315 and second latch plate 4320 each include one or more web slots 4325 to which the webbing 110 is secured. As shown, the buckle 4305 has a housing 4330 for protecting the internal components of the buckle 4305.

The buckle system 4300 of FIG. 40 has a release button 4335. As can be seen, the release button 4335 has an indicator 4340 that is only visible when the buckle 4305 is properly locked with the latch plate assembly 4310. The indicator 4340 has a physical appearance that differs from and/or is in contrast to a persistent visible area 4345 on the release button 4335 that is visible at all times, whether or not the latch plate assembly 4310 is buckled to the buckle 4000. In one example, the persistent visible area 4345 is colored red, and the indicator 4340 is colored green to indicate that the latch plate assembly 4310 was buckled properly in the buckle 4000, but in other examples, the indicator 4340 can include other types of indicators, such as patterns, colors, shapes, words, icons, and/or designs. When the buckle system 4300 is in an unbuckled state, the release button 4335 is in the partially or intermediate retracted position. At this partially retracted position, the indicator 4340 of the release button 4335 is covered by the housing 4330 such that only the persistent visible area 4345 is visible to the operator. When the latch plate assembly 4310 is buckled to the buckle 4305, the release button 4335 is positioned at a fully extended position such that the indicator 4340 is now visible to the operator (i.e., not covered by the housing 4330), thereby indicating that the latch plate assembly 4310 is buckled properly. To decouple and eject the latch plate assembly 4310, the operator presses on the release button 4335 so that the release button 4335 is at a fully retracted position. Once the latch plate assembly 4310 is ejected from the buckle 4305, the release button 4335 returns to the intermediate position, where the indicator 4340 is covered by the housing 4330 and is no longer visible to the operator or others.

Figure 44:
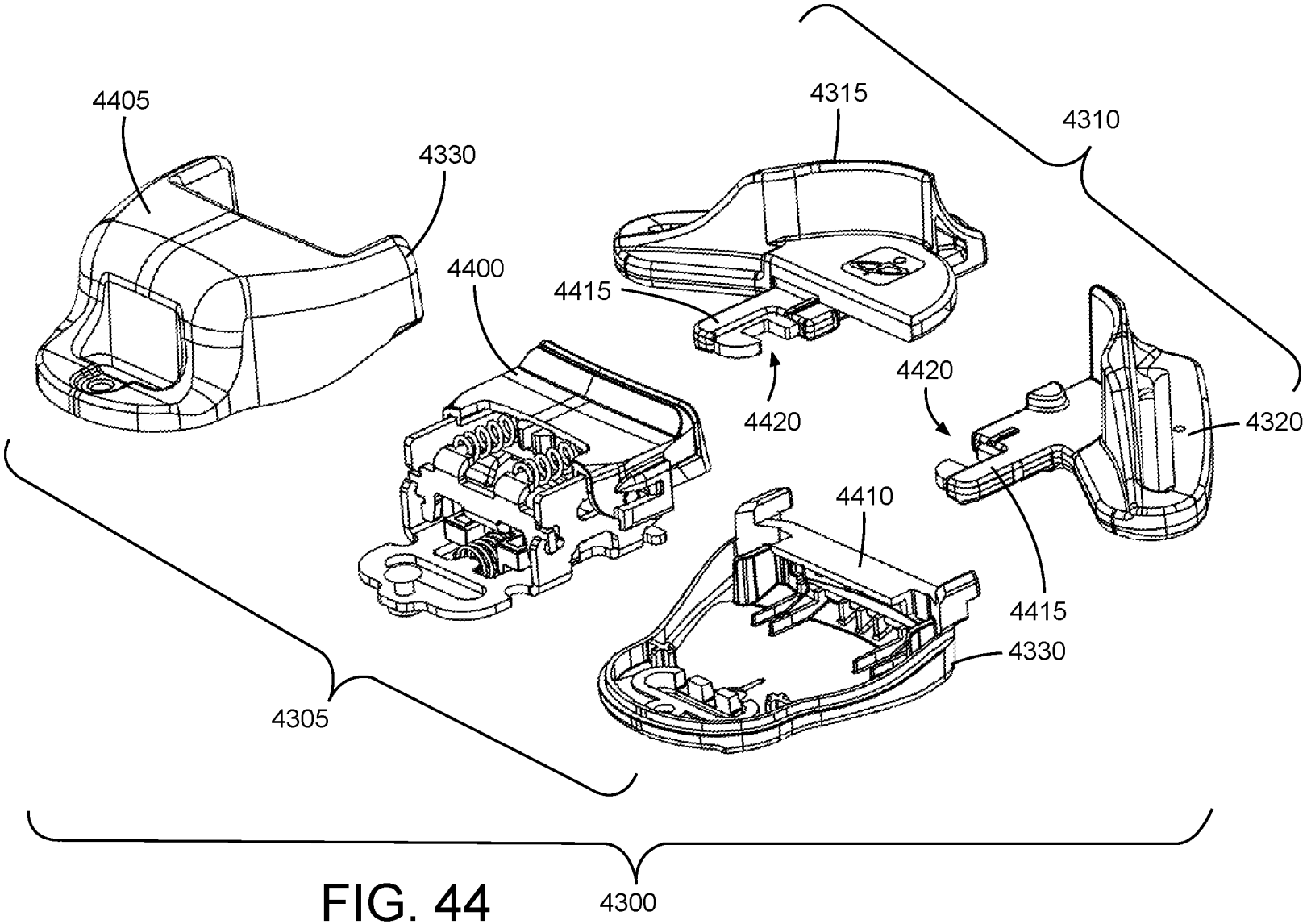
FIG. 44 is an exploded view of the FIG. 43 buckle system.

An exploded view of the buckle system 4300 is depicted in FIG. 44. As shown, the buckle 4305 includes a buckle mechanism 4400 that is attached by the housing 4330. The housing 4330 of the buckle 4305 includes a mechanism cover 4405 and a base cover 4410 that are coupled together in a clamshell type configuration around the buckle mechanism 4400. Each of the latch plates 4312 of the latch plate assembly 4310 have a tongue 4415 with a latch notch 4420. When the latch plates 4312 are coupled together, the latch plate assembly 4310 can then be inserted into the buckle mechanism 4400 of the buckle 4305.

Figure 45:
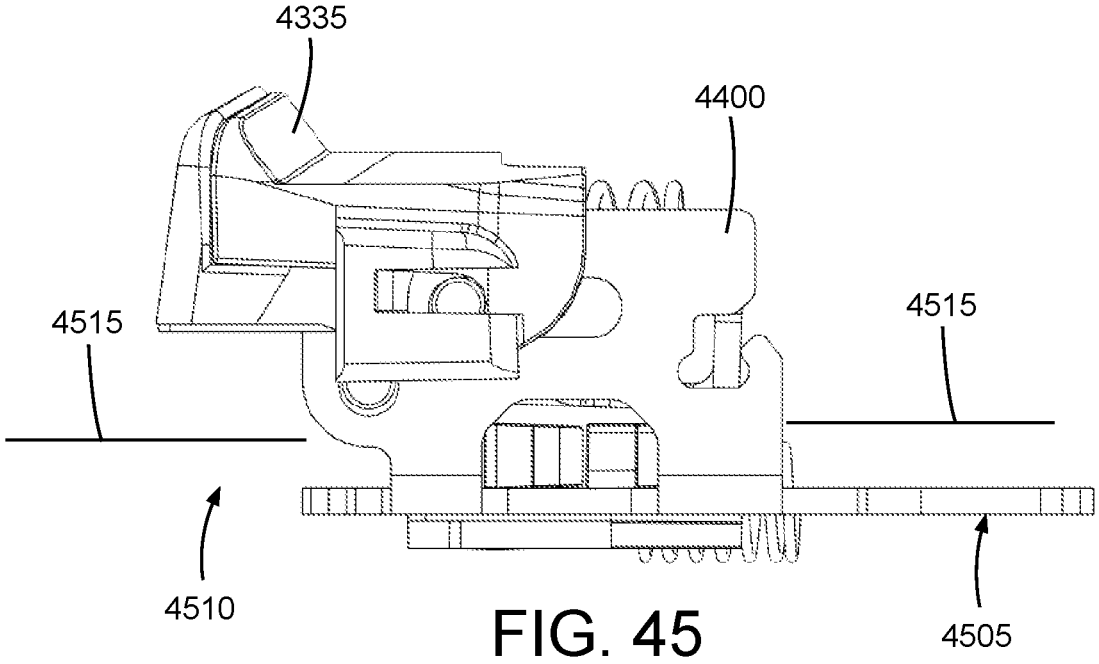
FIG. 45 is a side view of a buckle mechanism in the FIG. 43 buckle system.
Figure 46:
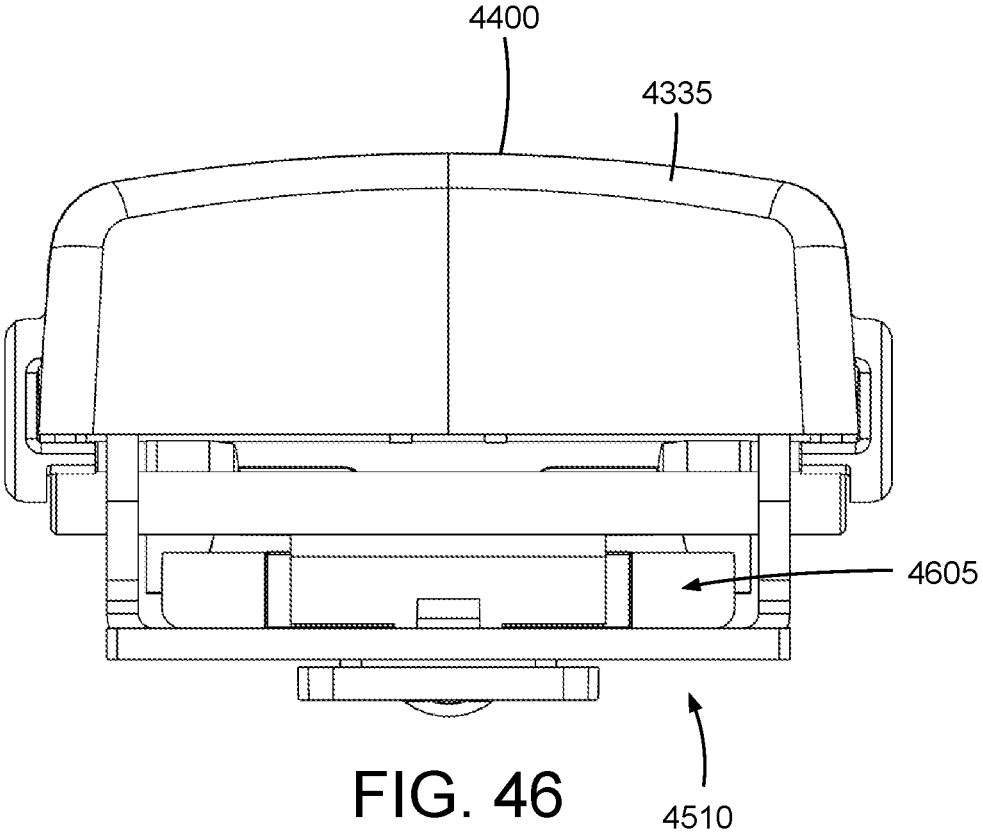
FIG. 46 is a rear view of the FIG. 45 buckle mechanism.

Turning to FIG. 45, the buckle mechanism 4400 includes a web engagement end 4505 where the webbing 110 is secured. Opposite the web engagement end 4505, the buckle mechanism 4400 has a latch plate coupling end 4510 where the latch plate assembly 4310 is inserted and secured. The buckle mechanism 4400 (and the buckle 4305) has a longitudinal axis 4515 that extends between the web engagement end 4505 and the latch plate coupling end 4510. As will be explained below, most of the movement action of the buckle 4305 occurs generally along this longitudinal axis 4515 so as to provide smooth actuation and latching movement. For example, the latch plate assembly 4310 is inserted into and ejected from the buckle 4305 along this longitudinal axis 4515 of the buckle 4305. Looking at FIG. 46, the buckle mechanism 4400 at the latch plate coupling end 4510 has a latch plate cavity 4605 configured to receive the tongues 4415 of the latch plates 4312.

Figure 47:
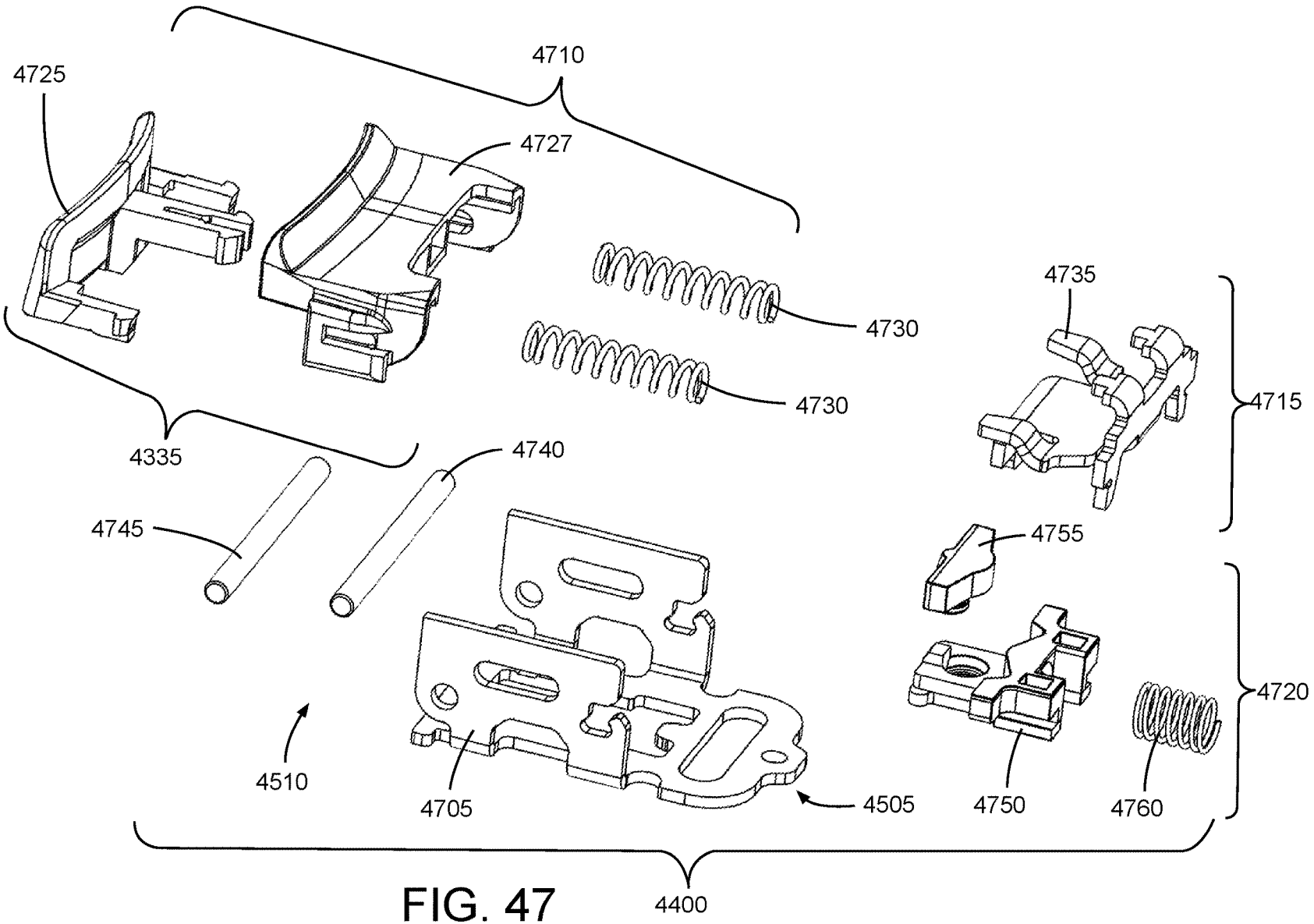
FIG. 47 is an exploded view of the FIG. 45 buckle mechanism.

Referring now to FIG. 47, the buckle mechanism 4400 includes a frame 4705 that supports a release mechanism 4710, latch mechanism 4715, and ejector mechanism 4720 of the buckle mechanism 4400. Among other things, the release mechanism 4710 along with the ejector mechanism 4720 is generally used to release and eject the latch plate assembly 4310 from the buckle 4305, and the latch mechanism 4715 is generally used to secure the latch plates 4312 of the latch plate assembly 4310 in the buckle mechanism 4400. The release mechanism 4710 includes the release button 4335. In the illustrated example, the release button 4335 includes an actuator cap 4725 and a spring retainer 4727. The release mechanism 4710 further includes one or more button springs 4730 that bias the release button 4335 in an extended position. The button springs 4730 are seated in the spring retainer 4727 of the release button 4335. The latch mechanism 4715 has a lock pawl 4735 designed to lock to the tongues 4415 of the latch plates 4312 and a latch pin 4740 configured to hold the lock pawl 4735 in the locked position. The latch pin 4740 is slidably coupled to the frame 4705, and the release button 4335 is secured to the latch pin 4740 so that the release button 4335 is able to move in a sliding fashion relative to the frame 4705. The lock pawl 4735 is pivotally coupled to the frame 4705. The button springs 4730 are biased or sandwiched between the release button 4335 and the lock pawl 4735. When the release button 4335 is pressed, the button springs 4730 transmit the force from the release button 4335 to the lock pawl 4735 so that the lock pawl 4735 pivots relative to the frame 4705 so as to release the latch plates 4312. The latch mechanism 4715 further includes a retention pin 4745 that is coupled to the frame 4705. Along with the frame 4705, the retention pin 4745 forms the latch plate cavity 4605 that keeps the latch plates 4312 coupled together so as to prevent latch plate assembly 4310 from accidentally disengaging from the buckle 4305.

The ejector mechanism 4720 includes an ejection slider 4750 that is slidably coupled to the frame 4705, an ejector swivel 4755 that is pivotally coupled to the ejection slider 4750, and at least one ejection spring 4760 to bias the ejection slider 4750. The ejector swivel 4755 is able to swivel relative to the ejection slider 4750 to ensure that both latch plates 4312 are properly secured together when locked in the buckle 4305. In other words, the ejector swivel 4755 is designed to swivel in order to prevent the lock pawl 4735 from latching with only a single latch plate 4312. The ejection spring 4760 is sandwiched between the frame 4705 and the ejection slider 4750 so as to bias the ejection slider 4750 in an ejection direction where the latch plate assembly 4310 is ejected from the latch plate cavity 4605.

As noted before, it was discovered in earlier designs that debris can collect in between the coils of the spring, thereby inhibiting proper ejection of the latch plates. Due to repeated use, the spring force can also deteriorate over time so as to further inhibit proper ejection of the latch plates. Without proper ejection of the latch plates, the latch plate may remain latched to the buckle which can be especially problematic such as during emergencies where quick occupant removal from the car seat is required.

The buckle mechanism 4400 in the illustrated example has been designed to address this as well as other issues. As noted before, when the release button 4335 is actuated, the lock pawl 4735 rotates so as to release the latch plate assembly 4310. This rotation also causes the lock pawl 4735 to contact the ejector swivel 4755 and push the ejection slider 4750 in the ejection direction so as to eject the latch plates 4312 from the latch plate cavity 4605 in the buckle 4305. In most cases, this ejection force from the lock pawl 4735 supplements the ejection biasing force applied by the ejection spring 4760, but in some cases, where the ejection spring 4760 has been damaged or otherwise rendered inoperative, the lock pawl 4735 can apply the sole ejection force to the ejection slider 4750 so as to eject the latch plate assembly 4310 from the buckle 4305.

Various features of the frame 4705 will now be described with reference to FIGS. 48 and 49. As shown, the frame 4705 includes a base 4805 and one or more support flanges 4810 extending in a transverse direction from the base 4805. In the illustrated example, a pair of support flanges 4810 extend perpendicularly from the base 4805 along opposing sides of the frame 4705 to form a latch plate channel 4812 in which various components of the buckle mechanism 4400 are received. Each support flange 4810 has a latch pivot notch 4815 where the lock pawl 4735 is pivotally coupled to the frame 4705. In the depicted example, the latch pivot notch 4815 is shaped to have a flat bottom and notched sides to allow the lock pawl 4735 to lay flat when latched and properly rotate during unlatching. The support flanges 4810 further each define a pin guide slot 4820 in which the latch pin 4740 is slidably received. To promote smooth actuation of the release button 4335 and firm latching of the lock pawl 4735, the pin guide slots 4820 extend in a direction that is generally parallel to the longitudinal axis 4515 of the buckle mechanism 4400. As can be seen, the pin guide slots 4820 are generally straight so that the latch pin 4740 can smoothly glide within the pin guide slots 4820. The pin guide slots 4820 in the depicted example do not have any bends or jogs where the latch pin 4740 could catch. The support flanges 4810 each further has retention bar slot 4825 in which the retention pin 4745 is secured.

Each support flange 4810 and the base 4805 further define one or more relief notches 4830. As shown, the relief notches 4830 extend from the base 4805 to the support flanges 4810. The relief notches 4830 are generally straight and extend in a generally parallel manner relative to the pin guide slots 4820. With such an arrangement, the actuator cap 4725 generally moves in a straight direction along the longitudinal axis 4515 when pressed or otherwise actuated. This release button 4335 further does not catch on anything when biased back to its original position. At the web engagement end 4505, the frame 4705 has a fastener opening 4835 configured to receive a fastener for securing the frame 4705 between the mechanism cover 4405 and base cover 4410. The frame 4705 at the web engagement end 4505 has a web eye 4840 through where the webbing 110 is looped.

Figure 48:
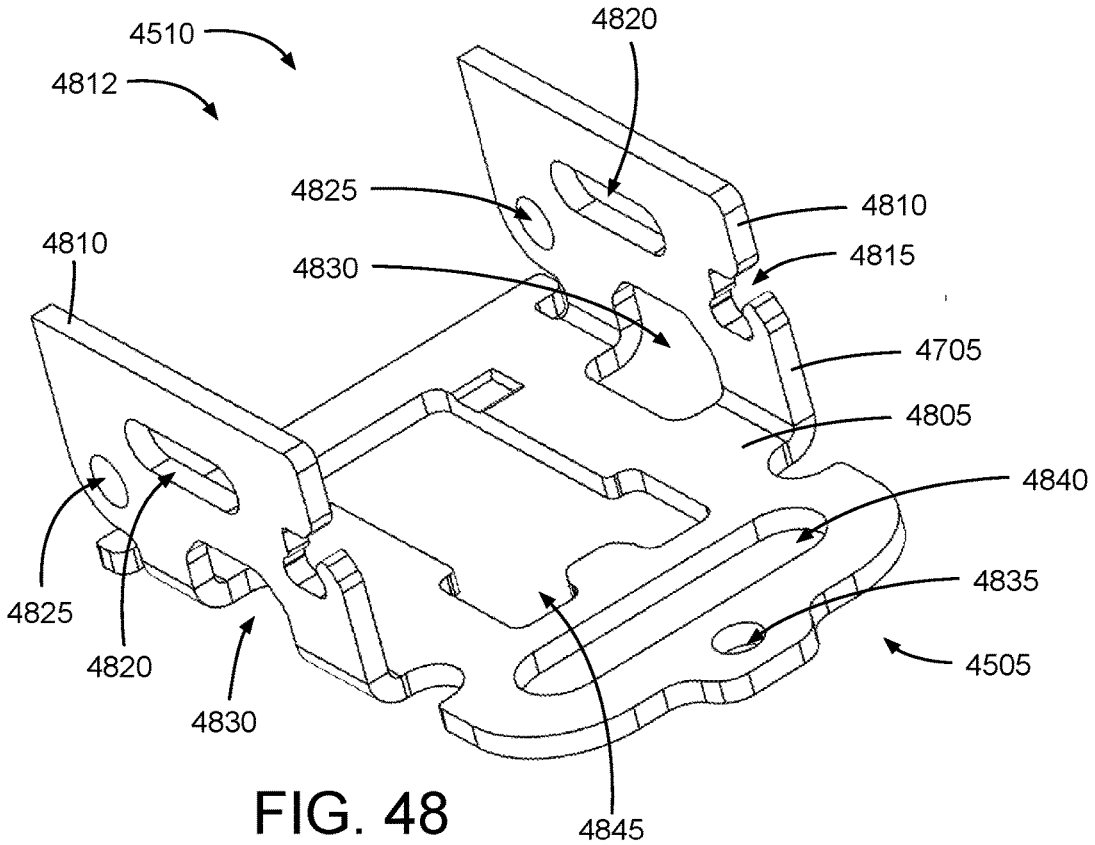
FIG. 48 is a perspective view of a latch plate coupling end in the FIG. 45 buckle mechanism.
Figure 49:
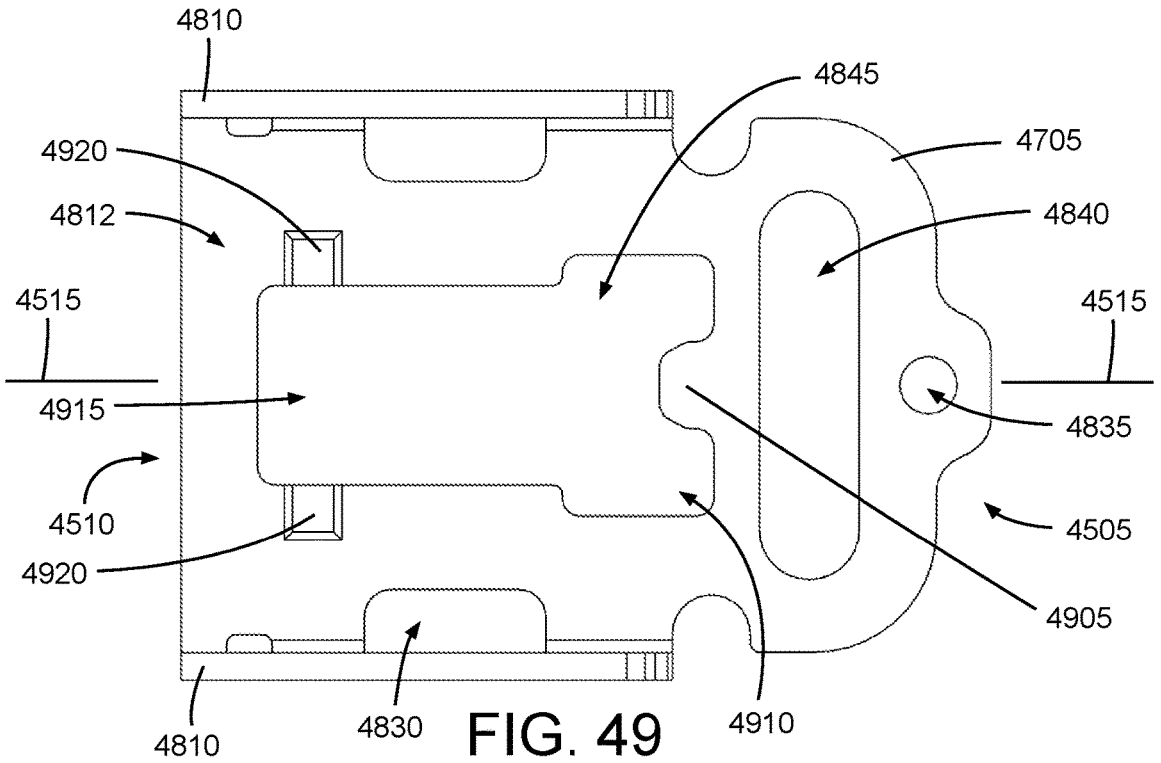
FIG. 49 is a top view of the FIG. 48 latch plate coupling end.

Looking at FIGS. 48 and 49, the base 4805 of the frame 4705 defines an ejector guide slot 4845 in which the ejector mechanism 4720 is slidably coupled to the frame 4705. The ejector guide slot 4845 has a spring seat flange 4905 where one end of the ejection spring 4760 is secured to the frame 4705. On opposing sides of the ejector guide slot 4845, the base 4805 has one or more spring seat facing relief notches 4910 and guide channel 4915. During assembly, the spring seat facing relief notches 4910 and guide channel 4915 allow the ejection slider 4750 to be slidably coupled to and retained on the frame 4705. At the sides of the ejector guide slot 4845 proximal to the latch plate coupling end 4510, the base 4805 has one or more latch alignment grooves 4920 configured to receive an end of the lock pawl 4735 when latched.

Figure 50:
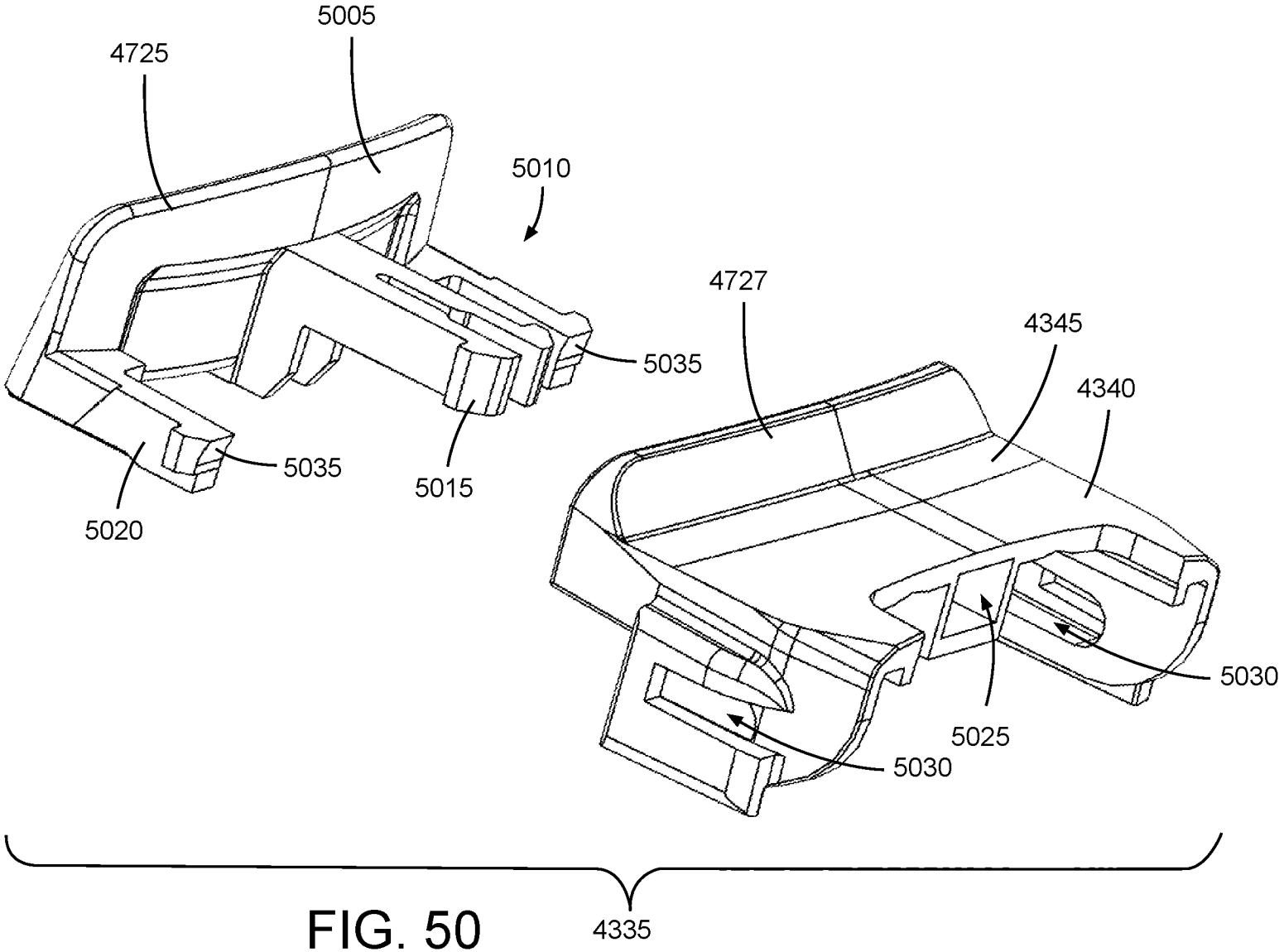
FIG. 50 is an exploded view of a release button of the FIG. 45 buckle mechanism.

FIG. 50 shows an exploded view of the release button 4335. As can be seen, the actuator cap 4725 has a cap body 5005 and one or more clip arms 5010 extending from the cap body 5005. The clip arms 5010 are configured to secure the actuator cap 4725 to the spring retainer 4727 via a snap fit type connection. In the illustrated example, the clip arms 5010 include one or more central clip arms 5015 and one or more side clip arms 5020.

Figure 51:
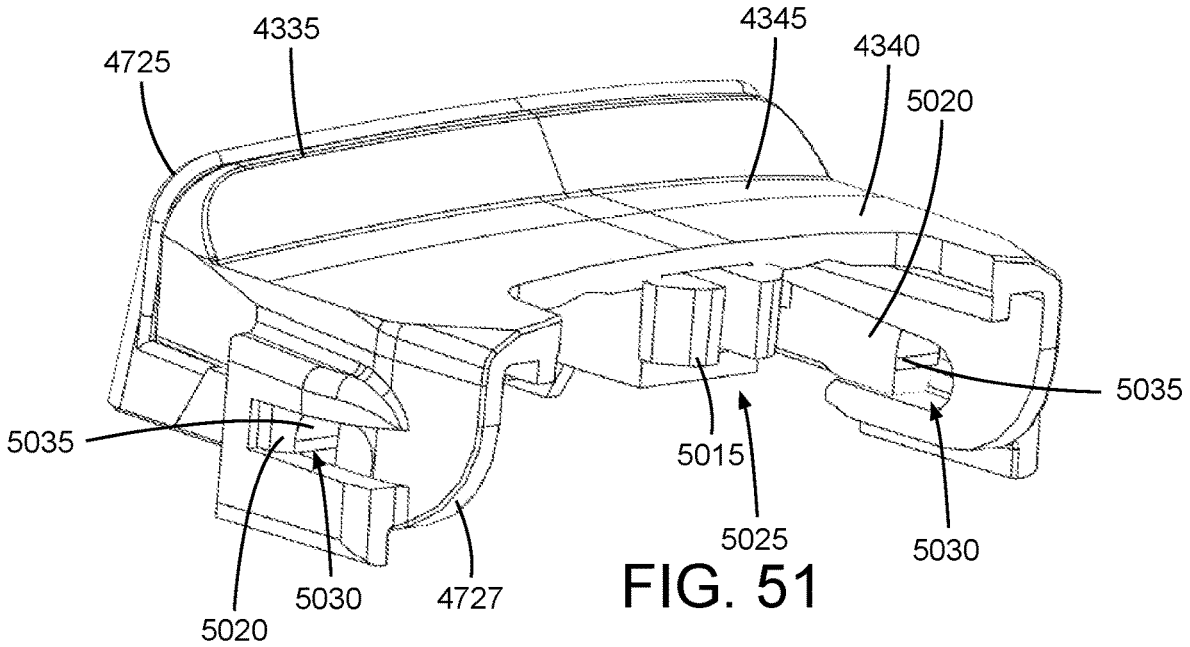
FIG. 51 is a top perspective view of the FIG. 50 release button.

As depicted in FIGS. 50 and 51, the side clip arms 5020 are configured to clip to a central clip cavity 5025 in the spring retainer 4727. The side clip arms 5020 are configured to clip to one or more latch pin engagement channels 5030 defined in the spring retainer 4727. Referring also to FIGS. 45, 47, and 48, the release button 4335 is configured to guide and actuate the latch pin 4740 so as to latch and unlatch the lock pawl 4735 with the latch plate assembly 4310. The latch pin 4740 is slidably received in the pin guide slots 4820 of the frame 4705, and the retention pin 4745 is received in the retention bar slot 4825 of the frame 4705. The ends of the latch pin 4740 extend laterally outside of the pin guide slots 4820 such that the ends of the latch pin 4740 are clipped inside the latch pin engagement channels 5030 of the release button 4335. During assembly, the spring retainer 4727 is slid onto the frame 4705 such that the ends of the latch pin 4740 are received inside the latch pin engagement channels 5030, and subsequently, the side clip arms 5020 of the actuator cap 4725 are clipped to the latch pin engagement channels 5030 so as to retain the ends of the latch pin 4740 in the release button 4335 by closing off the end openings of the latch pin engagement channels 5030. With this construction, the latch pin 4740 is not only actuated by the release button 4335, but the latch pin 4740 helps to retain and guide the release button 4335 when actuated. Among other things, this construction helps with assembly and simplifies the release mechanism 4710. Once more, the release button 4335 provides a smooth longitudinal or linear actuation motion.

Figure 52:
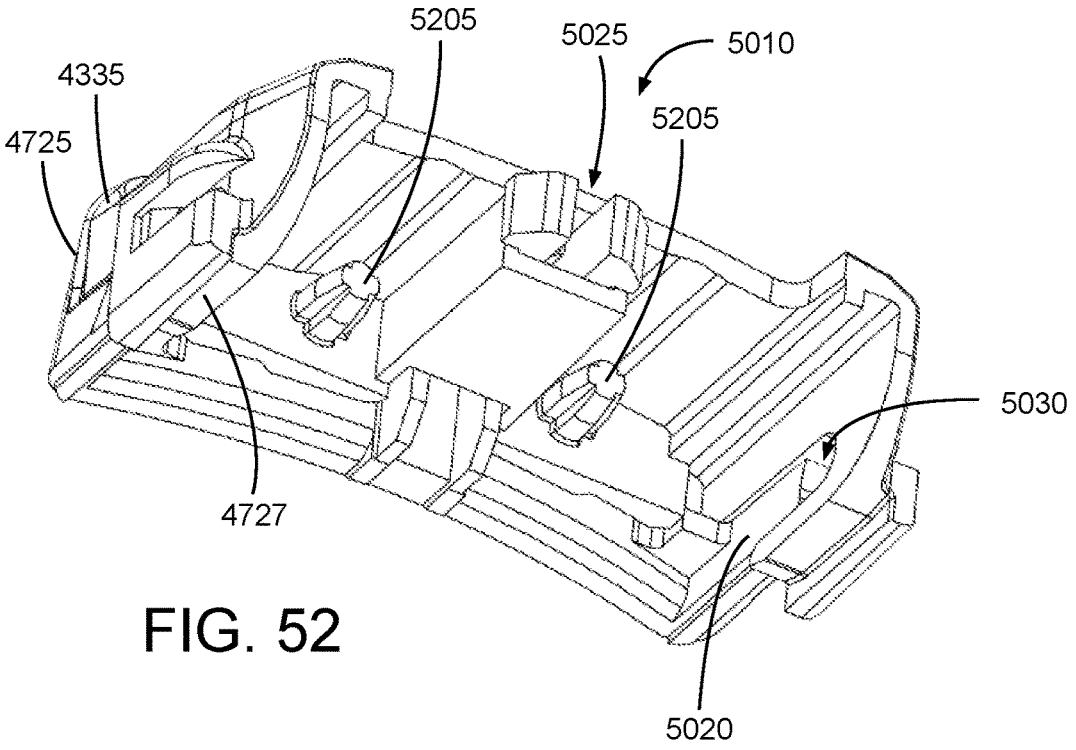
FIG. 52 is a bottom perspective view of the FIG. 50 release button.

Each of the side clip arms 5020 has a latch pin contact surface 5035 configured to actuate or move the latch pin 4740 in the pin guide slots 4820 of the frame 4705. In one example, the latch pin contact surface 5035 of each side clip arms 5020 is spaced away from the latch pin 4740 such that the release button 4335 needs to almost be fully depressed before releasing the latch plate assembly 4310. When pressing the release button 4335 in this example, the user will first feel just the resistance of the button springs 4730. Once the release button 4335 is pressed further, the latch pin contact surfaces 5035 contact the latch pin 4740, and the user experiences greater resistance. At this point, the side clip arms 5020 push the latch pin 4740 in the pin guide slot 4820 such that the latch pin 4740 releases the lock pawl 4735 from the formerly clipped latch plate assembly 4310. Having some play in the release button 4335 before releasing the latch plate assembly 4310 reduces the chance of accidental release of the latch plate assembly 4310. Turning to FIG. 52, the spring retainer 4727 of the release button 4335 has one or more spring seat pegs 5205 to which the button springs 4730 are seated to the release button 4335.

Figure 53:
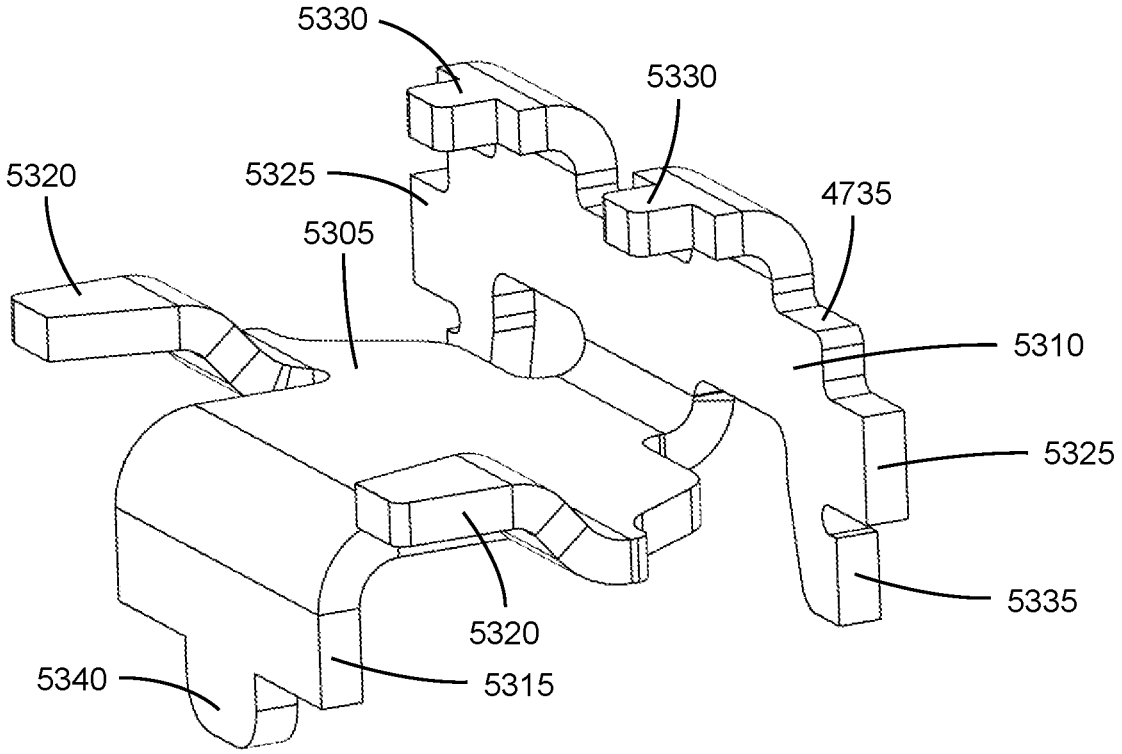
FIG. 53 is a front perspective view of a lock pawl in the FIG. 45 buckle mechanism.
Figure 54:
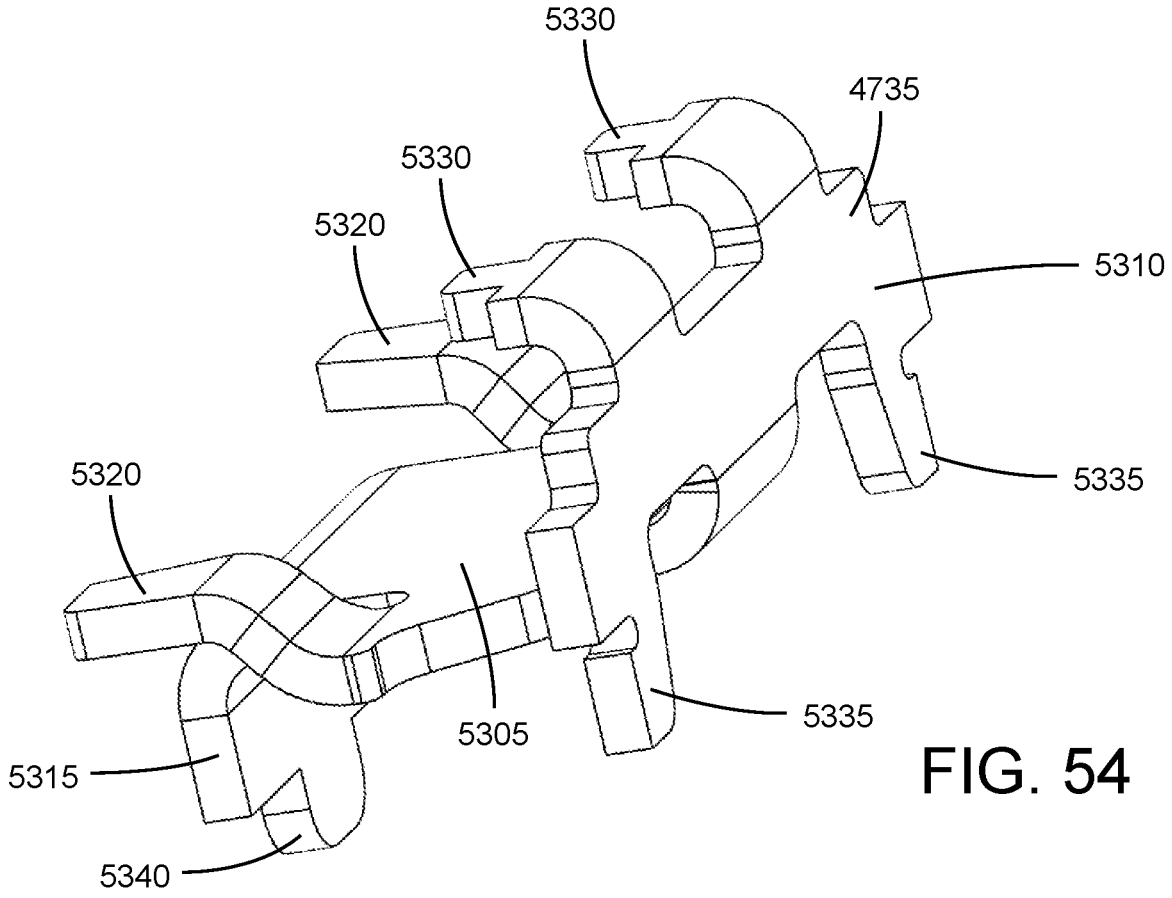
FIG. 54 is a rear perspective view of the FIG. 53 lock pawl.

As shown in FIGS. 53 and 54, the lock pawl 4735 has a latch body 5305 from where a hinge portion 5310 and lock portion 5315 extend at opposing ends. The hinge portion 5310 and lock portion 5315 extend in opposite transverse directions from the latch body 5305. One or more cam arms 5320 extend from the latch body 5305. In the depicted example, the cam arms 5320 extend at an acute angle from opposing lateral sides of the lock pawl 4735 and have a flat section that is spaced above the latch body 5305. As shown, the cam arms 5320 extend toward the lock portion 5315 and extend from the latch body 5305 in an opposite direction to the lock portion 5315. The cam arms 5320 provide a cam surface along where the latch pin 4740 is able to move. The latch pin 4740 engages near the ends of the cam arms 5320 to lock the lock pawl 4735 in the latched position with the latch plates 4312.

Referring again to FIG. 53, the hinge portion 5310 has one or more pivot tabs 5325 that are pivotally received in the latch pivot notch 4815 of the frame 4705 to facilitate pivotal movement of the lock pawl 4735 during latching and unlatching of the lock portion 5315 of the lock pawl 4735 with the latch plate assembly 4310. The hinge portion 5310 further has one or more spring seat fingers 5330 that extend towards the release button 4335 when the buckle mechanism 4400 is assembled. The spring seat fingers 5330 are configured to couple the ends of the button springs 4730 to the lock pawl 4735. As illustrated, the spring seat fingers 5330 are offset from the pivot tabs 5325 so as to create a moment arm that allows the release button 4335 via the button springs 4730 to pivot the lock pawl 4735 when the release button 4335 is pressed towards the lock pawl 4735.

Extending on a side opposite from the spring seat fingers 5330 relative to the pivot tabs 5325, the hinge portion 5310 has one or more ejector fingers 5335 positioned to engage the ejection slider 4750 of the ejector mechanism 4720. When the latch plate assembly 4310 is inserted into the buckle mechanism 4400, the ends of the tongues 4415 of the latch plates 4312 press against the ejector mechanism 4720. This pressing action pushes the ejection slider 4750 against the ejector fingers 5335 which in turn causes the lock pawl 4735 to rotate about the pivot tabs 5325 to latch with the latch plate assembly 4310. When the release button 4335 is pressed to eject the latch plate assembly 4310 from the buckle mechanism 4400, the lock pawl 4735 rotates in the opposite direction which in turn causes the ejector fingers 5335 to press against and move the ejection slider 4750 in the ejection direction resulting in the latch plate assembly 4310 being unlatched and ejected from the buckle mechanism 4400. The compressed ejection spring 4760 can provide additional force for ejecting the latch plate assembly 4310. As noted before, this construction allows the latch plate assembly 4310 to be unlatched and ejected even when the ejection spring 4760 is clogged with debris, damaged, and/or otherwise operating below operational norms.

At the end of the lock portion 5315, the lock pawl 4735 has a nose tab 5340 that helps to keep the lock pawl 4735 in an unlatched position until the latch plate assembly 4310 is properly seated inside the buckle 4305. The nose tab 5340 is sized to fit between the tips of the tongues 4415, and the lock portion 5315 is sized to engage the latch notches 4420 in the tongues 4415 when the latch plate assembly 4310 is latched. In the illustrated example, the lock portion 5315 is rounded to reduce wear on the ejection slider 4750.

Figure 55:
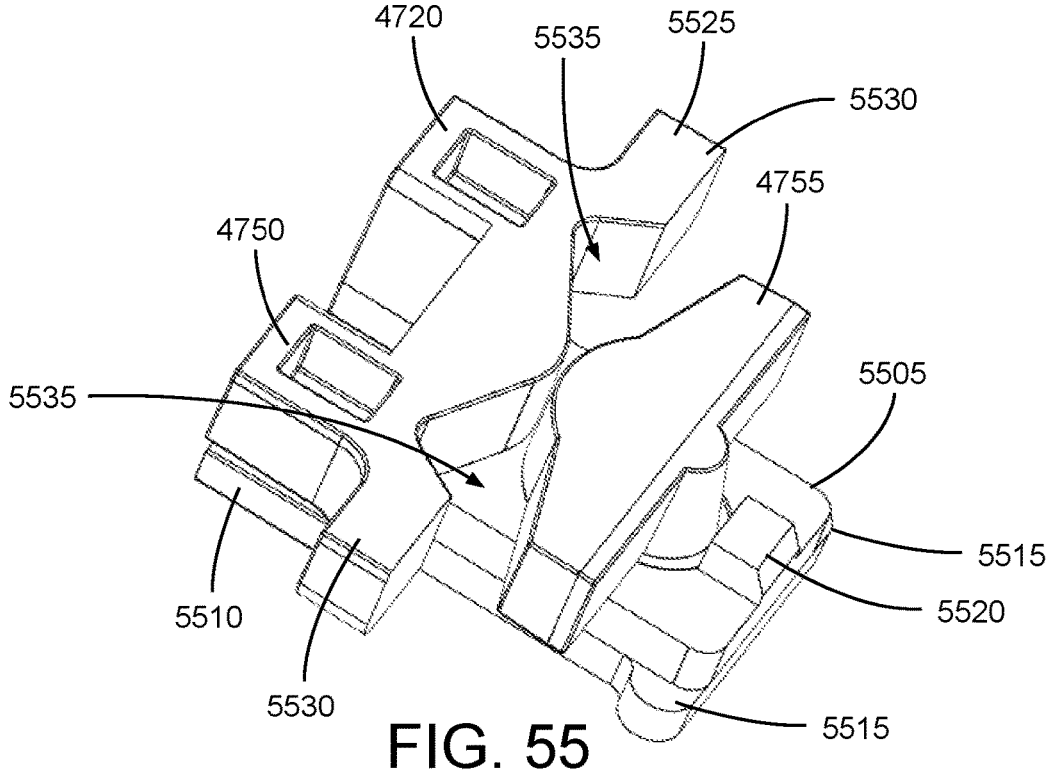
FIG. 55 is a top perspective view of an ejector mechanism in the FIG. 45 buckle mechanism.
Figure 56:
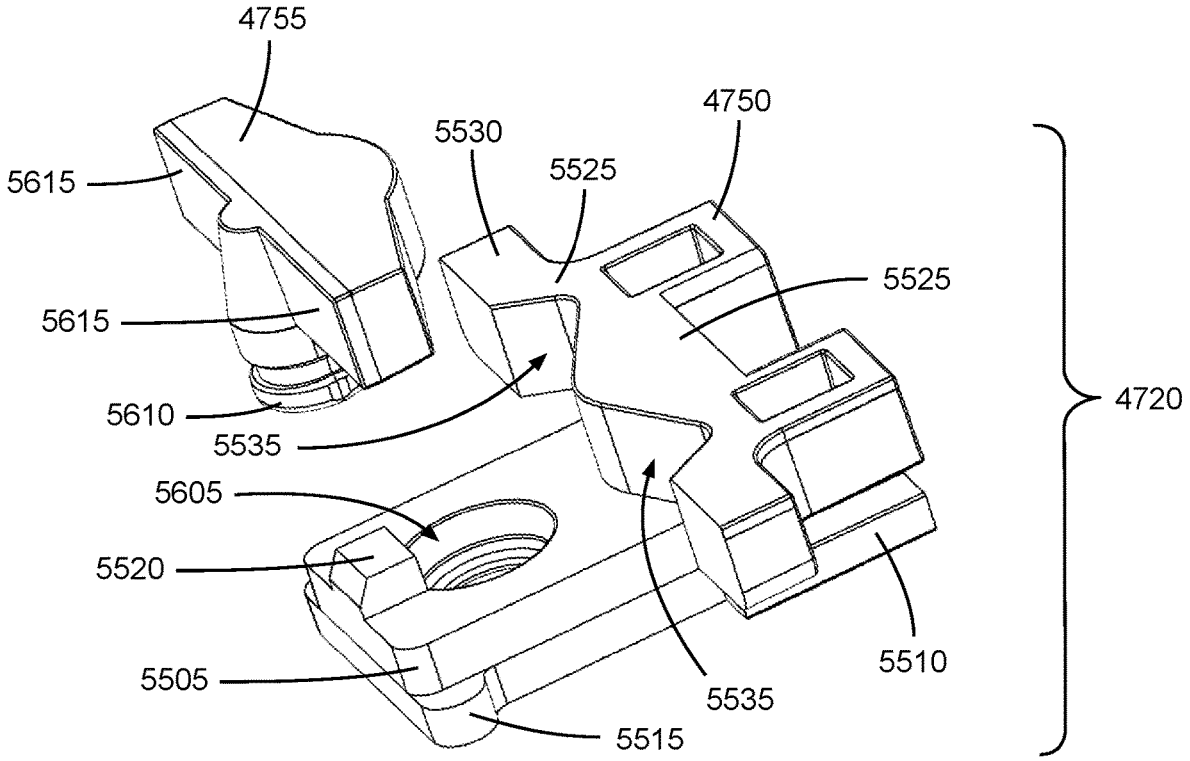
FIG. 56 is an exploded view of the FIG. 55 ejector mechanism.
Figure 57:
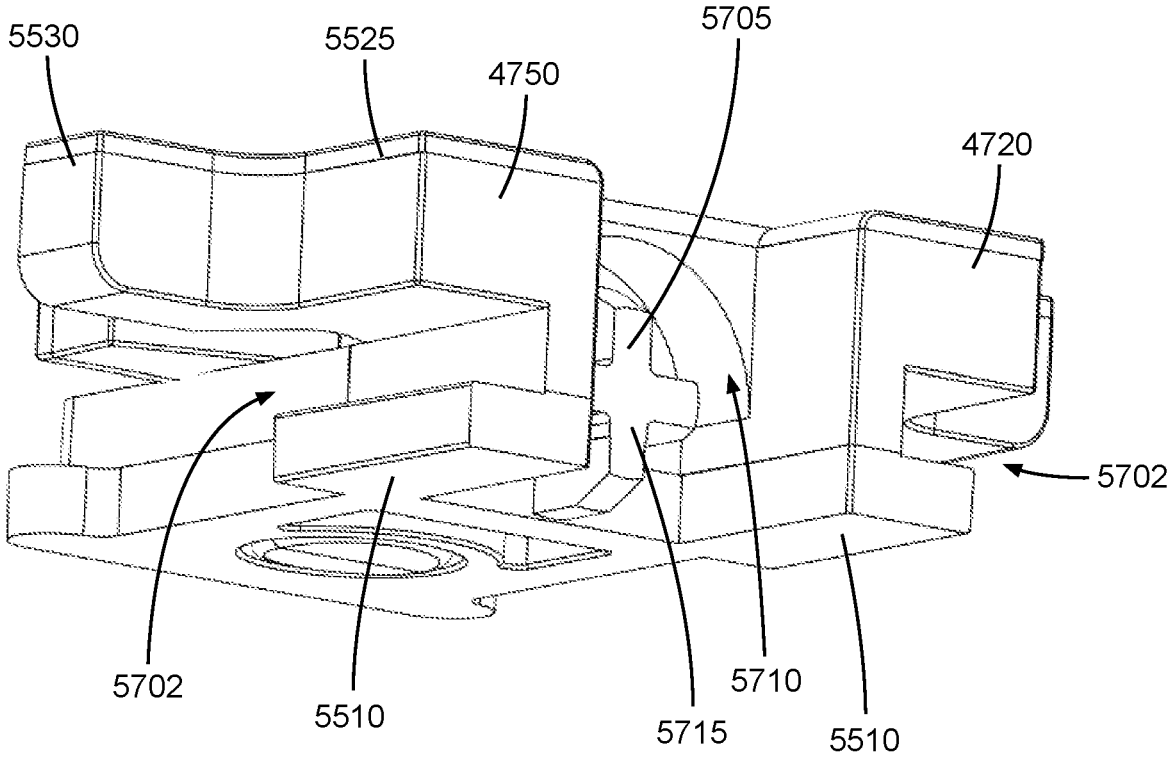
FIG. 57 is a bottom perspective view of the FIG. 55 ejector mechanism.

Turning to FIGS. 55, 56, and 57, the ejection slider 4750 of the ejector mechanism 4720 has a slider body 5505. One or more retention flanges 5510 and retention tabs 5515 extend in a lateral direction from the slider body 5505. The retention flanges 5510 and retention tabs 5515 are configured to retain the ejection slider 4750 on the frame 4705. The ejection slider 4750 further has a nose tab guide 5520 that extends from the surface of the slider body 5505. The nose tab guide 5520 is centered in front of the ejector swivel 4755. The nose tab guide 5520 is positioned to contact the nose tab 5340 so as to hold the lock pawl 4735 in the unlatched position until the latch plate assembly 4310 is properly positioned in the buckle mechanism 4200. Once the latch plate assembly 4310 is positioned for latching, the nose tab 5340 is able to slide past the nose tab guide 5520 as the lock pawl 4735 pivots to latch with the tongues 4415 of the latch plate assembly 4310. In the depicted example, the nose tab guide 5520 has a beveled edge that facilitates smooth sliding of the nose tab 5340 of the lock pawl 4735.

A latch bias wing 5525 of the ejection slider 4750 extends transverse to the slider body 5505. The latch bias wing 5525 has one or more wing tabs 5530 that extend from opposing ends of the latch bias wing 5525. The wing tabs 5530 in conjunction with the retention tabs 5515 help to retain the ejection slider 4750 in sliding engagement with the frame 4705. The wing tabs 5530 of the latch bias wing 5525 are positioned to be contacted with the ejector fingers 5335 when the lock pawl 4735 is pivoted to facilitate movement of the ejection slider 4750 for ejecting the latch plate assembly 4310. The latch bias wing 5525 further defines one or more relief notches 5535 configured to facilitate swiveling motion of the ejector swivel 4755 relative to the ejection slider 4750.

Referring to FIG. 56, the slider body 5505 of the ejection slider 4750 defines a connector opening 5605 to which the ejector swivel 4755 is connected in a swiveling manner. As shown, the ejector swivel 4755 has a pivot connector head 5610 that is received in the connector opening 5605 of the ejection slider 4750. In the illustrated example, the connector opening 5605 and pivot connector head 5610 form a snap fit type connection that facilitates rotational or swiveling movement of the ejector swivel 4755 relative to the ejection slider 4750. The ejection slider 4750 and ejector swivel 4755 in other examples can be connected together in other ways to facilitate swiveling motion. As shown, the ejector swivel 4755 has one or more tongue engagement arms 5615 where the tongues 4415 of the latch plate assembly 4310 contact the ejector swivel 4755 of the ejector mechanism 4720. The tongue engagement arms 5615 extend from opposing sides the ejector swivel 4755.

As noted before, the buckle mechanism 4200 is designed to prevent just a single latch plate 4312 from being secured without the other. In other words, the latch plates 4312 of the latch plate assembly 4310 must be properly aligned and coupled together before the lock pawl 4735 in the buckle mechanism 4200 is able to latch the latch plate assembly 4310 with the buckle 4305. When a single latch plate 4312 is inserted into the latch plate cavity 505 of the buckle 4305, the end of the tongue 4415 of the latch plate 4312 contacts just one of the tongue engagement arms 5615 such that ejector swivel 4755 begins to swivel. While the ejector swivel 4755 swivels, the ejection slider 4750 is stationary with the nose tab guide 5520 remaining in contact with the nose tab 5340 of the lock pawl 4735 such that the lock pawl 4735 stays in an unlatched position. When the single latch plate 4312 is inserted further into the buckle 4305, the relief notches 5535 in the latch bias wing 5525 allow the ejector swivel 4755 to further swivel while ejection slider 4750 remains stationary. The tongue engagement arms 5615 are then angled such that further insertion causes the end of the latch plate 4312 to slide in an outward lateral direction which in turn prevents the latch notch 4420 in the tongue 4415 from engaging the lock portion 5315 of the lock pawl 4735.

In contrast, when the latch plates 4312 are both properly coupled together and inserted at the same time into the latch plate cavity 505 of the buckle mechanism 4200, the ends of the latch plates 4312 contact the tongue engagement arms 5615 of the ejector mechanism 4720 at the same time, and the ejector swivel 4755 does not rotate or swivel. Against the biasing force of the of the ejection spring 4760, the latch plate assembly 4310 is able to slide the ejection slider 4750 in an insertion direction. This sliding movement of the ejection slider 4750 compresses the ejection spring 4760, and the resulting potential energy stored in the ejection spring 4760 can be later used to move the ejection slider 4750 in the ejection direction during unbuckling. As the latch plate assembly 4310 is further pushed into the buckle 4305, the ejection slider 4750 continues to slide in the insertion direction, and the nose tab 5340 of the lock pawl 4735 slides off the nose tab guide 5520 so that the lock pawl 4735 is able to latch to the latch notches 4420 in the latch plate assembly 4310. Eventually, as the ejection slider 4750 continues to slide, the wing tabs 5530 of the ejection slider 4750 press against the ejector fingers 5335 of the lock pawl 4735 (FIG. 53). When the ejector fingers 5335 are pressed, the lock pawl 4735 is able to pivot about the pivot tabs 5325 to have the lock portion 5315 latch in the latch notches 4420.

FIG. 57 shows one or more frame grooves 5702 that are formed between the retention flanges 5510 and latch bias wing 5525. These frame grooves 5702 in essence further extend between the tongue engagement arms 5615 of the ejector swivel 4755 and the retention tabs 5515 of the ejection slider 4750. With the frame grooves 5702, the ejection slider 4750 is able to be retained on and slide relative to the frame 4705. Looking at FIG. 57, the ejection slider 4750 further includes a spring seat 5705 to which the ejection spring 4760 is coupled. As shown, the spring seat 5705 has a spring cavity 5710 in which the ejection spring 4760 is received and a spring seat member 5715 to which the ejection spring 4760 is secured.

The buckle system 4300, and more particularly the buckle mechanism 4400, is designed to minimize the number of components so as to simplify assembly as well as enhance reliability. A technique for assembling various components of the buckle 4305 will now be initially described with reference to FIGS. 58 and 59. To improve visibility, various components, such as various springs, have been not shown in selected drawings, but it should be recognized that during assembly these components would be present. The ejector swivel 4755 is normally snap fitted to the ejection slider 4750 before being attached to the frame 4705, but the ejector swivel 4755 can be connected to the ejection slider 4750 after the ejection slider 4750 is secured to the frame 4705.

Figure 58:
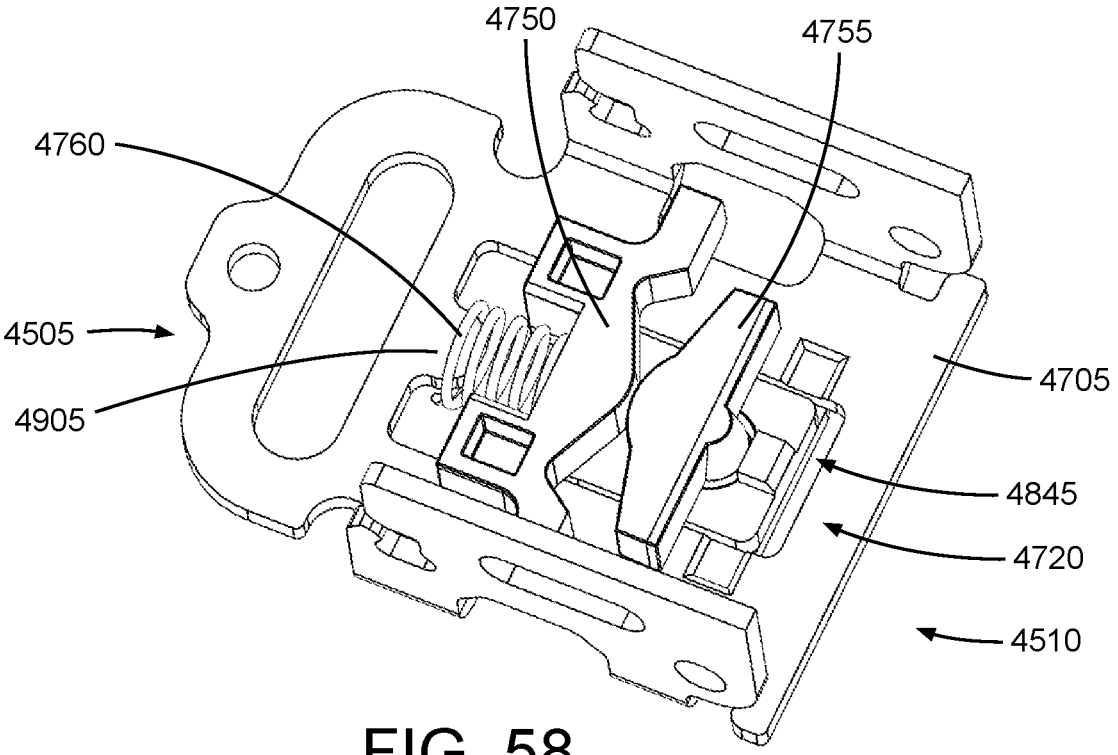
FIG. 58 is a top perspective view of a first subassembly of the FIG. 55 ejector mechanism.
Figure 59:
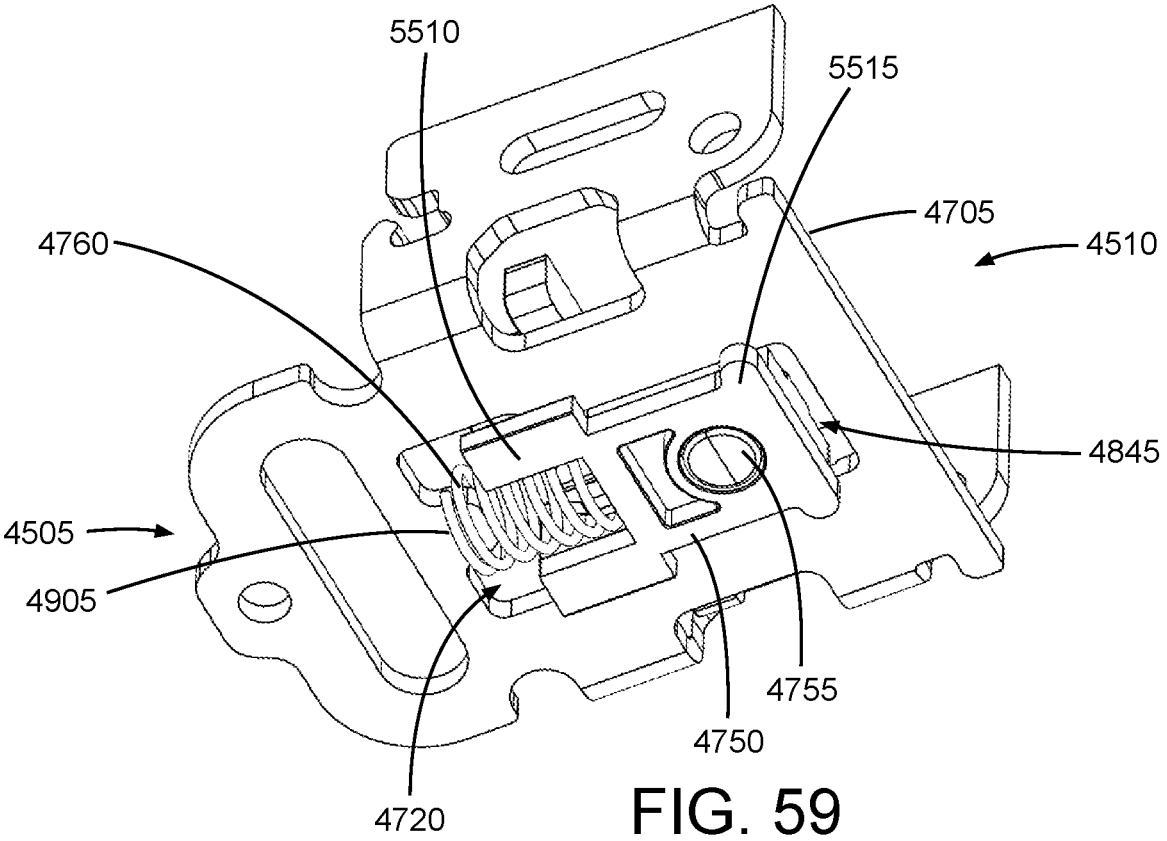
FIG. 59 is a bottom perspective view of the FIG. 58 subassembly.

Looking at FIGS. 58 and 59, to secure the ejection slider 4750 to the frame 4705, the ejection slider 4750 is slid within the ejector guide slot 4845 towards the latch plate coupling end 4510 of the frame 4705. The ends of the ejection spring 4760 are then coupled to the spring seat flange 4905 of the frame 4705 and the spring seat 5705 of the ejection slider 4750. The retention flanges 5510 and retention tabs 5515 along with the ejection spring 4760 retain the ejection slider 4750 on the frame 4705.

Figure 60:
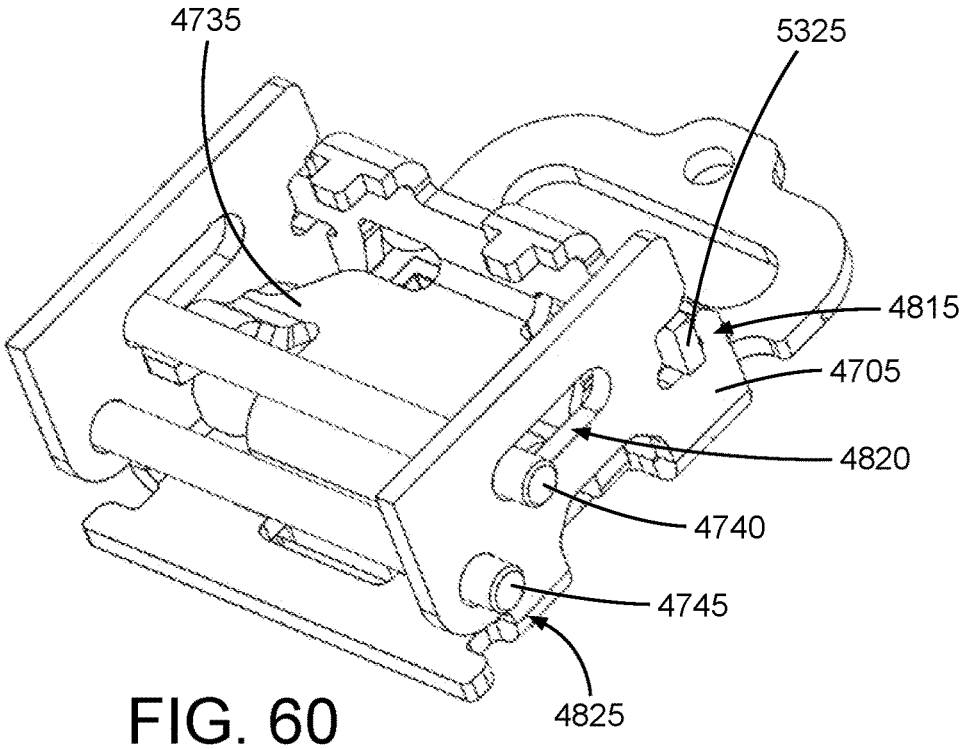
FIG. 60 is a top perspective view of a second subassembly of the FIG. 55 ejector mechanism.

Turning to FIG. 60, the lock pawl 4735 is coupled to the frame 4705 by inserting the pivot tabs 5325 of the lock pawl 4735 into the latch pivot notches 4815 in the frame 4705. The retention pin 4745 is secured to the retention bar slots 4825 of the frame 4705. It should be recognized that the retention pin 4745 can be secured at other times during the assembly process, such as before or after the ejector mechanism 4720 and/or lock pawl 4735 are secured to the frame 4705.

Figure 61:
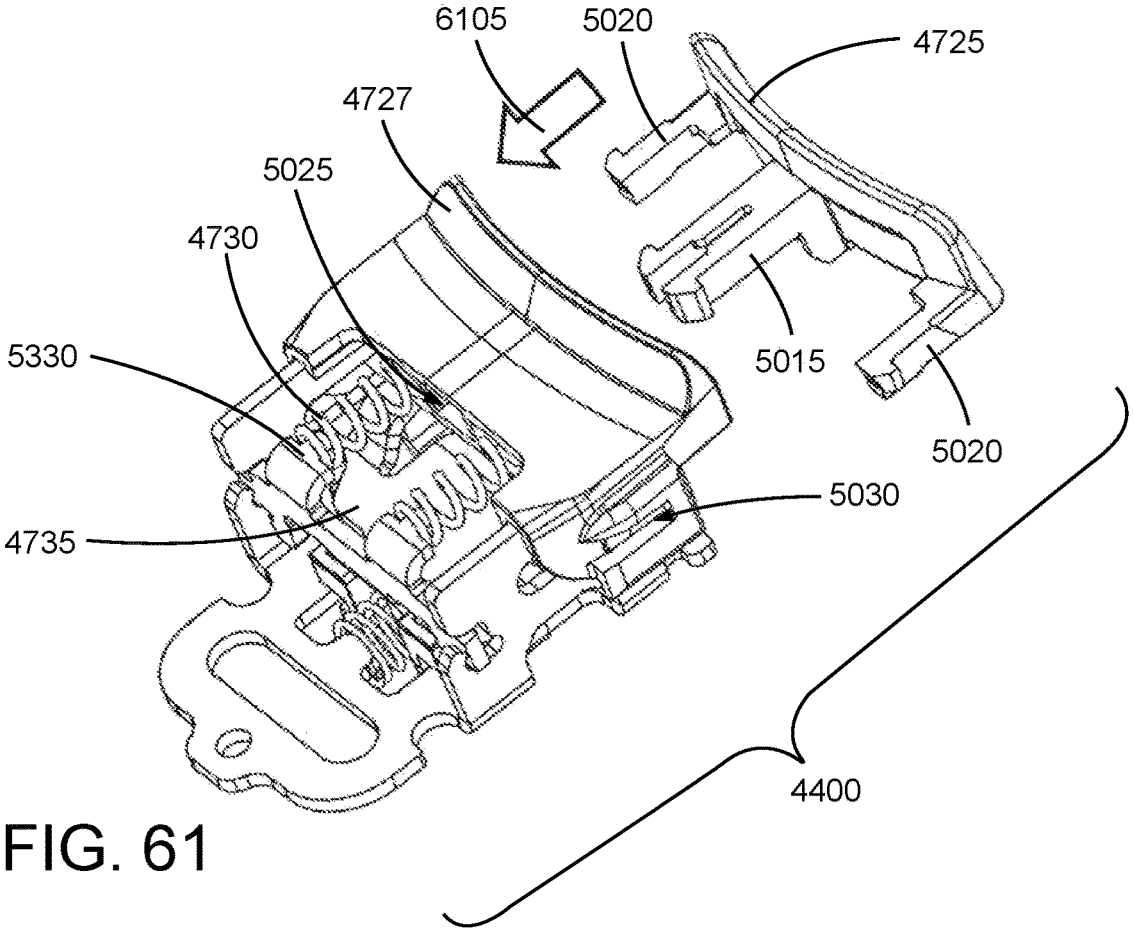
FIG. 61 is an exploded view of a third subassembly of the FIG. 55 ejector mechanism.

Referring now to FIG. 61, the latch pin 4740 is inserted into the pin guide slots 4820 of the frame 4705. The spring retainer 4727 is then secured to the frame 4705. The spring retainer 4727 is slid onto the frame 4705 such that the ends of the latch pin 4740 are received inside the latch pin engagement channels 5030, and as indicated by arrow 6105 in FIG. 61, the side clip arms 5020 of the actuator cap 4725 are clipped to the latch pin engagement channels 5030 so as to retain the ends of the latch pin 4740 in the release button 4335 by closing off the end openings of the latch pin engagement channels 5030.

Once the buckle mechanism 4400 is assembled, the buckle mechanism 4400 is then sandwiched inside the mechanism cover 4405 and base cover 4410 (FIG. 44) to form the housing 4330, and the mechanism cover 4405 and base cover 4410 are secured together, such as with fasteners, adhesives, etc. With the reduced number of components, the buckle 4305 can be assembled quickly and inexpensively. Again, it should be recognized that the components of the buckle 4305 can be assembled in a different order than is described and illustrated.

Figure 62:
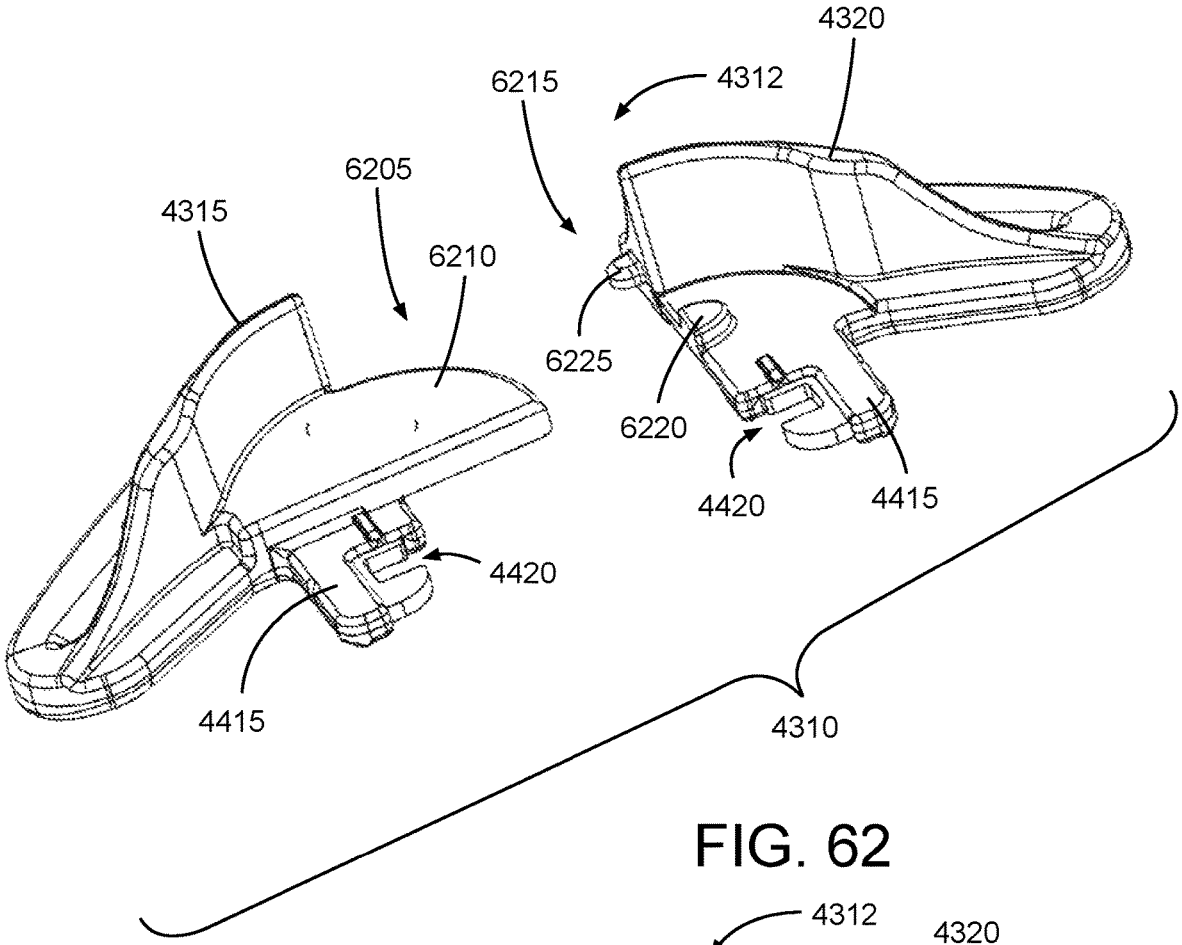
FIG. 62 is a top exploded view of a latch plate assembly in the FIG. 43 buckle system.
Figure 63:
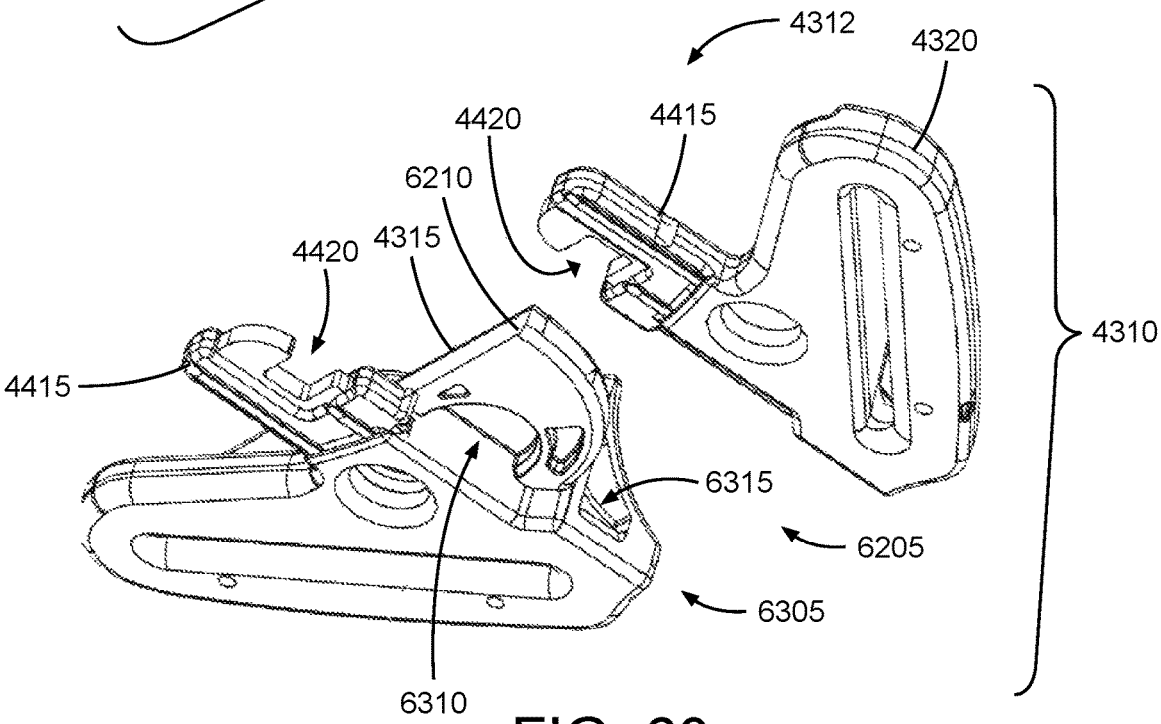
FIG. 63 is a bottom exploded view of the FIG. 62 latch plate assembly.

FIGS. 62 and 63 respectively illustrate top and bottom exploded views of the latch plate assembly 4310. The latch plates 4312 have a latch plate alignment system 6205 that is used to properly align the first latch plate 4315 with the second latch plate 4320 when coupled together. This latch plate alignment system 6205 ensures that the tongues 4415 of the latch plates 4312 contact the ejector swivel 4755 at the same time to ensure proper buckling. The latch plate alignment system 6205 includes an alignment flange 6210 on the first latch plate 4315 that covers a portion of the second latch plate 4320 when the latch plates 4312 are coupled together to minimize relative twisting motion between the latch plates 4312. The latch plate alignment system 6205 further includes one or more alignment protrusions 6215 that extend from the second latch plate 4320. In the depicted example, the alignment protrusions 6215 include a flange alignment protrusion 6220 and an end alignment protrusion 6225 that both extend from the second latch plate 4320.

Looking at FIG. 63, the latch plate alignment system 6205 further includes one or more alignment cavities 6305 on the first latch plate 4315 that are configured to receive the alignment protrusions 6215 of the second latch plate 4320. The alignment cavities 6305 include a flange alignment cavity 6310 defined in the alignment flange 6210 of the first latch plate 4315. The flange alignment cavity 6310 is configured to receive and engage with the flange alignment protrusion 6220 on the second latch plate 4320. At an end opposite the tongue 4415, the first latch plate 4315 defines an end alignment cavity 6315. The end alignment cavity 6315 is configured to receive the end alignment protrusion 6225 of the second latch plate 4320 when the first latch plate 4315 and second latch plate 4320 are properly coupled together. The latch plate alignment system 6205 in other variations can include other types of alignment systems such as through keying type structural arrangements and/or in other ways. For example, the latch plate alignment system 6205 in another form includes magnets with an opposite polarity arrangement on each of the latch plates 4312.

As should be recognized, the buckle system 4300 operates in the same general fashion as those described before. A technique for inserting and securing the latch plate assembly 4310 in the buckle 4305 will be initially described with reference to FIGS. 43, 44, and 47. Once more, the buckle mechanism 4400 is designed to prevent just a single latch plate 4312 from being secured without the other. In other words, the latch plates 4312 of the latch plate assembly 4310 must be properly aligned and coupled together before the lock pawl 4735 in the buckle mechanism 4200 is able to latch the latch plate assembly 4310 with the buckle 4305. When a single latch plate 4312 is inserted into the latch plate cavity 4605 of the buckle 4305, the ejector contact edge 3510 of the tongue 4415 of the latch plate 4312 contacts just one of the tongue engagement arms 5615 such that ejector swivel 4755 begins to swivel. While the ejector swivel 4755 swivels, the ejection slider 4750 is stationary with the nose tab guide 5520 remaining in contact with the nose tab 5340 of the lock pawl 4735 such that the lock pawl 4735 stays in an unlatched position. When the single latch plate 4312 is inserted further into the buckle 4305, the relief notches 5535 in the latch bias wing 5525 allow the ejector swivel 4755 to further swivel while ejection slider 4750 remains stationary. The tongue engagement arms 5615 are then angled such that further insertion causes the end of the latch plate 4312 to slide in an outward lateral direction which in turn prevents the latch notch 4420 in the tongue 4415 from engaging the lock portion 5315 of the lock pawl 4735.

As noted before, the latch plate alignment system 6205 of the latch plate assembly 4310 ensures that the tongues 4415 of the latch plates 4312 contact the ejector swivel 4755 at the same time to ensure proper buckling. To secure the latch plate assembly 4310 with the buckle 4305, the latch plate assembly 4310 is inserted into the latch plate cavity 4605 of the buckle 4305 in an insertion direction along the longitudinal axis 4515. When the latch plates 4312 are both properly coupled together and inserted at the same time into the latch plate cavity 4605 of the buckle mechanism 4400, the tongues 4415 at the latch notches 4420 contact the tongue engagement arms 5615 of the ejector mechanism 4720 at the same time, and the ejector swivel 4755 does not rotate or swivel. In other words, the forces applied by both tongues 4415 on the tongue engagement arms 5615 located on opposite sides of the pivot connector head 5610 balance one another, thereby preventing rotation of the ejector swivel 4755.

Against the biasing force of the ejection spring 4760, the latch plate assembly 4310 is able to slide the ejection slider 4750 in the insertion direction. This sliding movement of the ejection slider 4750 compresses the ejection spring 4760, and the resulting potential energy stored in the ejection spring 4760 can be later used to move the ejection slider 4750 during ejection of the latch plate assembly 4310. As the latch plate assembly 4310 is further pushed into the buckle 4305, the ejection slider 4750 continues to slide in the along the longitudinal axis 4515 in the insertion direction, and the nose tab 5340 of the lock pawl 4735 slides off the nose tab guide 5520 so that the lock pawl 4735 is able to latch to the latch notches 4420 in the latch plate assembly 4310. Eventually, as the ejection slider 4750 continues to slide, the wing tabs 5530 of the ejection slider 4750 press against the ejector fingers 5335 of the lock pawl 4735. When the ejector fingers 5335 are pressed, the lock pawl 4735 is able to pivot about the pivot tabs 5325 to have the lock portion 5315 latch in the latch notches 4420. After latching, the ejection spring 4760 may cause the ejection slider 4750 to slide back such that a space or gap is formed between the ejector fingers 5335 of the lock pawl 4735 and the wing tabs 5530 of the ejection slider 4750. This spacing gives some play in the actuator cap 4725 so as to prevent accidental release of the latch plate assembly 4310 when the actuator cap 4725 is accidentally or incidentally pressed.

When the latch plate assembly 4310 is buckled or latched in the buckle 4305, the lock portion 5315 of the lock pawl 4735 is received inside the latch plate assembly 4310. The tongues 4415 at the latch notches 4420 of the latch plate assembly 4310 are pressed or hooked against the lock portion 5315 of the lock pawl 4735. To prevent slippage, the side end edges of the lock portion 5315 are received in the latch alignment grooves 4920 of the frame 4705. The nose tab 5340 of the lock pawl 4735 extends through the ejector guide slot 4845 in the frame 4705. To further prevent accidental release, the latch pin 4740 presses against the cam arms 5320 of the lock pawl 4735 so as to hold the lock pawl 4735 in a latched position. With the pin guide slot 4820 only extending in a straight line along the longitudinal axis 4515, only the smooth linear motion of the actuator cap 4725 being pushed in a single direction along the longitudinal axis 4515 can release the latch pin 4740 such that the lock pawl 4735 can decouple from the latch plate assembly 4310. Movements in other directions will not cause the lock pawl 4735 to be accidentally unlatched. With the latch plate assembly 4310 latched in the buckle 4305, the occupant can be at least partially secured in the harness system 100, though additional tightening of the webbing 110 may be required.

To release the latch plate assembly 4310 from the buckle 4305, the user actuates the release button 4335. Once more, the release button 4335 is designed to smoothly slide in a straight direction along the longitudinal axis 4515 when pressed. An individual presses on the release button 4335 in a direction that is parallel to the longitudinal axis 4515 to release the latch plate assembly 4310. When the release button 4335 is pressed, the latch pin 4740, which is coupled to the release button 4335, longitudinally slides in the pin guide slot 4820 of the frame 4705 towards the web engagement end 4505. This movement in turn releases cam arms 5320 of the lock pawl 4735 from the latch pin 4740 such that the lock pawl 4735 is no longer locked in the latched position. At the same, the button springs 4730 are compressed between the release button 4335 and the ejector fingers 5335 of the lock pawl 4735. Due to this compression, the pressing force is transferred from the release button 4335 to the lock pawl 4735 via the button springs 4730. With the lock pawl 4735 now released by the latch pin 4740 and the force from the release button 4335 being applied to the spring seat fingers 5330, the lock pawl 4735 pivots about the pivot tabs 5325 in the latch pivot notch 4815 in a rotational direction.

As the lock pawl 4735 rotates, the lock portion 5315 of the lock pawl 4735 is removed or disengages from the latch notches 4420 of the latch plate assembly 4310. Around the same time, the pivoting motion of the lock pawl 4735 also causes the ejector fingers 5335 to push against the wing tabs 5530 of the ejector mechanism 4720 so as to cause the ejection slider 4750 to slide in an ejection direction. The ejection spring 4760 that was compressed when the latch plate assembly 4310 was buckled is now released so as to also push the ejection slider 4750 in the ejection direction. The ejector swivel 4755 of the ejector mechanism 4720 then pushes the latch plate assembly 4310 in the ejection direction so as to eject the latch plate assembly 4310. Again, the ejector fingers 5335 of the lock pawl 4735 allow the latch plate assembly 4310 to be unlatched and ejected even when the ejection spring 4760 is clogged with debris, damaged, and/or otherwise functionally inoperable. The buckle 4305 returns to the initial unbuckled state where the nose tab 5340 rests against the nose tab guide 5520 of the ejection slider 4750, and the release button 4335 is now at a partially retracted position, as was described before. With the latch plate assembly 4310 unlatched from the lock pawl 4735 and moved in the ejection direction, the latch plate assembly 4310 can be removed from the buckle 4305, and the occupant can be freed from the harness system 100.

Glossary of Terms

The language used in the claims and specification is to only have its plain and ordinary meaning, except as explicitly defined below. The words in these definitions are to only have their plain and ordinary meaning. Such plain and ordinary meaning is inclusive of all consistent dictionary definitions from the most recently published Webster's dictionaries and Random House dictionaries. As used in the specification and claims, the following definitions apply to these terms and common variations thereof identified below.

"Acute Angle" generally refers to an angle smaller than a right angle or less than 90 degrees.

"Couple" or "Coupled" generally refers to an indirect and/or direct connection between the identified elements, components, and/or objects. Often the manner of the coupling will be related specifically to the manner in which the two coupled elements interact.

"Fastener" generally refers to a hardware device that mechanically joins or otherwise affixes two or more objects together. By way of nonlimiting examples, the fastener can include bolts, dowels, nails, nuts, pegs, pins, rivets, screws, and snap fasteners, to just name a few.

"Frame" generally refers to a structure that forms part of an object and gives strength and/or shape to the object.

"Latch Plate" or "Latchplate" generally refers to a part of a vehicle belt assembly that releasably connects to a buckle and through which the webbing is threaded or otherwise secured. Typically, but not always, the latch plate is in at least part made of metal and/or plastic. The latch plate includes one or more tongues that are inserted into the buckle. Each tongue can include a notch or other opening that is used to secure the latch plate to the buckle. By way of non-limiting examples, the latch plates can include free-sliding latch plates, cinching latch plates, locking latch plates, and switchable latch plates, to name just a few examples.

"Lateral" generally refers to being situated on, directed toward, or coming from the side. "Longitudinal" generally relates to length or lengthwise dimension of an object, rather than across.

"Magnet" generally refers to a material or object that produces a magnetic field external to itself. Types of magnets include permanent magnets and electromagnets. By way of non-limiting examples, magnets in certain circumstances are able to attract (or repel) objects such as those made of iron or steel.

"Notch" generally refers to an indentation, cut, groove, channel, and/or incision on an edge or surface. In some non-limiting examples, the notch includes a V-shaped or U-shaped indentation carved, scratched, etched, stamped, and/or otherwise formed in the edge or surface. The notch can have a uniform shape or a non-uniform shape.

"Pin" or "Peg" generally refers to an elongated piece of material such as wood, metal, plastic and/or other material. Typically (but not always), the pin is tapered at one or both ends, but the pin can be shaped differently in other examples. For example, the ends of the pin can be flattened, widened, and/or bent in order to retain the pin. Pins can be used for any number of purposes. For example, the pin can be used in machines to couple components together or otherwise act as an interface between components. Pins can also be used for holding things together, hanging things on, and/or marking a position. Normally, but not always, the pin is a small, usually cylindrical piece. In certain cases, the pin is pointed and/or a tapered piece used to pin down, fasten things together, and/or designed to fit into holes. In other examples, the pin can have a polyhedral shape, such as with a rectangular or triangular cross-sectional shape, or an irregular shape.

"Seat Belt", "Safety Belt", "Vehicle Belt", or "Belt" generally refers to an arrangement of webs and other materials designed to restrain or otherwise hold a person or other object steady such as in a boat, vehicle, aircraft, and/or spacecraft. For example, the seat belt is designed to secure an occupant of a vehicle against harmful movement that may result during a collision or a sudden stop. By way of non-limiting examples, the seat belt can include webbing, buckles, latch plates, and/or length-adjustment mechanisms, such as a retractor, installed in the vehicle that is used to restrain an occupant or a child restraint system. The seat belt for instance can include a lap belt only, a combination lap-shoulder belt, a separate lap belt, a separate shoulder belt, and/or a knee bolster.

"Sensor" generally refers to an object whose purpose is to detect events and/or changes in the environment of the sensor, and then provide a corresponding output. Sensors include transducers that provide various types of output, such as electrical and/or optical signals. By way of nonlimiting examples, the sensors can include pressure sensors, ultrasonic sensors, humidity sensors, gas sensors, motion sensors, acceleration sensors, displacement sensors, force sensors, optical sensors, and/or electromagnetic sensors. In some examples, the sensors include barcode readers, RFID readers, and/or vision systems.

"Snap-Fit Connector" or "Snap-Fit Connection" generally refers to a type of attachment device including at least two parts, with at least one of which being flexible, that are interlocked with one another by pushing the parts together. The term "Snap-Fit Connector" may refer to just one of the parts, such as either the protruding or mating part, or both of the parts when joined together. Typically, but not always, the snap-fit connector includes a protrusion of one part, such as a hook, stud and/or bead, that is deflected briefly during the joining operation and catches in a depression and/or undercut in the mating part. After the parts are joined, the flexible snap-fit parts return to a stress-free condition. The resulting joint may be separable or inseparable depending on the shape of the undercut. The force required to separate the components can vary depending on the design. By way of non-limiting examples, the flexible parts are made of a flexible material such as plastic, metal, and/or carbon fiber composite materials. The snap-fit connectors can include cantilever, torsional and/or annular type snap-fit connectors. In the annular snap-fit type connector, the connector utilizes a hoop-strain type part to hold the other part in place. In one form, the hoop-strain part is made of an elastic material and has an expandable circumference. In one example, the elastic hoop-strain part is pushed onto a more rigid part so as to secure the two together. Cantilever snap-fit type connectors can form permanent type connections or can be temporary such that the parts can be connected and disconnected multiple times. A multiple use type snap-fit connector typically, but not always, has a lever or pin that is pushed in order to release the snap-fit connection. For a torsional snap fit connector, protruding edges of one part are pushed away from the target insertion area, and the other part then slides in between the protruding edges until a desired distance is reached. Once the desired distance is reached, the edges are then released such that the part is held in place.

"Spring" generally refers to an elastic object that stores mechanical energy. The spring can include a resilient device that can be pressed, pulled, and/or twisted but returns to its former shape when released. The spring can be made from resilient or elastic material such as metal and/or plastic The spring can counter or resist loads in many forms and apply force at constant or variable levels. For example, the spring can include a tension spring, compression spring, torsion spring, constant spring, and/or variable spring. The spring can take many forms such as by being a flat spring, a machined spring, and/or a serpentine spring. By way of nonlimiting examples, the springs can include various coil springs, pocket springs, Bonnell coils, offset coils, continuous coils, cantilever springs, volute springs, hairsprings, leaf springs, V-springs, gas springs, torsion springs, rubber bands, spring washers, and/or wave springs, to name just a few.

"Substantially" generally refers to the degree by which a quantitative representation may vary from a stated reference without resulting in an essential change of the basic function of the subject matter at issue. The term "substantially" is utilized herein to represent the inherent degree of uncertainty that may be attributed to any quantitative comparison, value, measurement, and/or other representation.

"Transverse" generally refers to an orientation in which the lines or objects extend in a crosswise direction relative to one. For example, the objects in the transverse orientation can extend in a perpendicular direction, at an acute angle, or at an obtuse angle relative to one another.

"Web" or "Webbing" generally refers to a strap made of a network of thread, strings, cords, wires, and/or other materials designed to restrain or otherwise hold a person or other object steady such as in a boat, vehicle, aircraft, and/or spacecraft. By way of non-limiting examples, the web can be incorporated into a seat belt, a child booster seat, and/or a car seat.

It should be noted that the singular forms "a," "an," "the," and the like as used in the description and/or the claims include the plural forms unless expressly discussed otherwise. For example, if the specification and/or claims refer to "a device" or "the device", it includes one or more of such devices.

It should be noted that directional terms, such as "up," "down," "top," "bottom," "lateral," "longitudinal," "radial," "circumferential," "horizontal," "vertical," etc., are used herein solely for the convenience of the reader in order to aid in the reader's understanding of the illustrated embodiments, and it is not the intent that the use of these directional terms in any manner limit the described, illustrated, and/or claimed features to a specific direction and/or orientation, unless expressly discussed otherwise.

The term "or" is inclusive, meaning "and/or".

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by the following claims are desired to be protected. All publications, patents, and patent applications cited in this specification are herein incorporated by reference as if each individual publication, patent, or patent application were specifically and individually indicated to be incorporated by reference and set forth in its entirety herein.

| Reference Numbers | |
|---|---|
| 100 | harness system |
| 105 | buckle system |
| 110 | webbing |
| 200 | buckle |
| 205 | latch plate assembly |
| 210 | web slots |
| 215 | housing |
| 220 | latch plates |
| 300 | buckle mechanism |
| 305 | mechanism cover |
| 310 | base cover |
| 315 | tongue |
| 320 | latch notch |
| 405 | web engagement end |
| 410 | latch plate coupling end |
| 415 | longitudinal axis |
| 505 | latch plate cavity |
| 605 | frame |
| 610 | release mechanism |
| 615 | latch mechanism |
| 620 | ejector mechanism |
| 625 | release button |
| 630 | button springs |
| 635 | lock pawl |
| 640 | latch pin |
| 645 | latch plate retention bar |
| 650 | ejection slider |
| 655 | ejector swivel |
| 660 | ejection spring |
| 1105 | base |
| 2315 | retention tabs |
| 2320 | nose tab guide |
| 2325 | latch bias wing |
| 2330 | wing tabs |
| 2335 | relief notches |
| 2405 | connector opening |
| 2410 | pivot connector head |
| 2415 | tongue engagement arms |
| 2505 | frame grooves |
| 2605 | spring seat |
| 2610 | spring cavity |
| 2615 | spring seat member |
| 3505 | magnetic coupling |
| 3510 | ejector contact edge |
| 3515 | beveled edge |
| 3520 | tongue gap |
| 3525 | latch cavity |
| 3530 | latch edge |
| 3705 | insertion direction |
| 3905 | arrow |
| 3910 | arrow |
| 3915 | ejection direction |
| 4000 | buckle |
| 4005 | release button |

-continued

| Reference Numbers | |
|---|---|
| 4010 | indicator |
| 4015 | persistent visible area |
| 4105 | base cover |
| 4110 | sensor |
| 4200 | buckle mechanism |
| 4205 | sensor arm |
| 4300 | buckle system |
| 4760 | ejection spring |
| 4805 | base |
| 4810 | support flanges |
| 4812 | latch plate channel |
| 4815 | latch pivot notch |
| 4820 | pin guide slot |
| 4825 | retention bar slot |
| 4830 | relief notches |
| 4835 | fastener opening |
| 4840 | web eye |
| 4845 | ejector guide slot |
| 4905 | spring seat flange |
| 4910 | spring seat facing relief notches |
| 4915 | guide channel |
| 4920 | latch alignment grooves |
| 5005 | cap body |
| 5010 | clip arms |
| 5015 | central clip arms |
| 5020 | side clip arms |
| 5025 | central clip cavity |
| 5030 | latch pin engagement channels |
| 5035 | latch pin contact surface |
| 5205 | spring seat pegs |
| 5305 | latch body |
| 5310 | hinge portion |
| 5315 | lock portion |
| 5320 | cam arms |
| 5325 | pivot tabs |
| 5330 | spring seat fingers |
| 5335 | ejector fingers |
| 5340 | nose tab |
| 1110 | support flanges |
| 1112 | latch plate channel |
| 1115 | latch pivot notch |
| 1120 | pin guide slot |
| 1125 | retention bar slot |
| 1130 | button guide notch |
| 1135 | fastener opening |
| 1140 | web eye |
| 1145 | ejector guide slot |
| 1305 | spring seat flange |
| 1310 | spring seat facing relief notches |
| 1315 | latch facing relief notches |
| 1320 | latch alignment grooves |
| 1405 | actuation surface |
| 1410 | frame engagement flanges |
| 1415 | pin openings |
| 1420 | stop lip |
| 1505 | spring seats |
| 1510 | seat |
| 1515 | guide flanges |
| 1705 | latch body |
| 1710 | hinge portion |
| 1715 | lock portion |
| 1720 | cam arms |
| 1725 | pivot tabs |
| 1730 | spring seat fingers |
| 1735 | ejector fingers |
| 1740 | nose tab |
| 2305 | slider body |
| 2310 | retention flanges |
| 4305 | buckle |
| 4310 | latch plate assembly |
| 4312 | latch plates |
| 4315 | first latch plate |
| 4320 | second latch plate |
| 4325 | web slots |
| 4330 | housing |
| 4335 | release button |
| 4340 | indicator |

-continued

| Reference Numbers | |
|---|---|
| 4345 | persistent visible area |
| 4400 | buckle mechanism |
| 4405 | mechanism cover |
| 4410 | base cover |
| 4415 | tongue |
| 4420 | latch notch |
| 4505 | web engagement end |
| 4510 | latch plate coupling end |
| 4515 | longitudinal axis |
| 4605 | latch plate cavity |
| 4705 | frame |
| 4710 | release mechanism |
| 4715 | latch mechanism |
| 4720 | ejector mechanism |
| 4725 | actuator cap |
| 4727 | spring retainer |
| 4730 | button springs |
| 4735 | lock pawl |
| 4740 | latch pin |
| 4745 | retention pin |
| 4750 | ejection slider |
| 4755 | ejector swivel |
| 5505 | slider body |
| 5510 | retention flanges |
| 5515 | retention tabs |
| 5520 | nose tab guide |
| 5525 | latch bias wing |
| 5530 | wing tabs |
| 5535 | relief notches |
| 5605 | connector opening |
| 5610 | pivot connector head |
| 5615 | tongue engagement arms |
| 5702 | frame grooves |
| 5705 | spring seat |
| 5710 | spring cavity |
| 5715 | spring seat member |
| 6105 | arrow |
| 6205 | latch plate alignment system |
| 6210 | alignment flange |
| 6215 | alignment protrusions |
| 6220 | flange alignment protrusion |
| 6225 | end alignment protrusion |
| 6305 | alignment cavities |
| 6310 | flange alignment cavity |
| 6315 | end alignment cavity |

What is claimed is:

1. A system, comprising:

a latch plate assembly; and a buckle including a lock pawl, pin slidable in a longitudinal direction within the buckle, wherein the pin is configured to lock the lock pawl, an ejector slider configured to eject the latch plate assembly, wherein the lock pawl has one or more ejector fingers positioned to engage the ejector slider, and wherein the lock pawl during unlatching of the latch plate assembly is configured to rotate to press the ejector fingers against the ejector slider to move the ejector slider to eject the latch plate assembly.

2. The system of claim 1, wherein the buckle includes a frame with one or more pivot notches pivotally engaged to the lock pawl.

3. The system of claim 2, wherein the frame has one or more pin guide slots extending in a longitudinal direction in which the pin is slidably received.

4. The system of claim 1, wherein the buckle includes one or more release springs seated to one or more spring seat fingers on the lock pawl.

5. The system of claim 4, further comprising:
a release button; and
wherein the release springs are disposed between the release button and the spring seat fingers.

6. The system of claim 5, wherein the release button includes a spring retainer in which the release springs are seated.

7. The system of claim 6, wherein the spring retainer has one or more latch pin engagement channels in which the pin is received.

8. The system of claim 7, wherein the release button includes a cap body with clip arms secured to the latch pin engagement channels to retain the pin.

9. The system of claim 8, wherein the clip arms each have a latch pin contact surface configured to move the latch pin.

10. The system of claim 5, wherein the lock pawl has one or more cam arms engageable by the pin to secure the lock pawl in a latched position.

11. The system of claim 10, wherein the release button is secured to the pin to actuate the pin to a position where the lock pawl is released.

12. The system of claim 1, further comprising:
a frame defining a guide slot; and
an ejector slider slidably received in the guide slot.

13. The system of claim 12, wherein the ejector slider has one or more retention tabs oriented to be received in corresponding notches in the guide slot.

14. The system of claim 12, further comprising:
wherein the frame has spring seat flange; and
an ejector spring disposed between the ejector slider and the spring seat flange of the frame.

15. The system of claim 1, wherein the buckle has a release button with an indicator that indicates when the buckle is properly secured.

16. The system of claim 1, wherein the buckle includes a sensor for sensing a state of the buckle.

17. The system of claim 1, wherein the latch plate assembly includes at least two latch plates.

18. The system of claim 17, wherein the latch plates include a latch plate alignment system configured to align the latch plates.

19. The system of claim 18, wherein the latch plate alignment system includes one or more magnets on the latch plates.

20. The system of claim 18, wherein the latch plate alignment system includes one or more alignment protrusions and one or more alignment cavities on the latch plates.

21. A system, comprising:
a latch plate assembly; and
a buckle including
a lock pawl, wherein the lock pawl has a nose tab,
a pin slidable in a longitudinal direction within the buckle,
wherein the pin is configured to lock the lock pawl,
an ejector slider configured to eject the latch plate assembly, wherein the ejector slider has a slider body and a nose tab guide extending from the slider body,
wherein the nose tab guide is configured to contact the nose tab to hold the lock pawl in an unlatched position until the latch plate assembly is positioned for latching, and
wherein the nose tab guide is configured to slide relative to the nose guide to allow the lock pawl to pivot to a latched position where the lock pawl latches to the latch plate assembly.

22. The system of claim 21, further comprising:
wherein the latch plate assembly includes at least two latch plates;
an ejector swivel pivotally coupled to the ejector slider;
wherein the nose tab guide is centered in front of the ejector swivel; and
wherein the ejector swivel is configured to swivel to inhibit latching of the lock pawl when a single latch plate of the latch plate assembly is inserted into the buckle.

23. The system of claim 21, wherein the latch plate assembly includes at least two latch plates.

24. The system of claim 23, wherein:
the latch plates include a latch plate alignment system configured to align the latch plates; and
the latch plate alignment system includes one or more magnets on the latch plates.

25. The system of claim 21, wherein the buckle includes a sensor for sensing a state of the buckle.

26. The system of claim 21, wherein the buckle has a release button with an indicator that indicates when the buckle is properly secured.

27. A system, comprising:
a latch plate assembly including two or more latch plates; and
a buckle including
a lock pawl,
a pin slidable in a longitudinal direction within the buckle,
wherein the pin is configured to lock the lock pawl,
an ejector slider,
an ejector swivel pivotally coupled to the ejector slider, and
wherein the ejector swivel is configured to swivel to inhibit latching of the lock pawl when a single latch plate of the latch plate assembly is inserted into the buckle.

28. The system of claim 27, wherein the latch plates include a latch plate alignment system configured to align the latch plates.

29. The system of claim 28, wherein the latch plate alignment system includes one or more magnets on the latch plates.

30. The system of claim 28, wherein the latch plate alignment system includes one or more alignment protrusions and one or more alignment cavities on the latch plates.

31. The system of claim 27, wherein the buckle has a release button with an indicator that indicates when the buckle is properly secured.

32. The system of claim 27, wherein the buckle includes a sensor for sensing a state of the buckle.

33. A system, comprising:
a latch plate assembly; and
a buckle including
a lock pawl,
a pin slidable in a longitudinal direction within the buckle,
wherein the pin is configured to lock the lock pawl,
a release button having a sensor arm, wherein the release button is configured to rotate the lock pawl to release the latch plate assembly from the lock pawl, and
a sensor configured to sense a relative position of the sensor arm to determine if the latch plate assembly is properly buckled.

34. The system of claim 33, further comprising:

an ejector slider, wherein the ejector slider has a slider body and a nose tab guide extending from the slider body;

wherein the lock pawl has a nose tab; and wherein the nose tab is configured to contact the nose tab guide on the ejector slider to inhibit latching after ejection of the latch plate assembly.

35. The system of claim 33, further comprising an ejector slider, wherein the ejector slider includes an ejector swivel configured to swivel to stop latching when a single latch plate is inserted.

36. The system of claim 35, wherein the ejector swivel is configured to redirect the single plate to stop latching of the lock pawl with the single plate.

* * * * *